US008111829B2

(12) United States Patent
Choo et al.

(10) Patent No.: US 8,111,829 B2
(45) Date of Patent: Feb. 7, 2012

(54) METHOD AND APPARATUS FOR ENCODING AND DECODING STEREO SIGNAL AND MULTI-CHANNEL SIGNAL

(75) Inventors: Ki-hyun Choo, Seoul (KR); Eun-mi Oh, Seongnam-si (KR); Jung-hoe Kim, Seoul (KR); Boris Kudryashov, Vladivostok (RU); Sergey Petrov, Vladivostok (RU)

(73) Assignee: Samsung Electronics Co., Ltd., Suwon-si (KR)

( * ) Notice: Subject to any disclaimer, the term of this patent is extended or adjusted under 35 U.S.C. 154(b) by 1141 days.

(21) Appl. No.: 11/876,947

(22) Filed: Oct. 23, 2007

(65) Prior Publication Data

US 2008/0253576 A1 Oct. 16, 2008

(30) Foreign Application Priority Data

Apr. 16, 2007 (KR) ..... 10-2007-0037165

(51) Int. Cl.
*H04H 40/54* (2008.01)

(52) U.S. Cl. ..... 381/10; 381/1; 381/17; 381/18; 381/19; 381/20; 381/21; 381/22; 381/23; 704/E19.005

(58) Field of Classification Search ..... None
See application file for complete search history.

(56) References Cited

U.S. PATENT DOCUMENTS

2007/0255572 A1* 11/2007 Miyasaka et al. ..... 704/500
2008/0091419 A1* 4/2008 Yoshida et al. ..... 704/219
2009/0171676 A1* 7/2009 Oh et al. ..... 704/500

* cited by examiner

*Primary Examiner* — Charles Garber
*Assistant Examiner* — Yasser Abdelaziez
(74) *Attorney, Agent, or Firm* — Stanzione & Kim, LLP

(57) ABSTRACT

Provided are a method and apparatus for encoding and decoding a stereo signal or a multi-channel signal. According to the method and apparatus, a stereo signal or a multi-channel signal can be encoded and/or decoded by generating parameters based on a mono signal.

20 Claims, 27 Drawing Sheets

METHOD AND APPARATUS FOR ENCODING AND DECODING STEREO SIGNAL AND MULTI-CHANNEL SIGNAL

CROSS-REFERENCE TO RELATED APPLICATIONS

This application claims the benefit of Korean Patent Application No. 10-2007-0037165, filed on Apr. 16, 2007, in the Korean Intellectual Property Office, the disclosure of which is incorporated herein in its entirety by reference.

BACKGROUND OF THE INVENTION

1. Field of the Invention

The present invention relates to encoding and decoding of a stereo signal and a multi-channel signal, and more particularly, to a method and apparatus for encoding and decoding a stereo signal or a multi-channel signal by using a parameter generated based on a mono signal.

2. Description of the Related Art

Conventionally, a stereo signal and a multi-channel signal are generally encoded by encoding information related to the differences between these signals for each channel. For example, the differences between the intensities, coherences, and phases of signals for each channel are extracted and then information related to the differences is encoded. A decoding terminal receives the encoded information, and decodes it into the stereo signal and the multi-channel signal by using the related information.

However, there is a need to encode or decode a stereo signal and a multi-channel signal, based on the differences between the stereo signal and a mono signal and between the multi-channel signal and the mono signal.

SUMMARY OF THE INVENTION

The present invention provides a method and apparatus for encoding or decoding a stereo signal or a multi-channel signal by generating parameters based on a mono signal.

Additional aspects and utilities of the present general inventive concept will be set forth in part in the description which follows and, in part, will be obvious from the description, or may be learned by practice of the general inventive concept.

According to an aspect of the present invention, there is provided a method of encoding a stereo signal, comprising: encoding the stereo signal by downmixing the stereo signal to a mono signal; generating and encoding a parameter that represents a ratio of the amplitude of at least one of signals contained in the stereo signal to the size of the mono signal; and generating and encoding a parameter that represents the difference between phases of at least one of the signals contained in the stereo signal and the mono signal.

According to another aspect of the present invention, there is provided a method of transmitting parameters, comprising: transmitting a parameter that represents a ratio of the amplitude of at least one of signals contained in a stereo signal to the amplitude of a mono signal; and transmitting a parameter that represents the difference between the phases of at least one of the signals contained in the stereo signal and the mono signal.

According to another aspect of the present invention, there is provided a method of decoding a stereo signal, comprising: decoding a parameter that represents a ratio of the amplitude of at least one of signals contained in the stereo signal to the amplitude of a mono signal; decoding a parameter that represents the difference between the phases of at least one of the signals contained in the stereo signal and the mono signal; and upmixing the mono signal to the stereo signal by using the decoded parameters.

According to another aspect of the present invention, there is provided a method of receiving parameters, comprising: receiving a parameter that represents a ratio of the amplitude of at least one of signals contained in a stereo signal to the amplitude of a mono signal; and receiving a parameter that represents the difference between the phases of at least one of the signals contained in the stereo signal and the mono signal.

According to another aspect of the present invention, there is provided a computer readable medium having recorded thereon a method of encoding a stereo signal, comprising: encoding the stereo signal by downmixing the stereo signal to a mono signal; generating and encoding a parameter that represents a ratio of the amplitude of at least one of signals contained in the stereo signal to the size of the mono signal; and generating and encoding a parameter that represents the difference between phases of at least one of the signals contained in the stereo signal and the mono signal.

According to another aspect of the present invention, there is provided a computer readable medium having recorded thereon a method of transmitting parameters, comprising: transmitting a parameter that represents a ratio of the amplitude of at least one of signals contained in a stereo signal to the amplitude of a mono signal; and transmitting a parameter that represents the difference between the phases of at least one of the signals contained in the stereo signal and the mono signal.

According to another aspect of the present invention, there is provided a computer readable medium having recorded thereon a method of decoding a stereo signal, comprising: decoding a parameter that represents a ratio of the amplitude of at least one of signals contained in the stereo signal to the amplitude of a mono signal; decoding a parameter that represents the difference between the phases of at least one of the signals contained in the stereo signal and the mono signal; and upmixing the mono signal to the stereo signal by using the decoded parameters.

According to another aspect of the present invention, there is provided a computer readable medium having recorded thereon a method of receiving parameters, comprising: receiving a parameter that represents a ratio of the amplitude of at least one of signals contained in a stereo signal to the amplitude of a mono signal; and receiving a parameter that represents the difference between the phases of at least one of the signals contained in the stereo signal and the mono signal.

According to another aspect of the present invention, there is provided an apparatus for encoding a stereo signal, comprising: a signal encoding unit encoding the stereo signal by downmixing the stereo signal to a mono signal and encoding; a size encoding unit generating and encoding a parameter that represents a ratio of the amplitude of at least one of signals contained in the stereo signal to the amplitude of the mono signal; and a phase encoding unit generating and encoding a parameter that represents the difference between the phases of at least one of the signals contained in the stereo signal and the mono signal.

According to another aspect of the present invention, there is provided an apparatus for transmitting parameters, comprising: a size parameter transmission unit transmitting a parameter that represents a ratio of the amplitude of at least one of signals contained in a stereo signal to the amplitude of a mono signal; and a phase parameter transmission unit transmitting a parameter that represents the difference between the phases of at least one of the signals contained in the stereo signal and the mono signal.

According to another aspect of the present invention, there is provided an apparatus for decoding a stereo signal, comprising: a size parameter decoding unit decoding a parameter that represents a ratio of the amplitude of at least one of signals contained in the stereo signal to the amplitude of a mono signal; a phase parameter decoding unit decoding a parameter that represents the difference between the phases of at least one of the signals contained in the stereo signal and the mono signal; and an upmixing unit upmixing the mono signal to the stereo signal by using the decoded parameters.

According to another aspect of the present invention, there is provided an apparatus for receiving parameters, comprising: a size parameter receiving unit receiving a parameter that represents a ratio of the amplitude of at least one of signals contained in a stereo signal to the amplitude of a mono signal; and a phase parameter receiving unit receiving a parameter that represents the difference between the phases of at least one of the signals contained in the stereo signal and the mono signal.

According to another aspect of the present invention, there is provided a method of encoding a multi-channel signal, comprising: encoding multi-channel signal containing two or more signals by downmixing the multi-channel signal to one or more signals; generating and encoding a parameter that represents a ratio of the amplitude of at least one of the signals of the multi-channel signal to the amplitude of at least one of the downmixed signals; and generating and encoding a parameter that represents the difference between phases of least one of the signals of the multi-channel signal and at least one of the downmixed signals.

According to another aspect of the present invention, there is provided a method of transmitting parameters, comprising: transmitting a parameter that represents a ratio of the amplitude of at least one of signals contained in a multi-channel signal to the amplitude of at least one of downmixed signals, where the multi-channel signal comprises at least two signals; and transmitting a parameter that represents the difference between phases of least one of the signals of the multi-channel signal and at least one of the downmixed signals.

According to another aspect of the present invention, there is provided a method of decoding a multi-channel signal, comprising: decoding a parameter that represents a ratio of the amplitude of at least one of the signals contained in the multi-channel signal to the amplitude of at least one of downmixed signals, where the multi-channel signal comprises at least two signals; decoding a parameter that represents the difference between phases of least one of the signals of the multi-channel signal and at least one of the downmixed signals; and upmixing the downmixed signals to the multi-channel signal by using the decoded parameters.

According to another aspect of the present invention, there is provided a method of receiving parameters, comprising: receiving a parameter that represents a ratio of the amplitude of at least one of signals contained in a multi-channel signal to the amplitude of at least one of downmixed signals, where the multi-channel signal comprises at least two signals; and receiving a parameter that represents the difference between phases of least one of the signals of the multi-channel signal and at least one of the downmixed signals.

According to another aspect of the present invention, there is provided a computer readable medium having recorded thereon a method of encoding a multi-channel signal, comprising: encoding multi-channel signal containing two or more signals by downmixing the multi-channel signal to one or more signals; generating and encoding a parameter that represents a ratio of the amplitude of at least one of the signals of the multi-channel signal to the amplitude of at least one of the downmixed signals; and generating and encoding a parameter that represents the difference between phases of least one of the signals of the multi-channel signal and at least one of the downmixed signals.

According to another aspect of the present invention, there is provided a computer readable medium having recorded thereon a method of transmitting parameters, comprising: transmitting a parameter that represents a ratio of the amplitude of at least one of signals contained in a multi-channel signal to the amplitude of at least one of downmixed signals, where the multi-channel signal comprises at least two signals; and transmitting a parameter that represents the difference between phases of least one of the signals of the multi-channel signal and at least one of the downmixed signals.

According to another aspect of the present invention, there is provided a computer readable medium having recorded thereon a method of decoding a multi-channel signal, comprising: decoding a parameter that represents a ratio of the amplitude of at least one of the signals contained in the multi-channel signal to the amplitude of at least one of downmixed signals, where the multi-channel signal comprises at least two signals; decoding a parameter that represents the difference between phases of least one of the signals of the multi-channel signal and at least one of the downmixed signals; and upmixing the downmixed signals to the multi-channel signal by using the decoded parameters.

According to another aspect of the present invention, there is provided a computer readable medium having recorded thereon a method of receiving parameters, comprising: receiving a parameter that represents a ratio of the amplitude of at least one of signals contained in a multi-channel signal to the amplitude of at least one of downmixed signals, where the multi-channel signal comprises at least two signals; and receiving a parameter that represents the difference between phases of least one of the signals of the multi-channel signal and at least one of the downmixed signals.

According to another aspect of the present invention, there is provided an apparatus for encoding a multi-channel signal, comprising: a signal encoding unit encoding the multi-channel signal by downmixing the multi-channel signal to one or more signals, wherein the multi-channel signal contains at least two signals; a size parameter encoding unit generating and encoding a parameter that represents a ratio of the amplitude of at least one of the signals of the multi-channel signal to the amplitude of at least one of the downmixed signals; and a phase parameter encoding unit generating and encoding a parameter that represents the difference between phases of least one of the signals of the multi-channel signal and at least one of the downmixed signals.

According to another aspect of the present invention, there is provided an apparatus for transmitting parameters, comprising: a size parameter transmission unit transmitting a parameter that represents a ratio of the amplitude of at least one of signals contained in a multi-channel signal to the amplitude of at least one of downmixed signals, where the multi-channel signal comprises two or more signals; and a phase parameter transmitting a parameter that represents the difference between phases of least one of the signals of the multi-channel signal and at least one of the downmixed signals.

According to another aspect of the present invention, there is provided an apparatus for decoding a multi-channel signal, comprising: a size parameter decoding unit decoding a parameter that represents a ratio of the amplitude of at least one of the signals contained in the multi-channel signal to the amplitude of at least one of downmixed signals, where the multi-channel signal comprises at least two signals; a phase parameter decoding unit decoding a parameter that represents the difference between phases of least one of the signals of the multi-channel signal and at least one of the downmixed signals; and an upmixing unit upmixing the downmixed signals to the multi-channel signal by using the decoded parameters.

According to another aspect of the present invention, there is provided a method of receiving parameters, comprising: a size parameter receiving unit receiving a parameter that represents a ratio of the amplitude of at least one of signals contained in a multi-channel signal to the amplitude of at least one of downmixed signals, where the multi-channel signal comprises at least two signals; and a phase parameter receiving unit receiving a parameter that represents the difference between phases of least one of the signals of the multi-channel signal and at least one of the downmixed signals.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

A method and apparatus for encoding and decoding a stereo signal and a multi-channel signal according to the present invention will now be described more fully with reference to the accompanying drawings, in which exemplary embodiments of the invention are shown.

Figure 1:
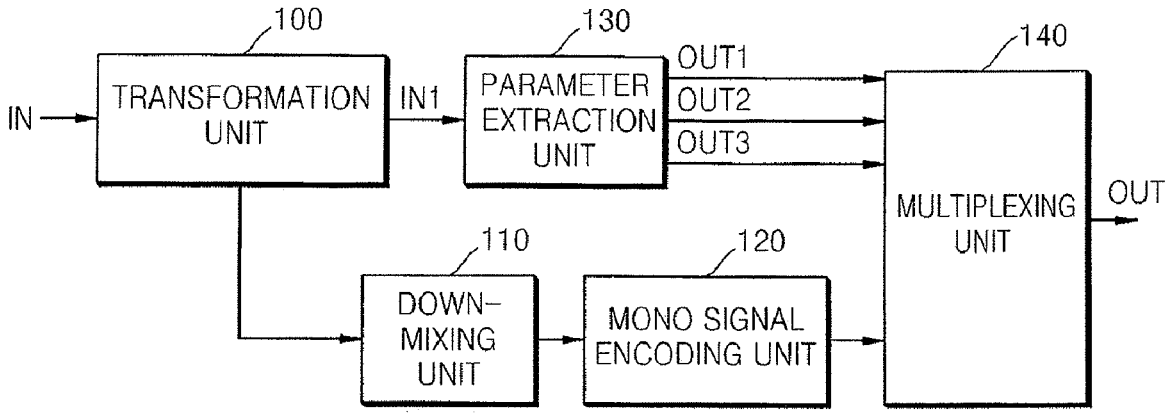
FIG. 1 is a block diagram of an apparatus for encoding a stereo signal, according to an embodiment of the present invention.

FIG. 1 is a block diagram of an apparatus for encoding a stereo signal, according to an embodiment of the present invention. The apparatus includes a transformation unit 100, a down-mixing unit 110, a mono signal encoding unit 120, a parameter extraction unit 130, and a multiplexing unit 140.

The transformation unit 100 transforms a stereo signal received via an input terminal IN into a predetermined domain by using an analysis filterbank. Here, the predetermined domain may have a complex-number format in which both the amplitude and phase of each signal can be expressed. For example, the predetermined domain allows each signal to be expressed in the time domain as spectra for each of the sub bands at predetermined frequency units, such as in a time-frequency domain.

The down-mixing unit 110 downmixes the stereo signal that is transformed into the predetermined domain to a mono signal.

In this case, the amplitude of the downmixed mono signal may be equal to the average of the amplitudes of a left-channel signal and a right-channel signal. Also, the mono signal may be generated on a half-sum vector of the left-channel signal and the right-channel signal.

The mono signal encoding unit 120 encodes the mono signal obtained by downmixing by the down-mixing unit 110.

The parameter extraction unit 130 extracts parameters from the stereo signal and encodes the parameters, where a decoding terminal uses the parameters in upmixing the mono signal to the stereo signal. The parameters are information for generating the left-channel signal and the right-channel signal based on the mono signal.

The parameters include a size parameter that represents the ratio of the amplitude of at least one of the left-channel signal and the right-channel signal to the amplitude of the mono signal, and a phase parameter that represents the difference between the phases of at least one of the left-channel signal and the right-channel signal and the mono signal. The parameters may further include an enhancement parameter for enhancing information contained in the size parameter and the phase parameter, using a decorrelated signal that is a vertical vector component of the mono signal.

The parameters may be generated for each frame and in band units.

The multiplexing unit 140 multiplexes the parameters encoded by the parameter extraction unit 130 and the mono signal encoded by the mono signal encoding unit 120 into a bitstream, and transmits the bitstream to the decoding terminal via an output terminal OUT.

Figure 2:
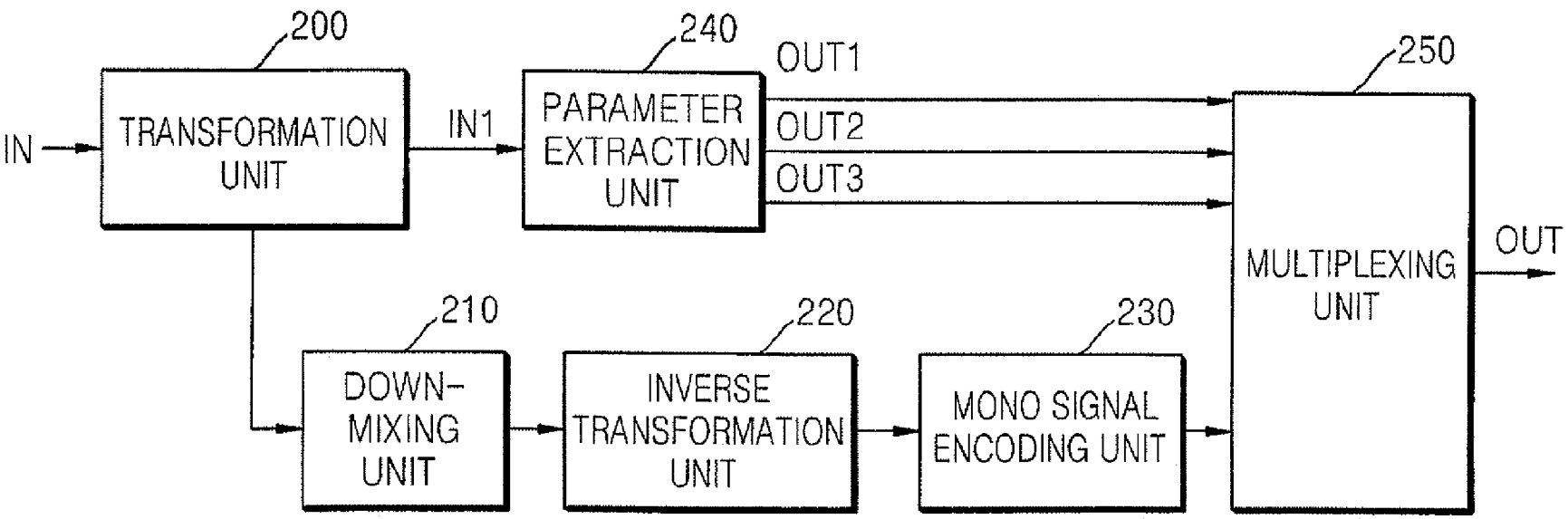
FIG. 2 is a block diagram of an apparatus for encoding a stereo signal, according to another embodiment of the present invention.

FIG. 2 is a block diagram of an apparatus for encoding a stereo signal, according to another embodiment of the present invention. The encoding apparatus includes a transformation unit 200, a down-mixing unit 210, an inverse transformation unit 220, a mono signal encoding unit 230, a parameter extraction unit 240, and a multiplexing unit 250.

The transformation unit 200 transforms a stereo signal received via an input terminal IN into a predetermined domain, using an analysis filterbank. Here, the predetermined domain may have a complex-number format in which both the amplitude and phase of each signal can be expressed. For example, the predetermined domain allows each signal to be expressed thetime domain for each of the sub bands at predetermined frequency units, using a Quadrature Mirror Filterbank (QMF) and/or Lapped Orthogonal Transform (LOT).

The down-mixing unit 210 downmixes the stereo signal that is transformed into the predetermined domain to a mono signal.

In this case, the amplitude of the downmixed mono signal may be equal to the average of the amplitudes of a left-channel signal and a right-channel signal. Also, the mono signal may be generated on a half-sum vector of the left-channel signal and the right-channel signal.

The inverse transformation unit 220 inversely transforms the domain of the mono signal in the reverse manner of that which transformation unit 200 performs, using a synthesis filterbank. For example, the inverse transformation unit 220 performs inverse transformation such that the mono signal that is expressed in the time domain as spectra for each of the sub bands at predetermined frequency units is expressed as a time series only in the time domain.

The mono signal encoding unit 230 encodes the mono signal that is inversely transformed by the inverse transformation unit 220.

The parameter extraction unit 240 extracts parameters from the stereo signal and encodes them, where a decoding terminal uses the parameters in upmixing the mono signal to the stereo signal. The parameters are information for generating the left-channel signal and the right-channel signal based on the mono signal.

The parameters include a size parameter that represents the ratio of the amplitude of at least one of the left-channel signal and the right-channel signal to the amplitude of the mono signal, and a phase parameter that represents the difference between the phases of at least one of the left-channel signal and the right-channel signal and the mono signal. The parameters may further include an enhancement parameter that contain information for enhancing information contained in the size parameter and the phase parameter, using a decorrelated signal that is a vertical vector component of the mono signal.

The parameters may be generated for each frame and in band units.

The multiplexing unit 250 multiplexes the parameters encoded by the parameter extraction unit 240 and the mono signal encoded by the mono signal encoding unit 230 into a bitstream, and transmits the bitstream to the decoding terminal via an output terminal OUT.

Figure 3:
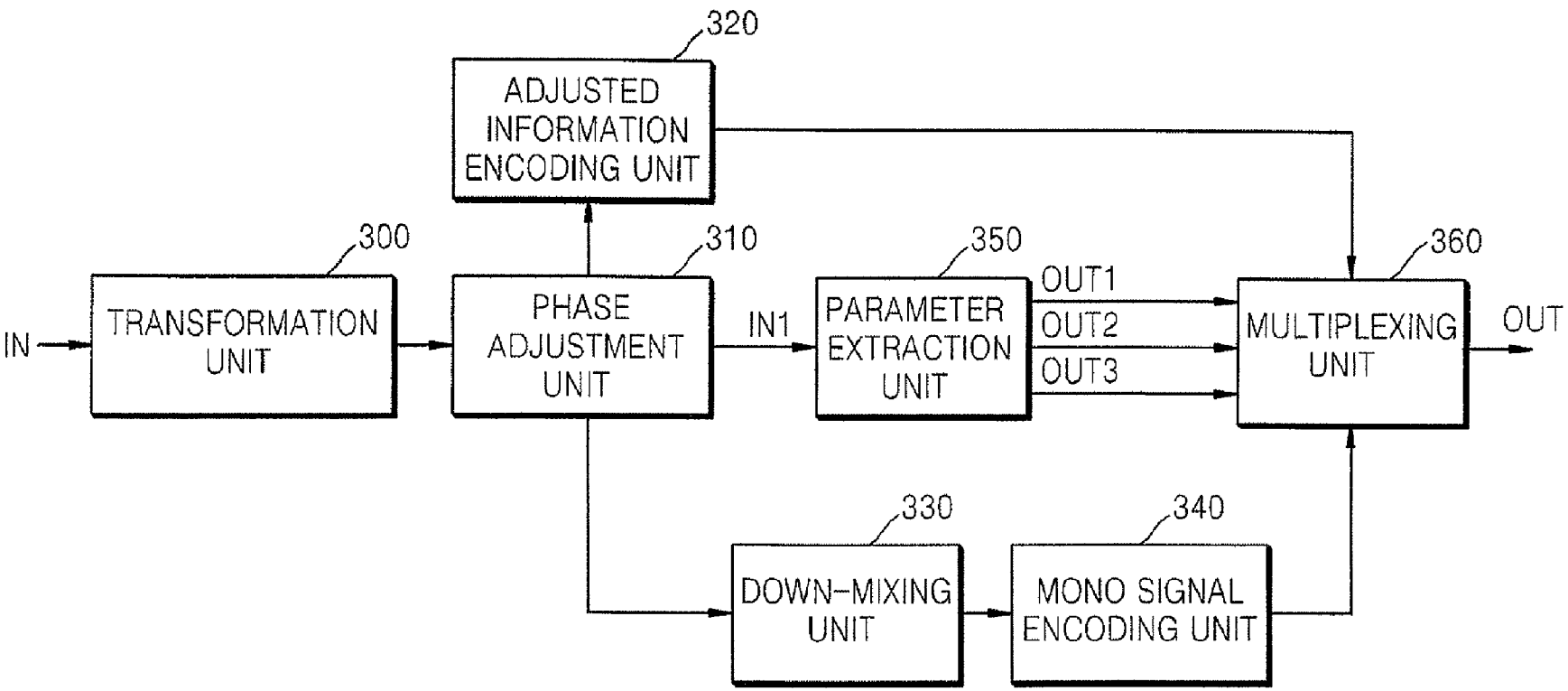
FIG. 3 is a block diagram of an apparatus for encoding a stereo signal, according to another embodiment of the present invention.

FIG. 3 is a block diagram of an apparatus for encoding a stereo signal, according to another embodiment of the present invention. The encoding apparatus includes a transformation unit 300, a phase adjustment unit 310, an adjusted information encoding unit 320, a down-mixing unit 330, a mono signal encoding unit 340, a parameter extraction unit 350, and a multiplexing unit 360.

The transformation unit 300 transforms a stereo signal received via an input terminal IN into a predetermined domain by using an analysis filterbank. Here, the predetermined domain may have a complex-number format in which both the amplitude and phase of each signal can be expressed. For example, the predetermined domain allows each signal to be expressed as spectra in the time domain for each of the sub bands at predetermined frequency units.

If the difference between the phases of a left-channel signal and a right-channel signal contained in the stereo signal transformed into the predetermined domain falls within a predetermined range, the phase adjustment unit 310 adjusts the phases of the left-channel signal and the right-channel signal by a predetermined phase. This is because the nearer the sum of the vectors of the left-channel signal and the right-channel signal approximates zero, the nearer the difference between the phases of the left-channel signal and the right-channel signal approximates 180 degrees. The predetermined range may be determined based on 180 degrees.

The phase adjustment unit 310 adjusts the phases of the left-channel signal and the right-channel signal by the same phase. For example, if the phase of the left-channel signal is adjusted by an angle of θ°, the phase of the right-channel signal is adjusted by an angle of −θ°.

A method of performing phase adjustment by the phase adjustment unit 310 according to an embodiment of the present invention will now be described. First, $S_{n,k}$ is calculated as follows:

$$S_{n,k} = \frac{L_{n,k} + R_{n,k}}{2}, \tag{1}$$

wherein $L_{n,k}$ denotes the left-channel signal, $R_{n,k}$ denotes the right-channel signal, n denotes a frame number, and k denotes a band number.

Next, $G_{n,k}$ is calculated by substituting $S_{n,k}$ into the following:

$$G_{n,k} = \frac{2|S_{n,k}|}{|L_{n,k}| + |R_{n,k}|} \tag{2}$$

The phase adjustment unit 310 determines whether to adjust the phases of the left-channel signal and the right-channel signal, depending on whether $G_{n,k}$ is less than $10^{-3}$ that is a predetermined threshold.

If $G_{n,k}$ is less than $10^{-3}$, the phase adjustment unit 310 determines that the phases of the left-channel signal and the right-channel signal are to be adjusted. If $G_{n,k}$ is equal to or greater than $10^{-3}$, the phase adjustment unit 310 determines that the phases of the left-channel signal and the right-channel signal are not to be adjusted.

If $G_{n,k}$ is less than $10^{-3}$, phase adjustment is performed by transforming $S_{n,k}$ as follows:

$$S_{n,k} = \frac{L_{n,k}e^{j\theta} + R_{n,k}e^{-j\theta}}{2}, \tag{3}$$

wherein $L_{n,k}$ denotes the left-channel signal, $R_{n,k}$ denotes the right-channel signal, θ denotes a predetermined phase value, e.g., π/100, n denotes a frame number, and k denotes a band number.

Thereafter, the final $S_{n,k}$ is calculated using $S_{n,k}$, as follows:

$$S_{n,k} = S_{n,k}\min\left\{2, \sqrt{\frac{|L_{n,k}|^2 + |R_{n,k}|^2}{2|S_{n,k}|^2}}\right\}, \tag{4}$$

wherein $S_{n,k}$ of the right-hand side of Equation (4) denotes a phasor calculated by Equation (3), $L_{n,k}$ denotes the left-channel signal, $R_{n,k}$ denotes the right-channel signal, n denotes a frame number, and k denotes a band number.

As will later be described in detail, the down-mixing unit 330 produces a mono signal by using $S_{n,k}$ calculated by Equation (4), as follows:

$$M_{n,k} = S_{n,k}\sqrt{\frac{\sum_{k=1}^{N}|L_{n,k}|^2 + |R_{n,k}|^2}{4\sum_{k=1}^{N}|S_{n,k}|^2}}, \tag{5}$$

wherein $M_{n,k}$ denotes the mono signal, $S_{n,k}$ denotes the phasor calculated by Equation (4), $L_{n,k}$ denotes the left-channel signal, $R_{n,k}$ denotes the right-channel signal, n denotes a frame number, and k denotes a band number.

If the phase adjustment unit 310 adjusts the phases of the left-channel signal and the right-channel signal, the adjusted information encoding unit 320 encodes information related to the adjusted phases. For example, if the phase adjustment unit 310 adjusts the phase of the left-channel signal by an angle of θ° and the phase of right-channel signal by an angle of −θ°, the adjusted information encoding unit 320 encodes information related to the value of the angle of θ°.

If the phase adjustment unit 310 adjusts the phase of the stereo signal, the down-mixing unit 330 downmixes the adjusted stereo signal to a mono signal. If the phase adjustment unit 310 does not adjust the phase of the stereo signal, the transformation unit 300 downmixes the stereo signal that is transformed into the predetermined domain to a mono signal.

The amplitude of the downmixed mono signal may be equal to the average of the amplitudes of a left-channel signal and a right-channel signal. Also, the mono signal may be generated on a half-sum vector of the left-channel signal and the right-channel signal.

The mono signal encoding unit 340 encodes the mono signal obtained by downmixing by the down-mixing unit 330.

The parameter extraction unit 350 extracts parameters from the stereo signal and encodes the parameters, where a decoding terminal uses the parameters in upmixing the mono signal to the stereo signal. The parameters are information for generating the left-channel signal and the right-channel signal based on the mono signal.

The parameters include a size parameter that represents the ratio of the amplitude of at least one of the left-channel signal and the right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter, using a decorrelated signal that is a vertical vector component of the mono signal.

The parameters may be generated for each frame and in band units.

The multiplexing unit 360 multiplexes the parameters encoded by the parameter extraction unit 350 and the mono signal encoded by the mono signal encoding unit 340 into a bitstream, and transmits the bitstream to the decoding terminal via an output terminal OUT. Also, if the phase adjustment unit 310 adjusts the phase of the stereo signal, the multiplexing unit 360 also multiplexes information related to the adjusted phase, which is encoded by the adjusted information encoding unit 320.

Figure 4:
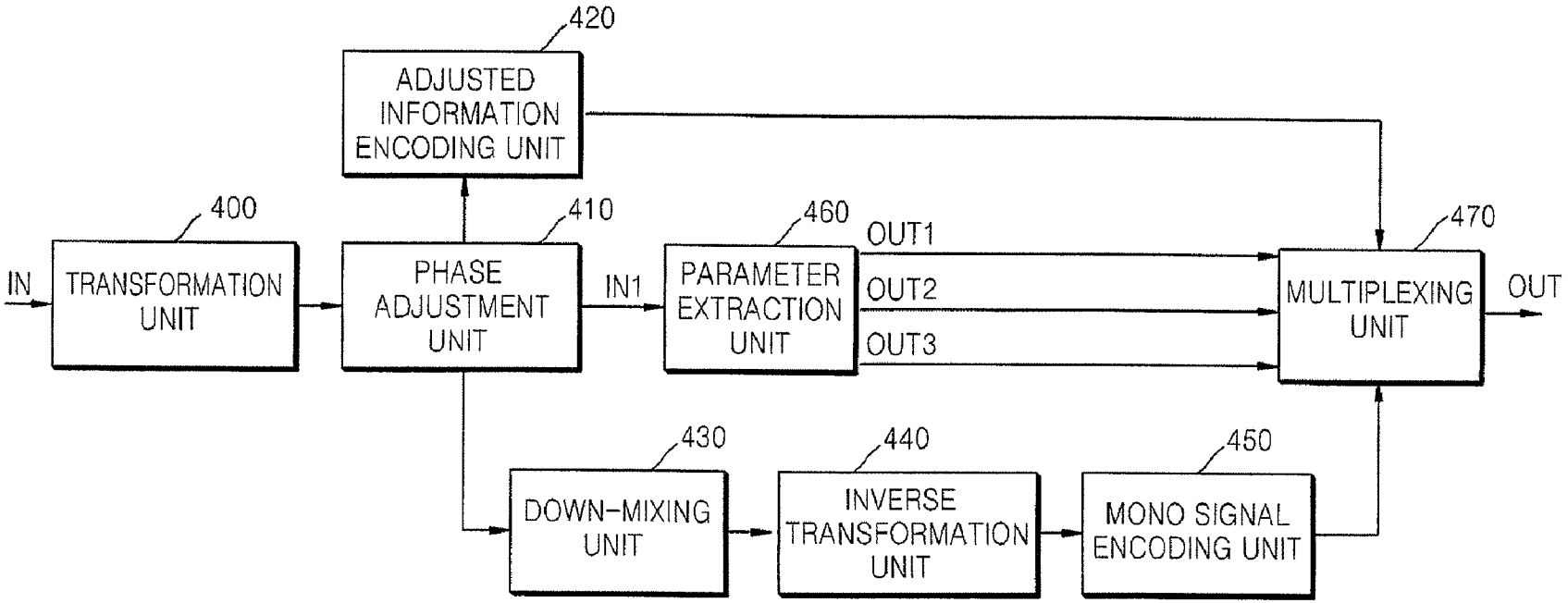
FIG. 4 is a block diagram of an apparatus for encoding a stereo signal, according to another embodiment of the present invention.

FIG. 4 is a block diagram of an apparatus for encoding a stereo signal, according to another embodiment of the present invention. The encoding apparatus includes a transformation unit 400, a phase adjustment unit 410, an adjusted information encoding unit 420, a down-mixing unit 430, an inverse transformation unit 440, a mono signal encoding unit 450, a parameter extraction unit 460, and a multiplexing unit 470.

The transformation unit 400 transforms a stereo signal received via an input terminal IN into a predetermined domain by using an analysis filterbank. Here, the predetermined domain may have a complex-number format in which both the amplitude and phase of each signal can be expressed. For example, the predetermined domain allows each signal to be expressed as a time domain for each of sub bands in predetermined frequency units.

If the difference between the phases of a left-channel signal and a right-channel signal contained in the stereo signal transformed into the predetermined domain falls within a predetermined range, the phase adjustment unit 410 adjusts the phases of the left-channel signal and the right-channel signal by a predetermined phase. This is because the nearer the difference between the phases of the left-channel signal and the right-channel signal approximates 180 degrees, the nearer the sum of the vectors of the left-channel signal and the right-channel signal approximates zero. The predetermined range may be determined based on 180 degrees.

The phase adjustment unit 410 adjusts the phases of the left-channel signal and the right-channel signal by the same phase. For example, if the phase of the left-channel signal is adjusted by an angle of θ°, the phase of the right-channel signal is adjusted by an angle of −θ°.

A method of performing phase adjustment by the phase adjustment unit 410 according to an embodiment of the present invention will now be described. First, $S_{n,k}$ is calculated by the following:

$$S_{n,k} = \frac{L_{n,k} + R_{n,k}}{2}, \tag{6}$$

wherein $L_{n,k}$ denotes the left-channel signal, $R_{n,k}$ denotes the right-channel signal, n denotes a frame number, and k denotes a band number.

Next, $G_{n,k}$ is calculated by substituting $S_{n,k}$ into the following:

$$G_{n,k} = \frac{2|S_{n,k}|}{|L_{n,k}| + |R_{n,k}|} \tag{7}$$

The phase adjustment unit 410 determines whether to adjust the phases of the left-channel signal and the right-channel signal, depending on whether $G_{n,k}$ is less than $10^{-3}$ that is a predetermined threshold.

If $G_{n,k}$ is less than $10^{-3}$, the phase adjustment unit 410 determines that the phases of the left-channel signal and the right-channel signal are to be adjusted. If $G_{n,k}$ is equal to or greater than $10^{-3}$, the phase adjustment unit 410 determines that the phases of the left-channel signal and the right-channel signal are not to be adjusted.

If $G_{n,k}$ is less than $10^{-3}$, phase adjustment is performed by transforming $S_{n,k}$ as follows:

$$S_{n,k} = \frac{L_{n,k}e^{j\theta} + R_{n,k}e^{-j\theta}}{2}, \tag{8}$$

wherein $L_{n,k}$ denotes the left-channel signal, $R_{n,k}$ denotes the right-channel signal, θ denotes a predetermined value, e.g., π/100, n denotes a frame number, and k denotes a band number.

Thereafter, $S_{n,k}$ is calculated using $S_{n,k}$, as follows:

$$S_{n,k} = S_{n,k}\min\left\{2, \sqrt{\frac{|L_{n,k}|^2 + |R_{n,k}|^2}{2|S_{n,k}|^2}}\right\}, \tag{9}$$

wherein $S_{n,k}$ of the right-hand side of Equation (9) denotes a phasor calculated by Equation (8), $L_{n,k}$ denotes the left-channel signal, $R_{n,k}$ denotes the right-channel signal, n denotes a frame number, and k denotes a band number.

As will later be described in detail, the down-mixing unit 430 produces a mono signal by using $S_{n,k}$ calculated by Equation (9), as follows:

$$M_{n,k} = S_{n,k}\sqrt{\frac{\sum_{k=1}^{N}|L_{n,k}|^2 + |R_{n,k}|^2}{4\sum_{k=1}^{N}|S_{n,k}|^2}}, \tag{10}$$

wherein $M_{n,k}$ denotes the mono signal, $S_{n,k}$ denotes the phasor calculated by Equation (9), $L_{n,k}$ denotes the left-channel signal, $R_{n,k}$ denotes the right-channel signal, n denotes a frame number, and k denotes a band number.

If the phase adjustment unit 410 adjusts the phases of the left-channel signal and the right-channel signal contained in the stereo signal since the difference between the phases falls within the predetermined range, the adjusted information encoding unit 420 encodes information related to the adjusted phases. For example, if the phase adjustment unit 420 adjusts the phase of the left-channel signal by an angle of θ°and the phase of right-channel signal by an angle of −θ°, the adjusted information encoding unit 320 encodes information related to the value of the angle of θ°.

If the phase adjustment unit 410 adjusts the phase of the stereo signal, the down-mixing unit 430 downmixes the adjusted stereo signal to a mono signal. If the phase adjustment unit 310 does not adjust the phase of the stereo signal, the transformation unit 300 downmixes the stereo signal that is transformed into the predetermined domain to a mono signal.

The amplitude of the downmixed mono signal may be equal to the average of the amplitudes of a left-channel signal and a right-channel signal. Also, the mono signal may be generated on a half-sum vector of the left-channel signal and the right-channel signal.

The inverse transformation unit 440 inversely transforms the domain of the mono signal downmixed by the downmixing unit 430 in the reverse manner that the transformation unit 400 performs transformation, using a synthesis filterbank. For example, the inverse transformation unit 440 performs inverse transformation such that the mono signal that is expressed as spectra in thetime domain for each of sub bands at predetermined frequency units is expressed as a time series only in a time domain.

The mono signal encoding unit 450 encodes the mono signal inversely transformed by the inverse transformation unit 440.

The parameter extraction unit 460 extracts parameters from the stereo signal and encodes the parameters, where a decoding terminal uses the parameters in upmixing the mono signal to the stereo signal. The parameters are information for generating the left-channel signal and the right-channel signal based on the mono signal.

The parameters include a size parameter that represents the ratio of the amplitude of at least one of the left-channel signal and the right-channel signal to the amplitudes of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter, using a decorrelated signal that is a vertical vector component of the mono signal.

The parameters may be generated for each frame and in band units.

The multiplexing unit 470 multiplexes the parameters encoded by the parameter extraction unit 460 and the mono signal encoded by the mono signal encoding unit 450 into a bitstream, and transmits the bitstream to the decoding terminal via an output terminal OUT. Also, if the phase adjustment unit 410 adjusts the phase of the stereo signal, the multiplexing unit 470 also multiplexes information related to the adjusted phase, which is encoded by the adjusted information encoding unit 420.

Figure 5:
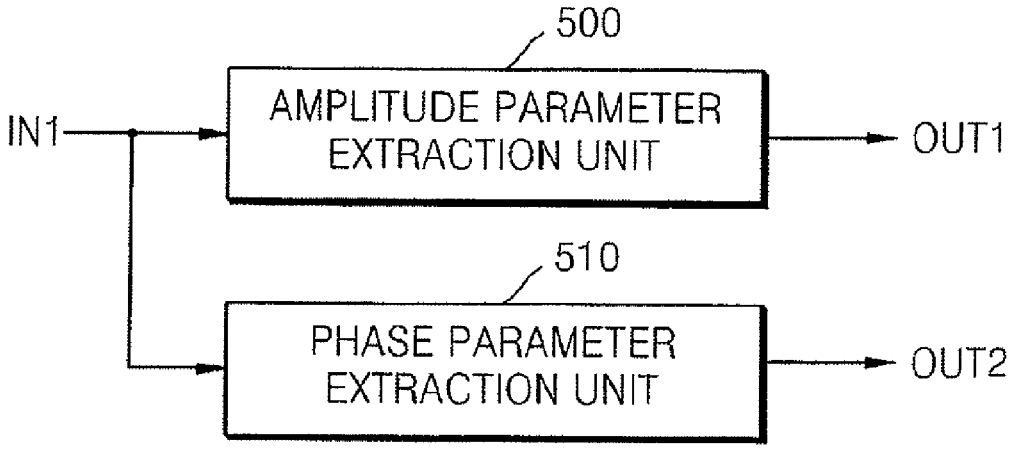
FIG. 5 is a block diagram of a parameter extraction unit included in an apparatus for encoding a stereo signal, according to an embodiment of the present invention.
Figure 6:
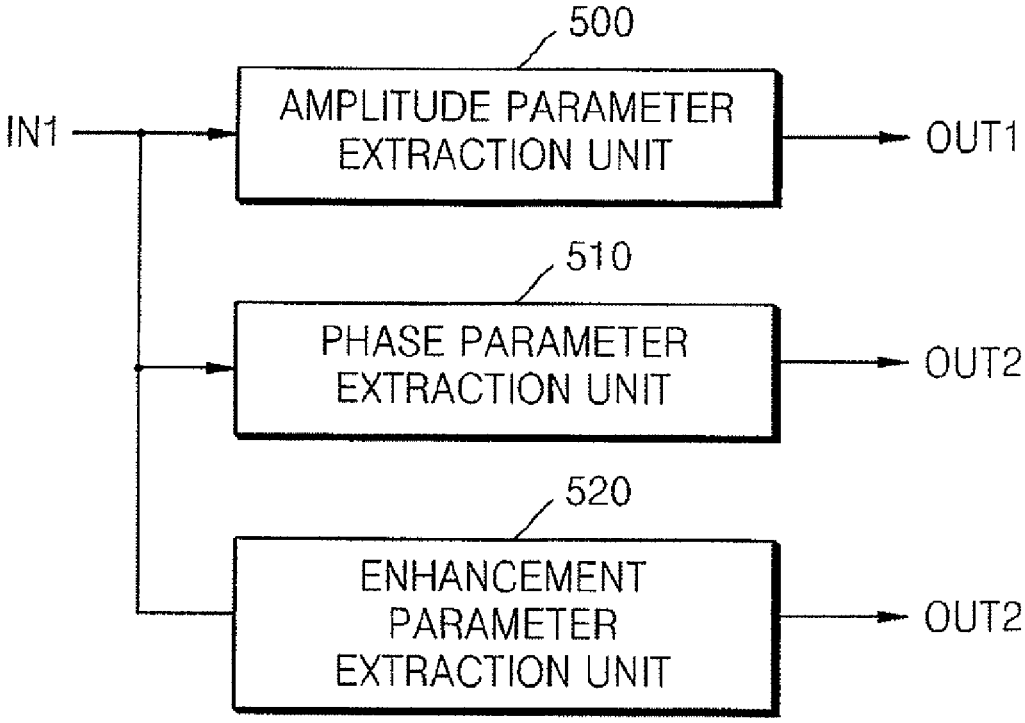
FIG. 6 is a block diagram of a parameter extraction unit included in an apparatus for encoding a stereo signal, according to another embodiment of the present invention.

FIGS. 5 and 6 are block diagrams illustrating in detail the parameter extraction unit 350 illustrated in FIG. 3, which is included in an apparatus for encoding a stereo signal according to embodiments of the present invention. As illustrated in FIG. 5, the parameter extraction unit 350 includes a size parameter extraction unit 500 and a phase parameter extraction unit 510. Alternatively, as illustrated in FIG. 6, the parameter extraction unit 350 may further include an enhancement parameter extraction unit 520.

The size parameter extraction unit 500 extracts and encodes a size parameter that represents the ratio of the amplitude of at least one of a left-channel signal and a right-channel signal to the amplitude of a mono signal.

The phase parameter extraction unit 510 extracts and encodes a phase parameter that represents the difference between the phases of at least one of the left-channel signal and the right-channel signal, and to the mono signal. Here, the phase parameter extraction unit 510 may extract the phase parameter that represents the difference between the phases of the left-channel signal and the mono signal, the difference between the phases of the right-channel signal and the mono signal, or the difference between the phases of each of the left-channel signal and the right-channel signal and the mono signal.

The enhancement parameter extraction unit 520 extracts and encodes an enhancement parameter that enhances and controls the phase indicated by the phase parameter, using a decorrelated signal that is a vertical vector component of the mono signal.

Figure 7:
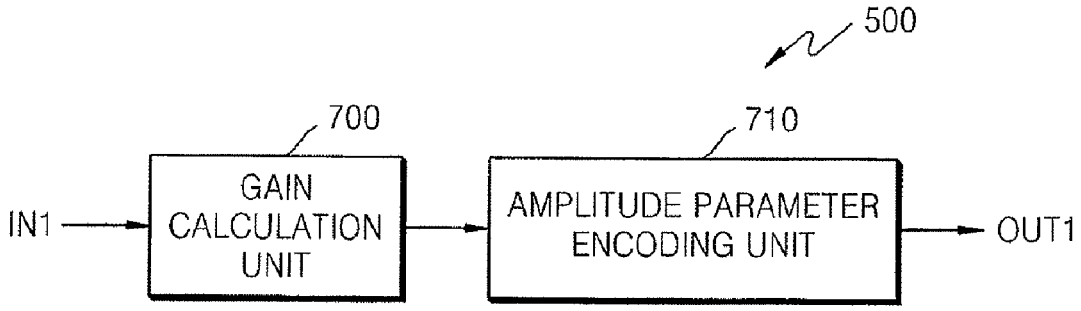
FIG. 7 is a block diagram of a size parameter extraction unit included in an apparatus for encoding a stereo signal, according to an embodiment of the present invention.

FIG. 7 is a block diagram block illustrating in detail the size parameter extraction unit 500 illustrated in FIG. 5 or 6, which is included in an apparatus for encoding a stereo signal according to an embodiment of the present invention. The size parameter extraction unit 500 includes a gain calculation unit 700 and a size parameter encoding unit 710.

The gain calculation unit 700 calculates a gain that minimizes the difference between the energy levels of an actual stereo signal and a stereo signal that is to be produced from a mono signal by applying the calculated gain in order to minimize an error between the amplitudes of the actual stereo signal and a stereo signal that is to be decoded by a decoding terminal, on an assumption that the amplitude of a left-channel signal has a predetermined relation to the amplitude of a right-channel signal.

The calculated gain is used to determine the amplitudes of the left-channel signal and the right-channel signal when the decoding terminal upmixes the mono signal to a stereo signal.

For example, if it is assumed that the predetermined relation between the amplitudes of the left-channel signal and the right-channel signal is that the amplitude of the mono signal is equal to the average of the amplitudes of the left-channel signal and the right-channel signal, the left-channel signal and the right-channel signal can be expressed as follows:

$$\tilde{a}_{n,k}^{L}=g_m a_{n,k}^{M}$$

$$\tilde{a}_{n,k}^{R}=(2-g_m)a_{n,k}^{M} \tag{11},$$

wherein $\tilde{a}_{n,k}^{L}$ denotes the amplitude of the left-channel signal when the gain calculated by the gain calculation unit 700 is applied, $\tilde{a}_{n,k}^{R}$ denotes the amplitude of the right-channel signal to which the gain is applied, $g_m$ denotes the gain used to calculate the amplitude of a signal, $a_{n,k}^{M}$ denotes the amplitude of the mono signal, n denotes a frame number, and k denotes a band number.

The difference between the energy levels of the actual stereo signal and the stereo signal obtained by applying the calculated gain can be calculated by the following Equation (12) into which Equation (11) has been substituted:

$$\begin{aligned} E_{n,k}^{LR} &= \sum_n (\tilde{a}_{n,k}^{L} - a_{n,k}^{L})^2 + \sum_n (\tilde{a}_{n,k}^{R} - a_{n,k}^{R})^2 \\ &= \sum_n (g_m a_{n,k}^{M} - a_{n,k}^{L})^2 + \sum_n ((2-g_m)a_{n,k}^{M} - a_{n,k}^{R})^2, \end{aligned} \tag{12}$$

wherein $E_{n,k}^{LR}$ denotes the difference between the energy levels of the actual stereo signal and the stereo signal to which the calculated gain is applied, $\tilde{a}_{n,k}^{L}$ denotes the amplitude of the left-channel signal to which the calculated gain is applied, $\tilde{a}_{n,k}^{R}$ denotes the amplitude of the right-channel signal to which the calculated gain is applied, $a_{n,k}^{L}$ denotes the amplitude of an actual left-channel signal, $a_{n,k}^{R}$ denotes the amplitude of an actual right-channel signal, $g_m$ denotes the gain used to calculate the amplitude of a signal, $a_{n,k}^{M}$ denotes the amplitude of the mono signal, n denotes a frame number, and k denotes a band number.

Equation (12) into which Equation (11) has been substituted can be expressed with respect to the gain $g_m$, as follows:

$$g_m = 1 + \frac{\sum_n \sum_k a_{n,k}^M a_{n,k}^L - \sum_n \sum_k a_{n,k}^M a_{n,k}^R}{2\sum_n \sum_k (a_{n,k}^M)^2}, \quad (13)$$

wherein $g_m$ denotes the gain used to calculate the amplitude of a signal, $a_{n,k}^L$ denotes the amplitude of the actual left-channel signal, $a_{n,k}^R$ denotes the amplitude of the actual right-channel signal, $a_{n,k}^M$ denotes the amplitude of the mono signal, n denotes a frame number, and k denotes a band number.

Thus, the gain calculation unit 700 can calculate the gain that minimizes the difference between the energy levels of the actual stereo signal and the stereo signal that is produced from the mono signal by applying the gain by substituting the actual left-channel signal amplitude $a_{n,k}^L$, the actual right-channel signal amplitude $a_{n,k}^R$, and the mono signal amplitude $a_{n,k}^M$ into Equation (13).

The size parameter encoding unit 710 encodes the gain.

Figure 8:
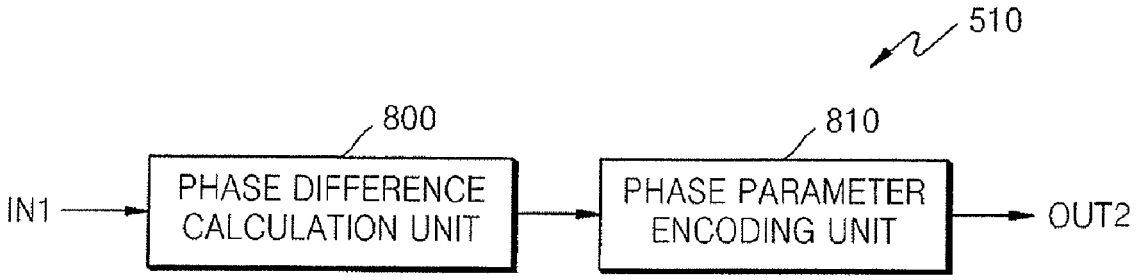
FIG. 8 is a block diagram of a phase parameter extraction unit included in an apparatus for encoding a stereo signal, according to an embodiment of the present invention.

FIG. 8 is a block diagram block illustrating in detail the phase parameter extraction unit 510 illustrated in FIG. 5 or 6, which is included in an apparatus for encoding a stereo signal according to an embodiment of the present invention. The phase parameter extraction unit 510 includes a phase difference calculation unit 800 and a phase parameter encoding unit 810.

The phase difference calculation unit 800 calculates a phase difference that minimizes the difference between the phases of an actual stereo signal and a stereo signal that is to be generated by applying a phase difference that is to be calculated by the phase difference calculation unit 800, in order to minimize an error between the phases of the actual stereo signal and a stereo signal that is to be decoded by a decoding terminal, on an assumption that the phase of a left-channel signal has a predetermined relation to the phase of a right-channel signal.

The difference between the energy levels of the actual stereo signal and the stereo signal that is to be generated can be calculated by:

$$E_{n,k}^{LR} = 2(a_{n,k}^R)^2[1-\cos(\phi_{n,k}^R - \phi_{n,k}^M + \psi_{n,k}^R)] + 2(a_{n,k}^L)^2[1-\cos(\phi_{n,k}^M - \phi_{n,k}^L + \psi_{n,k}^L)] \quad (14),$$

wherein $E_{n,k}^{LR}$ denotes the difference between the energy levels of the actual stereo signal and the stereo signal that is to be generated, $a_{n,k}^R$ denotes the amplitude of an actual right-channel signal, $a_{n,k}^L$ denotes the amplitude of an actual left-channel signal, $\phi_{n,k}^R$ denotes the phase of the actual right-channel signal, $\phi_{n,k}^M$ denotes the phase of a mono signal, $\phi_{n,k}^L$ denotes the phase of the actual left-channel signal, $\psi_{n,k}^R$ denotes the difference between the phases of the mono signal and the right-channel signal, $\psi_{n,k}^L$ denotes the difference between the phases of the mono signal and the left-channel signal, n denotes a frame number, and k denotes a band number.

If it is assumed that the difference between the phases of the left-channel signal and the mono signal is equal to that between the phases of the right-channel signal and the mono signal in Equation (14), that is, if it is assumed that $\psi_{n,k}^R$ and $\psi_{n,k}^L$ has the same value, e.g., $\psi_{n,k}$, Equation (14) can be expressed by:

$$tg(\psi_{n,k}) = \frac{\sum_n \sum_k (a_{n,k}^R)^2 \sin(\varphi_{n,k}^M - \varphi_{n,k}^R) + \sum_n \sum_k (a_{n,k}^L)^2 \sin(\varphi_{n,k}^L - \varphi_{n,k}^M)}{\sum_n \sum_k (a_{n,k}^R)^2 \cos(\varphi_{n,k}^M - \varphi_{n,k}^R) + \sum_n \sum_k (a_{n,k}^L)^2 \cos(\varphi_{n,k}^L - \varphi_{n,k}^M)}, \quad (15)$$

wherein $\psi_{n,k}$ denotes the difference between the phases of the mono signal and the stereo signal, $a_{n,k}^R$ denotes the amplitude of the actual right-channel signal, $a_{n,k}^L$ denotes the amplitude of the actual left-channel signal, $\phi_{n,k}^R$ denotes the phase of the actual right-channel signal, $\phi_{n,k}^M$ denotes the phase of the mono signal, $\phi_{n,k}^L$ denotes the phase of the actual left-channel signal, n denotes a frame number, and k denotes a band number.

Thus, the phase difference calculation unit 800 can calculate the phase difference that minimizes the difference between the energy levels of the actual stereo signal and the stereo signal that is to be generated, by substituting the actual left-channel signal amplitude $a_{n,k}^L$, the actual right-channel signal amplitude $a_{n,k}^R$, the actual left-channel signal phase flak $\phi_{n,k}^L$, actual right-channel signal phase $\phi_{n,k}^R$, and the mono signal phase $\phi_{n,k}^M$ into Equation (15).

The phase parameter encoding unit 810 encodes the phase difference calculated by the phase difference calculation unit 800.

Figure 9:
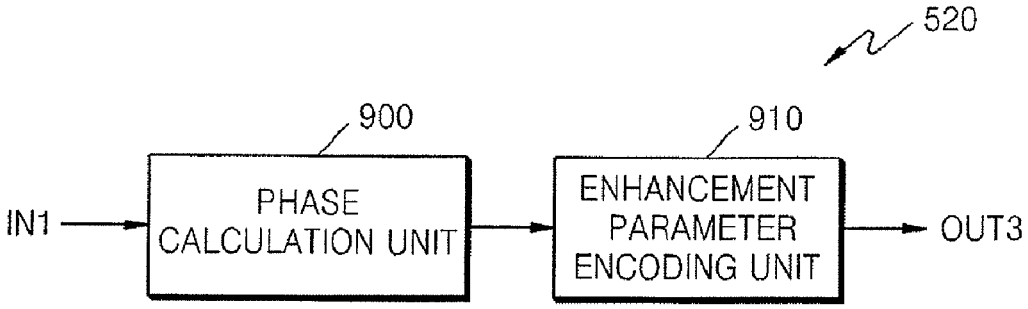
FIG. 9 is a block diagram of an enhancement parameter extraction unit included in an apparatus for encoding a stereo signal, according to an embodiment of the present invention.

FIG. 9 is a block diagram block illustrating in detail the enhancement parameter extraction unit 520 illustrated in FIG. 6, which is included in an apparatus for encoding a stereo signal according to an embodiment of the present invention. The enhancement parameter extraction unit 520 includes a phase calculation unit 900 and an enhancement parameter encoding unit 910.

The phase calculation unit 900 calculates a second phase for enhancing and controlling a first phase indicated by a phase parameter encoded by the parameter extraction unit 510, using a decorrelated signal that is a vertical vector component of a mono signal.

For example, the phase calculation unit 900 calculates the second phase for enhancing and controlling the first phase, using the following:

$$tg(\alpha_k) = \min\left[1, \sqrt{\frac{2\left(\sum_{n=b_k}^{b_{k+1}-1} (a_{n,k}^L)^2(1-\cos(\varphi_{n,k}^L - \varphi_{n,k}^M - \psi_{n,k})) + \sum_{n=b_k}^{b_{k+1}-1} (a_{n,k}^R)^2(1-\cos(\varphi_{n,k}^R - \varphi_{n,k}^M + \psi_{n,k}))\right)}{\sum_{n=b_k}^{b_{k+1}-1} (a_{n,k}^L)^2 + \sum_{n=b_k}^{b_{k+1}-1} (a_{n,k}^R)^2}}\right], \quad (16)$$

wherein $a_{n,k}^L$ denotes the amplitude of an actual left-channel signal, $\phi_{n,k}^L$ denotes the phase of the actual left-channel signal, $\phi_{n,k}^M$ denotes the phase of the mono signal, $\psi_{n,k}$ denotes the difference between the phases of the mono signal and the stereo signal, $a_{n,k}^R$ denotes the amplitude of an actual right-channel signal, $\phi_{n,k}^R$ denotes the phase of the actual right-channel signal, $b_k$ denotes a band border value, n denotes a frame number, and k denotes a band number.

Thus, the phase calculation unit 900 can calculate the second phase by using the actual left-channel signal amplitude $a_{n,k}^{L}$, the actual left-channel signal phase $\phi_{n,k}^{L}$, the mono signal phase $\phi_{n,k}^{M}$, the difference $\psi_{n,k}$ between the phases of the mono signal and the stereo signal, the actual right-channel signal amplitude $a_{n,k}^{R}$, and the actual right-channel signal phase $\phi_{n,k}^{R}$.

Figure 10:
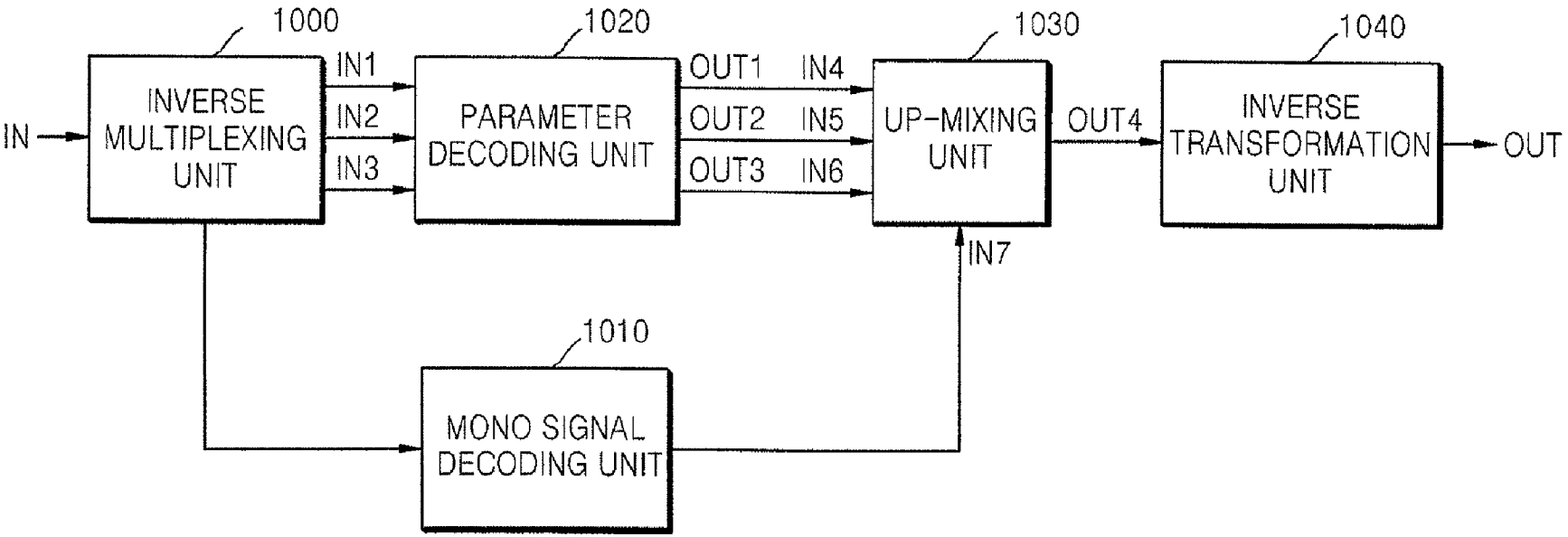
FIG. 10 is a block diagram of an apparatus for decoding a stereo signal, according to an embodiment of the present invention.

FIG. 10 is a block diagram of an apparatus for decoding a stereo signal, according to an embodiment of the present invention. The decoding apparatus includes an inverse multiplexing unit 1000, a mono signal decoding unit 1010, a parameter decoding unit 1020, an up-mixing unit 1030, and an inverse transformation unit 1040.

The inverse multiplexing unit 1000 receives a bitstream from an encoding terminal (not shown) via an input terminal IN, and inversely multiplexes the bitstream. The bitstream contains parameters necessary to upmix a mono signal generated by an encoding apparatus (not shown), and the mono signal encoded by the encoding apparatus.

The mono signal decoding unit 1010 decodes the encoded mono signal inversely multiplexed by the inverse multiplexing unit 1000.

The parameter decoding unit 1020 decodes the parameters inversely multiplexed by the inverse multiplexing unit 1000. The decoded parameters include a size parameter that represents the ratio of the amplitude of at least one of a left-channel signal and a right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter by using a decorrelated signal that is a vertical vector component of the mono signal. The parameters may be produced for each frame and in band units.

The up-mixing unit 1030 upmixes the decoded mono signal to a stereo signal by using the decoded parameters, such as the size parameter, the phase parameter, and the enhancement parameter. When the up-mixing unit 1030 upmixes the mono signal to a stereo signal containing a left-channel signal and a right-channel signal, the amplitudes of the left-channel signal and the right-channel signal are determined using the mono signal according to the size parameter, the phases of the left-channel signal and the right-channel signal are determined using the mono signal according to the phase parameter, and the determined phases of the left-channel signal and the right-channel signal are enhanced and controlled using a decorrelated signal according to the enhancement parameter.

The inverse transformation unit 1040 inversely transforms the domain of the stereo signal that was upmixed by the up-mixing unit 1030 in the reverse manner of that transformed by the transformation unit 100 illustrated in FIG. 1 performs transformation, by using the synthesis filterbank, and then outputs the result of inverse transformation via an output terminal OUT. For example, the inverse transformation unit 1040 performs inverse transformation such that the mono signal expressed in the time domain as spectra for each of the sub bands at predetermined frequency units is expressed only in the time domain.

Figure 11:
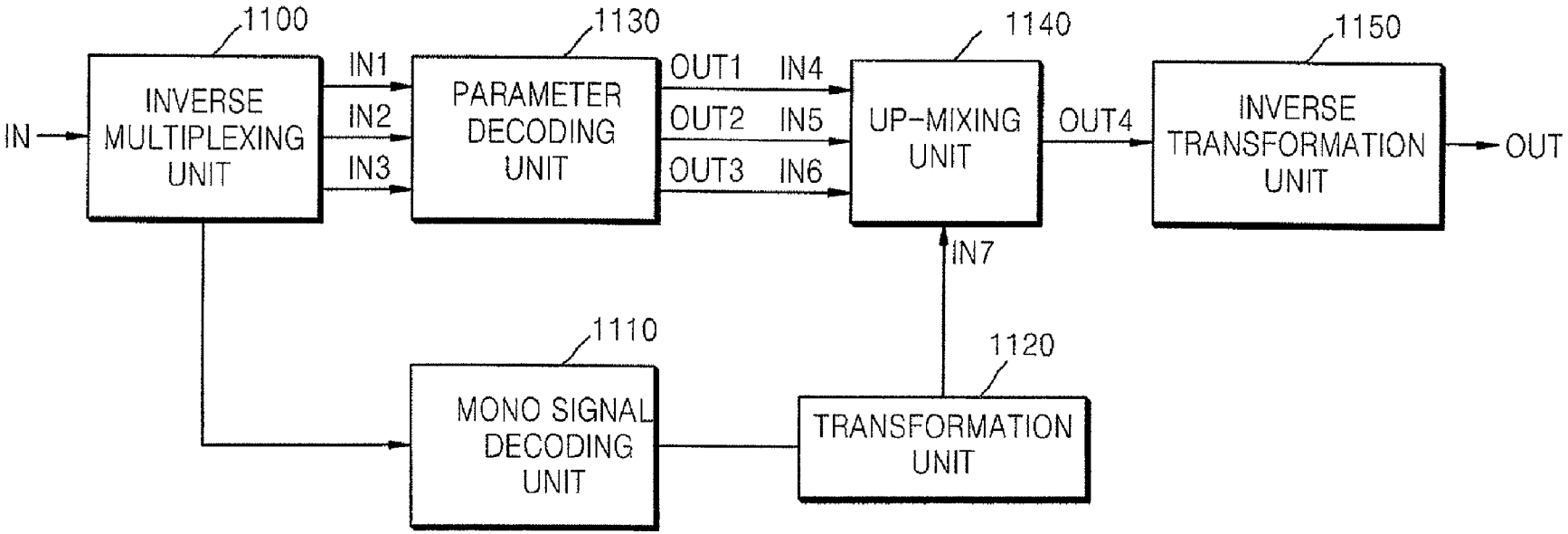
FIG. 11 is a block diagram of an apparatus for decoding a stereo signal, according to another embodiment of the present invention.

FIG. 11 is a block diagram of an apparatus for decoding a stereo signal, according to another embodiment of the present invention. The decoding apparatus includes an inverse multiplexing unit 1100, a mono signal decoding unit 1110, a transformation unit 1120, a parameter decoding unit 1130, an up-mixing unit 1140, and an inverse transformation unit 1150.

The inverse multiplexing unit 1100 receives a bitstream from an encoding terminal (not shown) via an input terminal IN, and inversely multiplexes the bitstream. The bitstream contains parameters necessary to upmix a mono signal generated by an encoding apparatus (not shown), and the mono signal encoded by the encoding apparatus.

The mono signal decoding unit 1110 decodes the encoded mono signal demultiplexed from the inverse multiplexing unit 1100.

The transformation unit 1120 transforms the decoded mono signal into a predetermined domain by using an analysis filterbank. The predetermined domain may have a complex-number format in which both the amplitude and phase of each signal can be expressed. For example, the predetermined domain allows each signal to be expressed as spectra in the time domain for each of the sub bands at predetermined frequency units.

The parameter decoding unit 1130 decodes the parameters multiplexed by the inverse multiplexing unit 1100. The parameters include a size parameter that represents the ratio of the amplitude of at least one of a left-channel signal and a right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter by using a decorrelated signal that is a vertical vector component of the mono signal. The parameters may be produced for each frame and in band units.

The up-mixing unit 1140 upmixes the decoded mono signal to a stereo signal by using the decoded parameters, such as the size parameter, the phase parameter, and the enhancement parameter. When the up-mixing unit 1130 upmixes the mono signal to a stereo signal containing a left-channel signal and a right-channel signal, the amplitudes of the left-channel signal and the right-channel signal are determined using the mono signal according to the size parameter, the phases of the left-channel signal and the right-channel signal are determined using the mono signal according to the phase parameter, and the determined phases of the left-channel signal and the right-channel signal are enhanced and controlled using a decorrelated signal according to the enhancement parameter.

The inverse transformation unit 1150 inversely transforms the domain of the stereo signal that was upmixed by the up-mixing unit 1140 in the reverse manner of that performed by transformation unit 1120, using the synthesis filterbank, and then outputs the result of inverse transformation via an output terminal OUT. For example, the inverse transformation unit 1150 performs inverse transformation such that the mono signal expressed in the time domain as spectra for each of the sub bands at predetermined frequency units is expressed as a time series only in the time domain.

Figure 12:
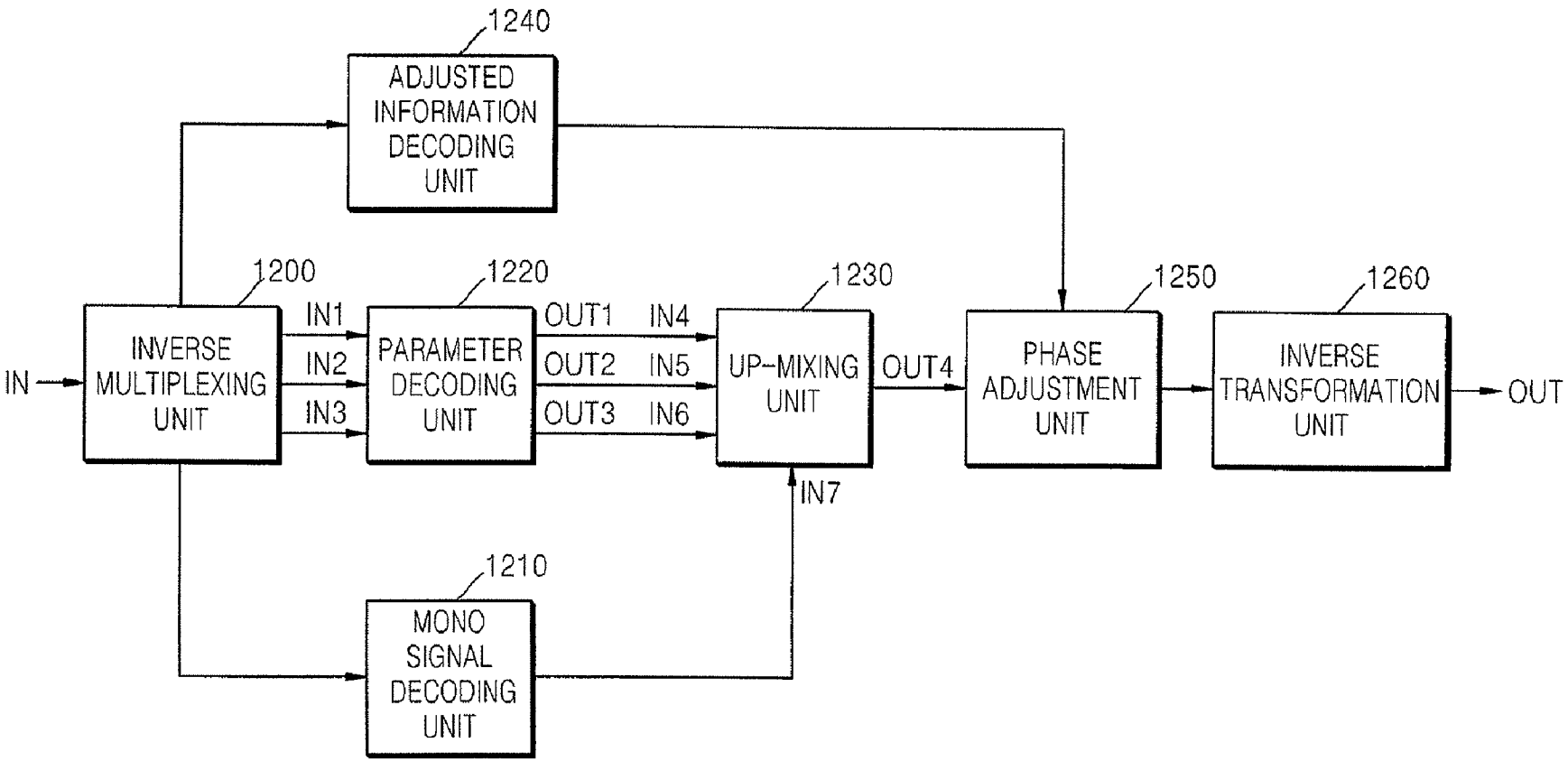
FIG. 12 is a block diagram of an apparatus for decoding a stereo signal, according to another embodiment of the present invention.

FIG. 12 is a block diagram of an apparatus for decoding a stereo signal, according to another embodiment of the present invention. The decoding apparatus includes an inverse multiplexing unit 1200, a mono signal decoding unit 1210, a parameter decoding unit 1220, an up-mixing unit 1230, an adjusted information decoding unit 1240, a phase adjustment unit 1250, and an inverse transformation unit 1260.

The inverse multiplexing unit 1200 receives a bitstream from an encoding terminal (not shown) via an input terminal IN, and inversely multiplexes the bitstream. The bitstream contains parameters necessary to upmix a mono signal generated by an encoding apparatus (not shown), and the mono signal encoded by the encoding apparatus. If the encoding apparatus has adjusted the phase of the stereo signal due to the difference between the phases of a left-channel signal and a right-channel signal-contained in the stereo signal fell within a predetermined range, the bitstream further contains information regarding the phase of the stereo signal, which is adjusted by the encoding apparatus.

The mono signal decoding unit 1210 decodes the inversely multiplexed mono signal.

The parameter decoding unit 1220 decodes the parameters that were inversely multiplexed by the inverse multiplexing unit 1200. The parameters include a size parameter that represents the ratio of the amplitude of at least one of the left-channel signal and the right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter by using a decorrelated signal that is a vertical vector component of the mono signal. The parameters may be produced for each frame and in band units.

The up-mixing unit 1230 upmixes the decoded mono signal to a stereo signal by using the decoded parameters, such as the size parameter, the phase parameter, and the enhancement parameter. When the up-mixing unit 1230 upmixes the mono signal to a stereo signal containing the left-channel signal and the right-channel signal, the amplitude of the left-channel signal and the right-channel signal are determined using the mono signal according to the size parameter, the phases of the left-channel signal and the right-channel signal are determined using the mono signal according to the phase parameter, and the determined phases of the left-channel signal and the right-channel signal are enhanced and controlled using a decorrelated signal according to the enhancement parameter.

If the encoding apparatus adjusted the phases of the left-channel signal and the right-channel signal because the difference between the phases of the left-channel signal and the right-channel signal fell within the predetermined range, that is, if the inversely multiplexed bitstream contains the information regarding the adjusted phases, the adjusted information decoding unit 1240 decodes the information regarding the adjusted phases. For example, if the encoding apparatus adjusts the phase of the left-channel signal by an angle of $\theta°$ and the phase of the right-channel signal by an angle of $-\theta°$, the information regarding the adjusted phases indicates the angle of $\theta°$.

If the inversely multiplexed bitstream contains the information regarding the adjusted phases, the phase adjustment unit 1250 respectively adjusts the phases of the left-channel signal and the right-channel signal that are upmixed to the stereo signal, by the adjusted phases. However, if the inversely multiplexed bitstream does not contain the information regarding the adjusted phases, the phase adjustment unit 1250 does not adjust the phases of the left-channel signal and the right-channel signal that are upmixed to the stereo signal.

If the inversely multiplexed bitstream contains the information regarding the adjusted phases, the inverse transformation unit 1260 inversely transforms the domain of the stereo signal adjusted by the phase adjustment unit 1250 in the reverse manner that the transformation unit 300 illustrated in FIG. 3 performs transformation, using the synthesis filterbank, and then outputs the result of transformation via an output terminal OUT. For example, the inverse transformation unit 1260 inversely transforms the mono signal, which is expressed in the time domain as spectra for each of the sub bands in predetermined frequency units, only as a time domain.

However, if the inversely multiplexed bitstream does not contain the information regarding the adjusted phases, the inverse transformation unit 1260 inversely transforms the stereo signal upmixed by the up-mixing unit 1230.

Figure 13:
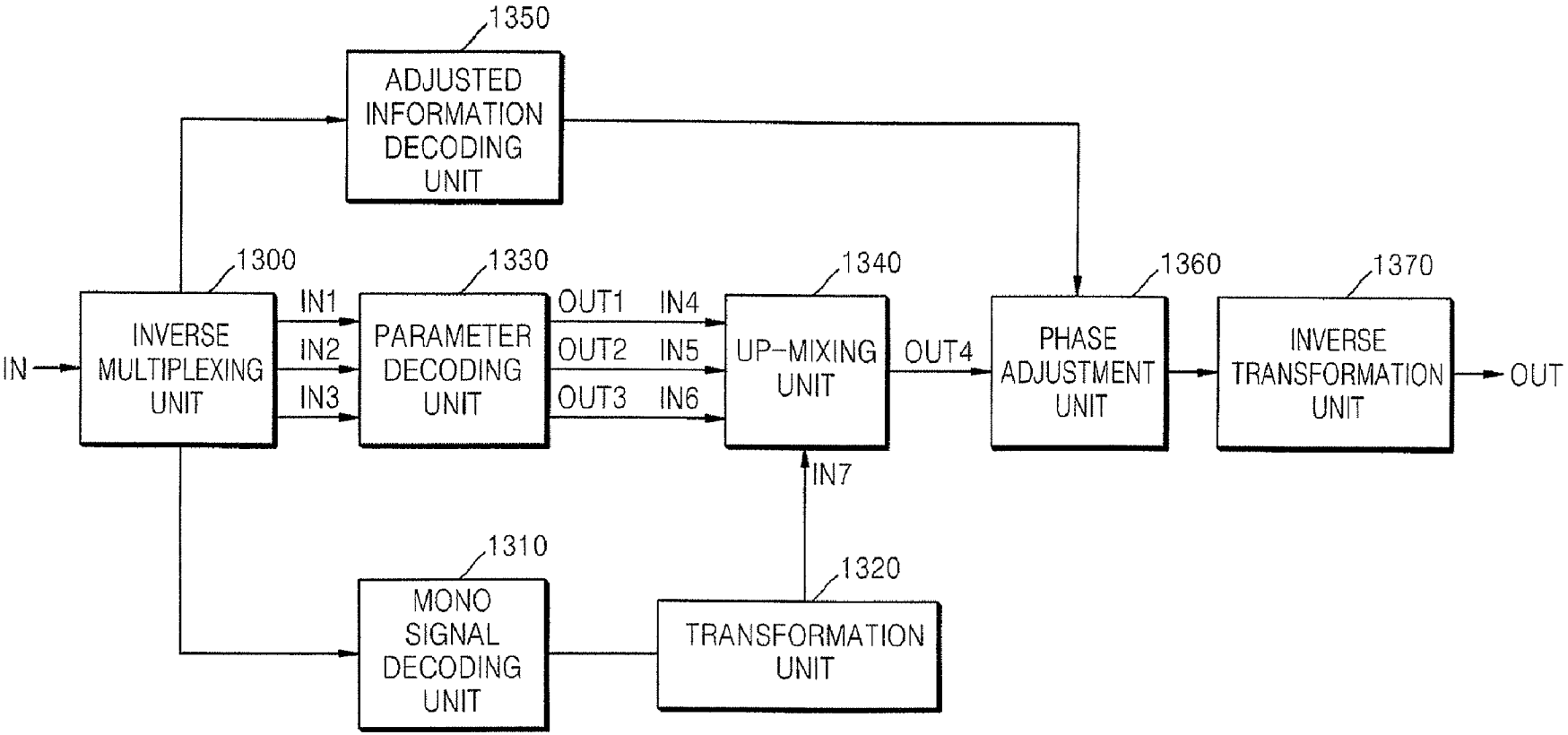
FIG. 13 is a block diagram of an apparatus for decoding a stereo signal, according to another embodiment of the present invention.

FIG. 13 is a block diagram of an apparatus for decoding a stereo signal, according to another embodiment of the present invention. The decoding apparatus includes an inverse multiplexing unit 1300, a mono signal decoding unit 1310, a transformation unit 1320, a parameter decoding unit 1330, an up-mixing unit 1340, an adjusted information decoding unit 1350, a phase adjustment unit 1360, and an inverse transformation unit 1370.

The inverse multiplexing unit 1300 receives a bitstream from an encoding terminal (not shown) via an input terminal IN, and inversely multiplexes the bitstream. The bitstream contains parameters necessary to upmix a mono signal generated by an encoding apparatus (not shown), and the mono signal encoded by the encoding apparatus. If the encoding apparatus has adjusted the phase of the stereo signal due to the difference between the phases of a left-channel signal and a right-channel signal contained in the stereo signal falling within a predetermined range, the bitstream further contains information regarding the phase of the stereo signal, which is adjusted by the encoding apparatus.

The mono signal decoding unit 1320 decodes the inversely multiplexed mono signal.

The transformation unit 1320 transforms the mono signal, which was decoded by mono signal decoding unit 1320, into a predetermined domain by using the analysis filterbank. The predetermined domain may have a complex-number format in which both the amplitude and phase of each signal can be expressed. For example, the predetermined domain allows each signal to be expressed in the time domain as spectra for each of the sub bands at predetermined frequency units.

The parameter decoding unit 1330 decodes the parameters that were inversely multiplexed by the inverse multiplexing unit 1300. The parameters include a size parameter that represents the ratio of the amplitude of at least one of the left-channel signal and the right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter by using a decorrelated signal that is a vertical vector component of the mono signal. The parameters may be produced for each frame and in band units.

The up-mixing unit 1340 upmixes the transformed mono signal to a stereo signal by using the decoded parameters, such as the size parameter, the phase parameter, and the enhancement parameter. When the up-mixing unit 1340 upmixes the mono signal to a stereo signal containing the left-channel signal and the right-channel signal, the amplitude of the left-channel signal and the right-channel signal are determined using the mono signal according to the amplitude parameter, the phases of the left-channel signal and the right-channel signal are determined using the mono signal according to the phase parameter, and the determined phases of the left-channel signal and the right-channel signal are enhanced and controlled using a decorrelated signal according to the enhancement parameter.

If the encoding apparatus adjusted the phases of the left-channel signal and the right-channel signal because the difference between the phases of the left-channel signal and the right-channel signal fell within the predetermined range, that is, if the inversely multiplexed bitstream contains the information regarding the adjusted phases, the adjusted information decoding unit 1350 decodes the information regarding the adjusted phases. For example, if the encoding apparatus adjusts the phase of the left-channel signal by an angle of θ° and the phase of the right-channel signal by an angle of −θ°, the information regarding the adjusted phases indicates the angle of θ°.

If the inversely multiplexed bitstream contains the information regarding the adjusted phases, the phase adjustment unit 1360 respectively adjusts the phases of the left-channel signal and the right-channel signal that are upmixed to the stereo signal, by the adjusted phases. However, if the inversely multiplexed bitstream does not contain the information regarding the adjusted phases, the phase adjustment unit 1360 does not adjust the phases of the left-channel signal and the right-channel signal that are upmixed to the stereo signal.

If the inversely multiplexed bitstream contains the information regarding the adjusted phases, the inverse transformation unit 1370 inversely transforms the domain of the stereo signal adjusted by the phase adjustment unit 1360 in the reverse manner of that performed by the transformation unit 1320, using the synthesis filterbank and then outputs the result of transformation via an output terminal OUT. For example, the inverse transformation unit 1370 inversely transforms the mono signal, which is expressed in the time domain as spectra for each of the sub bands at predetermined frequency units, as a time series only in the time domain.

However, if the inversely multiplexed bitstream does not contain the information regarding the adjusted phases, the inverse transformation unit 1370 inversely transform the stereo signal upmixed by the up-mixing unit 1340.

Figure 14:
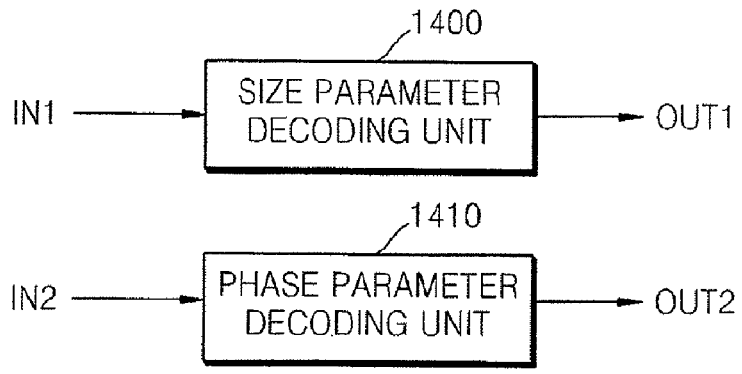
FIG. 14 is a block diagram of parameter decoding units included in an apparatus for decoding a stereo signal, according to an embodiment of the present invention.
Figure 15:
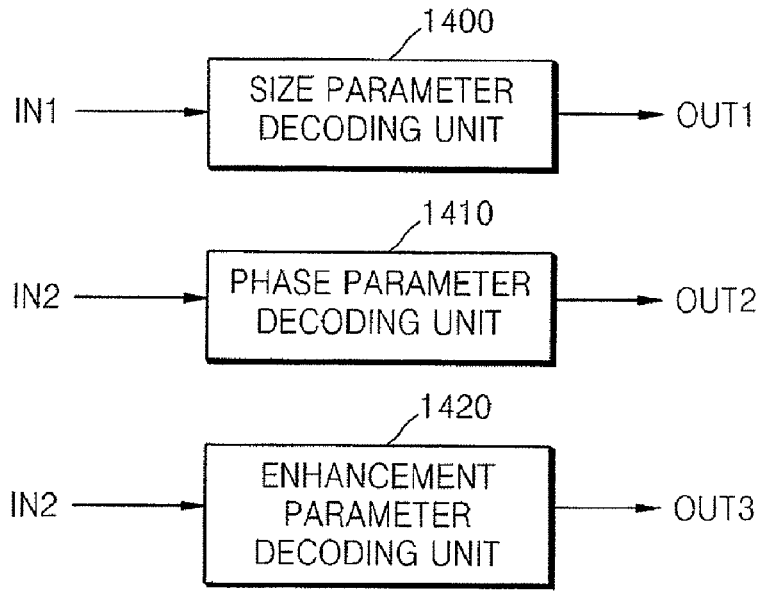
FIG. 15 is a block diagram of parameter decoding units included in an apparatus for decoding a stereo signal, according to another embodiment of the present invention.

FIGS. 14 and 15 are block diagrams illustrating in detail the parameter decoding unit 1020, 1130, 1220 or 1330 that is included in an apparatus for encoding a stereo signal, according to embodiments of the present invention. The parameter decoding unit 1020, 1130, 1220 or 1330 includes a size parameter decoding unit 1400 and a phase parameter decoding unit 1410 as illustrated in FIG. 14 but may further include an enhancement parameter decoding unit 1430 as illustrated in FIG. 15.

The size parameter decoding unit 1400 decodes a size parameter that represents the ratio of the amplitude of at least one of a left-channel signal and a right-channel signal to the amplitude of a mono signal.

The phase parameter decoding unit 1410 decodes a phase parameter that represents the difference between the phases of at least one of the left-channel signal and the right-channel signal, and the mono signal.

The enhancement parameter extraction unit 1420 decodes an enhancement parameter for enhancing and controlling the phase indicated by the phase parameter, using a decorrelated signal that is a vertical vector component of the mono signal.

Figure 16:
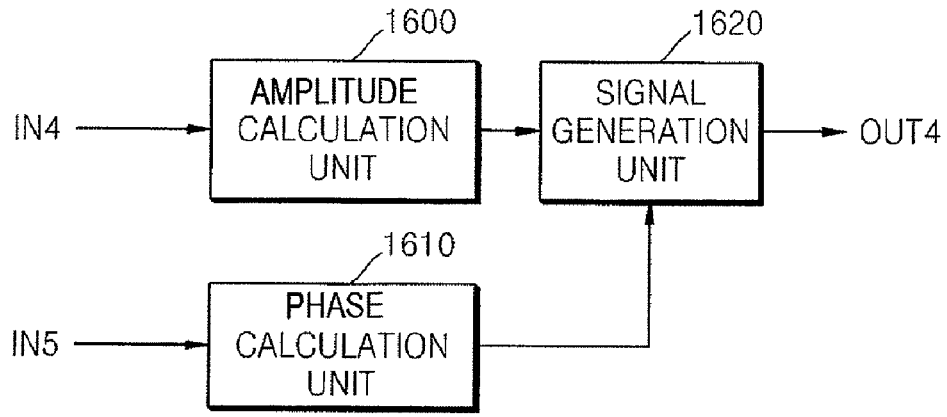
FIG. 16 is a block diagram illustrating in detail an upmixing unit included in an apparatus for encoding a stereo signal, according to an embodiment of the present invention.

FIG. 16 is a block diagram illustrating in detail the up-mixing unit 1030,1140,1230 or 1340 that is included in an apparatus for decoding a stereo signal, according to an embodiment of the present invention. The up-mixing unit 1030, 1140, 1230 or 1340 includes a amplitude calculation unit 1600, a phase calculation unit 1610, and a signal generation unit 1620.

The amplitude calculation unit 1600 calculates the amplitudes of a left-channel signal and a right-channel signal based on a mono signal, using the size parameter decoded by the size parameter decoding unit 1400 illustrated in FIG. 14 or 15. Here, the size parameter is a gain calculated by an encoding apparatus (not shown) so that the difference between the energy levels of an actual stereo signal and a stereo signal that is to be decoded by a decoding terminal (not shown) can be minimized in order, which minimizes an error between the amplitudes of the actual stereo signal and the stereo signal.

If it is assumed that the relation between the left-channel signal and the right-channel signal is set so that the amplitude of the mono signal can be equal to the average of the amplitudes of the left-channel signal and the right-channel signal, the amplitude calculation unit 1600 can calculate the amplitudes of the left-channel signal and the right-channel signal by using the following:

$$\tilde{a}_{n,k}^{L}=g_m a_{n,k}^{M}$$

$$\tilde{a}_{n,k}^{R}=(2-g_m)a_{n,k}^{M} \quad (17),$$

wherein $\tilde{a}_{n,k}^{L}$ and $\tilde{a}_{n,k}^{R}$ respectively denote the amplitudes of the left-channel signal and the right-channel signal calculated by the amplitude calculation unit 1600, $g_m$ denotes the gain, $a_{n,k}^{M}$ denotes the amplitude of the mono signal, n denotes a frame number, and k denotes a band number.

The phase calculation unit 1610 calculates the phases of the left-channel signal and the right-channel signal, based on the phase of the mono signal by using the phase parameter decoded by the phase parameter decoding unit 1410 illustrated in FIG. 14 or 15. Here, the phase parameter is a phase difference $\psi_{n,k}$ calculated so that the difference between the energy levels of the actual stereo signal and the stereo signal to which the calculated phase difference is to be applied can be minimized in order to minimize an error between the phases of the actual stereo signal and the stereo signal that is to be decoded.

If the phase parameter is the phase difference $\psi_{n,k}$ on an assumption that both the encoding apparatus and the decoding apparatus have predetermined that the difference between the phases of the left-channel signal and the mono signal is equal to the difference between the phases of the right-channel signal and the mono signal, the phase calculation unit 1610 can calculate the phase of the left-channel signal by adding $\psi_{n,k}$ to the phase of the mono signal and the phase of the right-channel signal by subtracting $\psi_{n,k}$ from the phase of the mono signal.

The signal generation unit 1620 generates the stereo signal by generating the left-channel signal and the right-channel signal, based on the amplitudes of the left-channel signal and the right-channel signal, which are calculated by the amplitude calculation unit 1600, and the phases of the left-channel signal and the right-channel signal, which are calculated by the phase calculation unit 1610.

Figure 18:
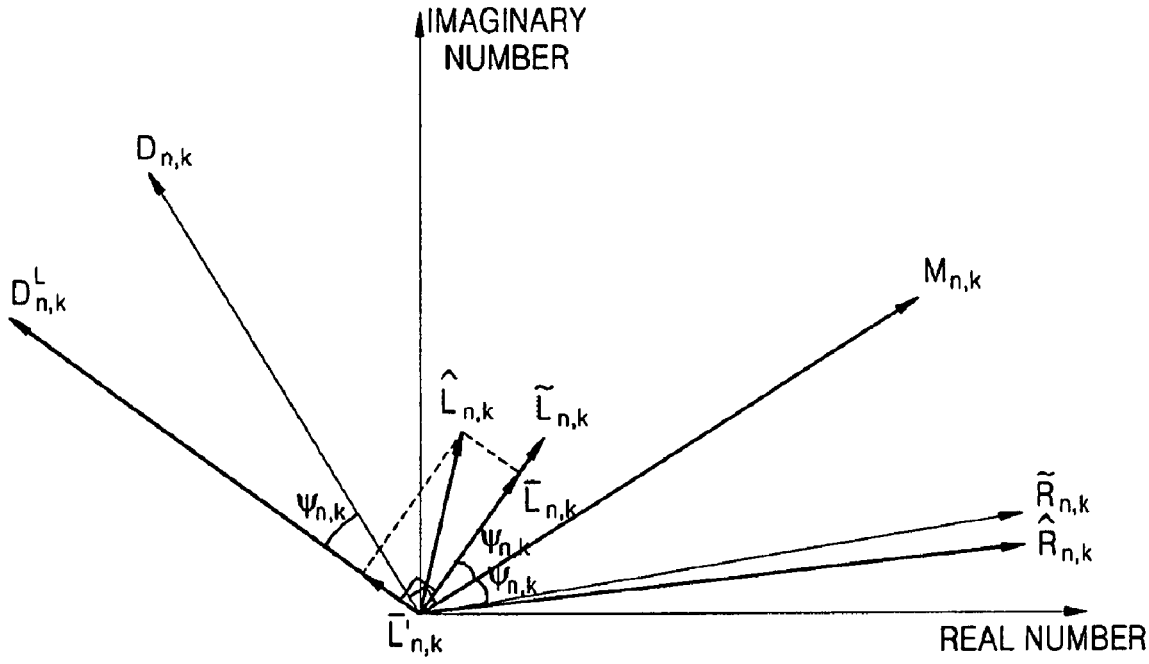
FIG. 18 is a graph illustrating a method of generating a left-channel signal and a right-channel signal from a mono signal by using a method and apparatus for decoding a stereo signal mono signal, according to an embodiment of the present invention.

For example, referring to FIG. 18, a left-channel signal $\tilde{L}_{n,k}$ and a right-channel signal $\tilde{R}_{n,k}$ are produced by determining the amplitudes of them by applying the gain $g_m$, based on a mono signal $M_{n,k}$, and then respectively determining the phases of the left-channel signal $\tilde{L}_{n,k}$ and the right-channel signal $\tilde{R}_{n,k}$ by applying the phase difference θ, that is, by respectively rotating the mono signal $M_{n,k}$ by an angle of θ° and an angle of −θ°.

Figure 17:
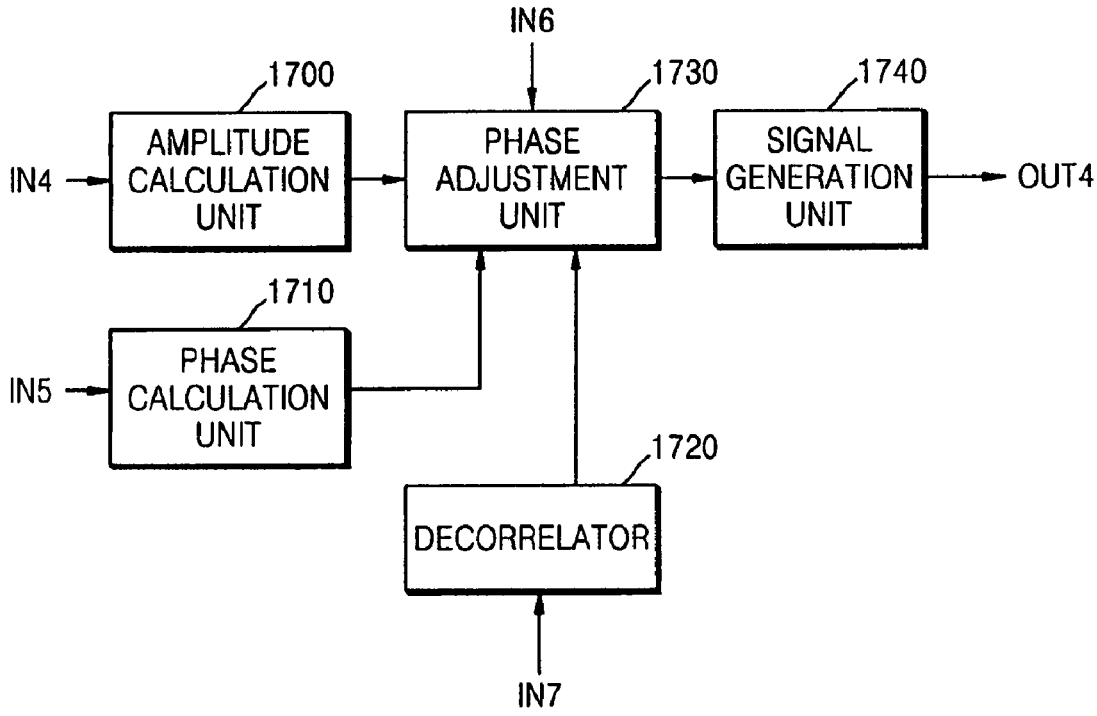
FIG. 17 is a block diagram illustrating in detail an upmixing unit included in an apparatus for encoding a stereo signal, according to another embodiment of the present invention.

FIG. 17 a block diagram illustrating in detail the up-mixing unit 1030, 1140, 1230 or 1340 that is included in an apparatus for encoding a stereo signal, according to another embodiment of the present invention. The up-mixing unit 1030, 1140, 1230 or 1340 includes a amplitude calculation unit 1700, a phase calculation unit 1710, a decorrelator 1720, a phase adjustment unit 1730, and a signal generation unit 1740.

The amplitude calculation unit 1700 calculates the amplitudes of a left-channel signal and a right-channel signal based on a mono signal, using the size parameter decoded by the size parameter decoding unit 1400 illustrated in FIG. 14 or 15. Here, the size parameter is a gain calculated by an encoding apparatus (not shown) so that the difference between the energy levels of an actual stereo signal and a stereo signal that is to be decoded by a decoding terminal (not shown) can be minimized in order to minimize an error between the amplitudes of the actual stereo signal and the stereo signal.

If it is assumed that the relation between the left-channel signal and the right-channel signal is set so that the amplitude of the mono signal can be equal to the average of the amplitudes of the left-channel signal and the right-channel signal, the amplitude calculation unit 1700 can calculate the amplitudes of the left-channel signal and the right-channel signal by using the following:

$$\tilde{a}_{n,k}^{L}=g_m a_{n,k}^{M}$$

$$\tilde{a}_{n,k}^{R}=(2-g_m)a_{n,k}^{M} \quad (18),$$

wherein $\tilde{a}_{n,k}^{L}$ and $\tilde{a}_{n,k}^{R}$ respectively denote the amplitudes of the left-channel signal and the right-channel signal that are calculated by the amplitude calculation unit 1700, $g_m$ denotes the gain, $a_{n,k}^{M}$ denotes the amplitude of the mono signal, n denotes a frame number, and k denotes a band number.

The phase calculation unit 1710 calculates the phases of the left-channel signal and the right-channel signal, based on the phase of the mono signal by using the phase parameter decoded by the phase parameter decoding unit 1410 illustrated in FIG. 14 or 15. Here, the phase parameter is a phase difference $\psi_{n,k}$ calculated so that the difference between the energy levels of the actual stereo signal and the stereo signal that is to be decoded can be minimized in order to minimize an error between the phases of the actual stereo signal and the stereo signal that is to be decoded.

If the phase parameter is a phase difference $\psi_{n,k}$ on an assumption that both the encoding apparatus and the decoding apparatus have predetermined that the difference between the phases of the left-channel signal and the mono signal is equal to the difference between the phases of the right-channel signal and the mono signal, the phase calculation unit 1710 can calculate the phase of the left-channel signal by adding $\psi_{n,k}$ to the phase of the mono signal and the phase of the right-channel signal by subtracting $\psi_{n,k}$ from the phase of the mono signal.

The decorrelator 1720 produces a decorrelated signal that is a vertical vector component of the mono signal.

The phase adjustment unit 1730 adjusts the left-channel signal and the right-channel signal by enhancing the phases of the left-channel signal and the right-channel signal calculated by the phase calculation unit 1710 based on the decorrelated signal and the mono signal, using the enhancement parameter decoded by the enhancement parameter decoding unit 1420 illustrated in FIG. 15. If it is assumed that the enhancement parameter is $\alpha_m$ calculated by the encoding apparatus, it is possible to adjust the left-channel signal by using Equation (19) and the right-channel signal by using Equation (20), as follows:

$$\begin{aligned}\hat{L}_{n,k} &= \tilde{L}_{n,k}\cos(\alpha_m) + g_m e^{j\psi_{n,k}} D_{n,k}\sin(\alpha_m) \\ &= g_m M_{n,k} e^{j\psi_{n,k}}\cos(\alpha_m) + g_m e^{j\psi_{n,k}} D_{n,k}\sin(\alpha_m),\end{aligned} \quad (19)$$

wherein $\hat{L}_{n,k}$ denotes the left-channel signal adjusted by the phase adjustment unit 1730, $\tilde{L}_{n,k}$ denotes the left-channel signal obtained by applying the amplitude and phase of the left-channel signal that are respectively calculated by the amplitude calculation unit 1700 and the phase calculation unit 1710, $g_m$ denotes the gain, $\psi_{n,k}$ denotes the phase difference indicated by the phase parameter, $D_{n,k}$ denotes the amplitude of the decorrelated signal, $\alpha_m$ denotes the phase indicated by the enhancement parameter, and $M_{n,k}$ denotes the amplitude of the mono signal.

$$\begin{aligned}\hat{R}_{n,k} &= \tilde{R}_{n,k}\cos(\alpha_m) - (2-g_m)e^{-j\psi_{n,k}} D_{n,k}\sin(\alpha_m) \\ &= (2-g_m)M_{n,k} e^{-j\psi_{n,k}}\cos(\alpha_m) - (2-g_m)e^{-j\psi_{n,k}} D_{n,k}\sin(\alpha_m),\end{aligned} \quad (20)$$

wherein $\hat{R}_{n,k}$ denotes the right-channel signal adjusted by the phase adjustment unit 1730, $\tilde{R}_{n,k}$ denotes a right-channel signal obtained by applying the amplitude and phase of the right-channel signal that are respectively calculated by the amplitude calculation unit 1700 and the phase calculation unit 1710, $g_m$ denotes the gain, $\psi_{n,k}$ denotes a phase difference indicated by phase parameter, $D_{n,k}$ denotes the amplitude of the decorrelated signal, $\alpha_m$ denotes the phase indicated by the enhancement parameter, and $M_{n,k}$ denotes the amplitude of the mono signal.

The signal generation unit 1740 generates the stereo signal by generating the left-channel signal and the right-channel signal, based on the amplitude of the left-channel signal and the right-channel signal, which are calculated by the amplitude calculation unit 1700, the phases of the left-channel signal and the right-channel signal, which are calculated by the phase calculation unit 1710, and the phases of the left-channel signal and the right-channel signal adjusted by the phase adjustment unit 1730.

For example, referring to FIG. 18, a first left-channel signal $\tilde{L}_{n,k}$ and a first right-channel signal $\tilde{R}_{n,k}$ are produced by determining their amplitudes by the gain $g_m$ based on a mono signal $M_{n,k}$, and respectively determining their phases of the first left-channel signal $\tilde{L}_{n,k}$ and the first right-channel signal $\tilde{R}_{n,k}$ by rotating the mono signal $M_{n,k}$ by an angle of θ° and an angle of −θ° by applying the phase difference θ.

Next, a second left-channel signal $\bar{L}_{n,k}$ is produced by adjusting the amplitude of the first left-channel signal $\tilde{L}_{n,k}$ to $|\tilde{L}_{n,k}|\cos(\alpha_m)$, a second decorrelated signal $D_{n,k}^{L}$ is produced by rotating the first decorrelated signal $D_{n,k}$ by the phase difference $\psi_{n,k}$, a third left-channel signal $\bar{L}_{n,k}'$ is produced by adjusting the amplitude of the second left-channel signal $\bar{L}_{n,k}$ to $|\tilde{L}_{n,k}|\sin(\alpha_m)(=M_n g_m \sin(\alpha_m)=g_m|M_n|\sin(\alpha_m)=g_m|D_n|\sin(\alpha_m))$, and then, a fourth left-channel signal $\hat{L}_{n,k}$ is produced by vector addition of the second left-channel signal $\bar{L}_{n,k}$ and the third left-channel signal $\bar{L}_{n,k}'$. A fourth right-channel signal $\hat{R}_{n,k}$ is produced in the same way that the left-channel signal $\hat{L}_{n,k}$ is produced.

Figure 19:
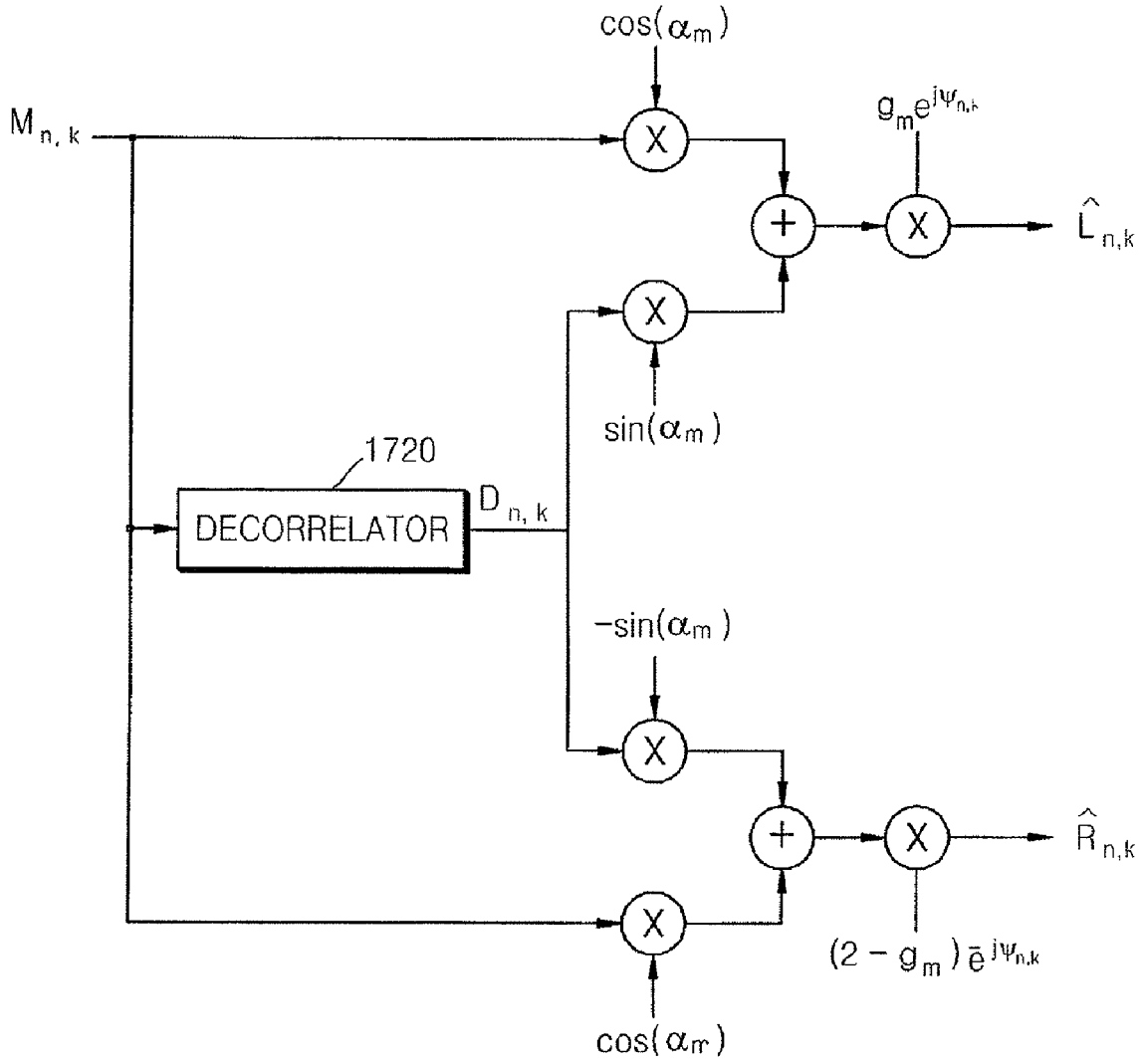
FIG. 19 is a conceptual diagram illustrating a method of generating a left-channel signal and a right-channel signal from a mono signal by using a method and apparatus for decoding a stereo signal mono signal, according to an embodiment of the present invention.

As illustrated in FIG. 19, the up-mixing unit 1030, 1140, 1230 or 1340 can receive the mono signal $M_{n,k}$, produce the decorrelated signal $D_{n,k}$ by the decorrelator 1720, and then, produce the left-channel signal $\hat{L}_{n,k}$ and the right-channel signal $\hat{R}_{n,k}$ based on the mono signal $M_{n,k}$ and the decorrelated signal $D_{n,k}$ by using the gain $g_m$ determined from the size parameter, the phase difference $\psi_{n,k}$ determined from the phase parameter, and the phase $\alpha_m$ determined from the enhancement parameter.

The method, illustrated in FIG. 19, of generating a left-channel signal and a right-channel signal can be simply expressed by:

$$\begin{bmatrix} \hat{L}_{n,k} \\ \hat{R}_{n,k} \end{bmatrix} = \begin{bmatrix} e^{j\psi_{n,k}} & 0 \\ 0 & e^{-j\psi_{n,k}} \end{bmatrix} \begin{bmatrix} g_m & 0 \\ 0 & (2-g_m) \end{bmatrix} \begin{bmatrix} \cos(\alpha_m) & \sin(\alpha_m) \\ \cos(\alpha_m) & -\sin(a_m) \end{bmatrix} \begin{bmatrix} M_{n,k} \\ D_{n,k} \end{bmatrix} = \begin{bmatrix} g_m e^{j\psi_{n,k}} \cos(\alpha_m) & g_m e^{j\psi_{n,k}} \sin(\alpha_m) \\ (2-g_m)e^{-j\psi_{n,k}} \cos(\alpha_m) & -(2-g_m)e^{-j\psi_{n,k}} \sin(\alpha_m) \end{bmatrix} \begin{bmatrix} M_{n,k} \\ D_{n,k} \end{bmatrix}, \quad (21)$$

wherein $\hat{L}_{n,k}$ denotes the finally generated left-channel signal, $\hat{R}_{n,k}$ denotes the finally generated right-channel signal, $\psi_{n,k}$ denotes the phase difference represented by the phase parameter, $g_m$ denotes the gain, $\alpha_m$ denotes the phase represented by the enhancement parameter, $M_{n,k}$ denotes the mono signal, and $D_{n,k}$ denotes the decorrelated signal.

According to Equation (21), first, rotation transformation is performed on the mono signal $M_{n,k}$ and the decorrelated signal $D_{n,k}$, size transformation is performed, and then, phase adjustment is performed, but the present invention is not limited thereto.

Figure 20:
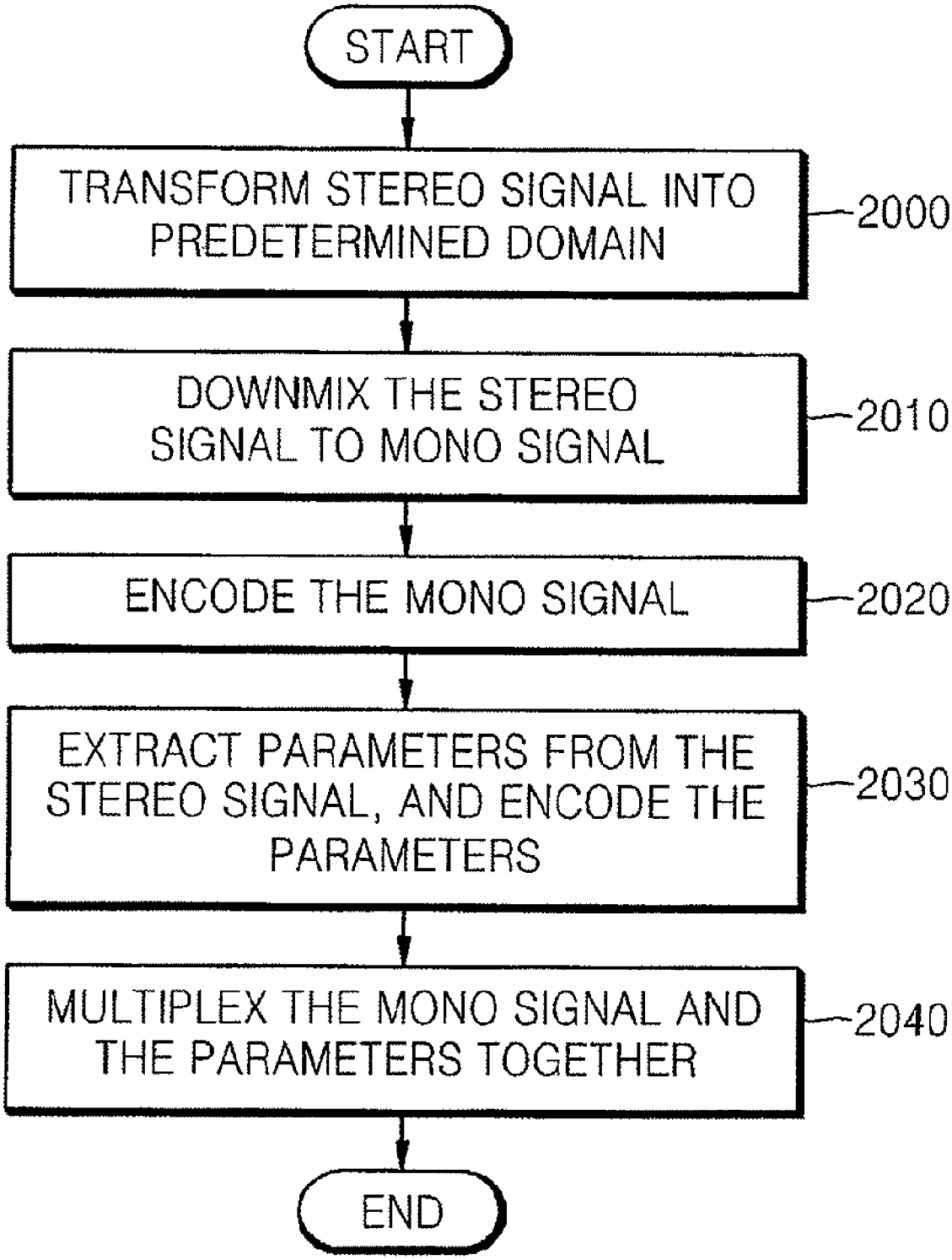
FIG. 20 is a flowchart illustrating a method of encoding a stereo signal, according to an embodiment of the present invention.

FIG. 20 is a flowchart illustrating a method of encoding a stereo signal, according to an embodiment of the present invention.

First, a received stereo signal is transformed into a predetermined domain by using an analysis filterbank (operation 2000). Here, the predetermined domain may have a complex-number format in which both the amplitude and phase of each signal can be expressed. For example, the predetermined domain allows each signal to be expressed in the time domain as spectra for each of the sub bands at predetermined frequency units.

Next, the stereo signal that is transformed into the predetermined domain is downmixed to a mono signal (operation 2010).

The amplitude of the downmixed mono signal may be equal to the average of the amplitudes of a left-channel signal and a right-channel signal, and the mono signal may be generated on a half sum vector of the left-channel signal and the right-channel signal.

Next, the downmixed mono signal is encoded (operation 2020).

Next, parameters necessary to upmix the mono signal to the stereo signal by a decoding process are extracted from the stereo signal, and the extracted parameters are encoded (operation 2030). The extracted parameters are information for producing the left-channel signal and the right-channel signal, based on the mono signal.

The parameters include a size parameter that represents the ratio of the amplitude of at least one of a left-channel signal and a right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter by using a decorrelated signal that is a vertical vector component of the mono signal.

The parameters, which are extracted in operation 2030, may be produced for each frame, in band units.

Thereafter, the parameters encoded in operation 2030 and the mono signal encoded in operation 2020 are multiplexed together, thereby obtaining a bitstream (operation 2040).

Figure 21:
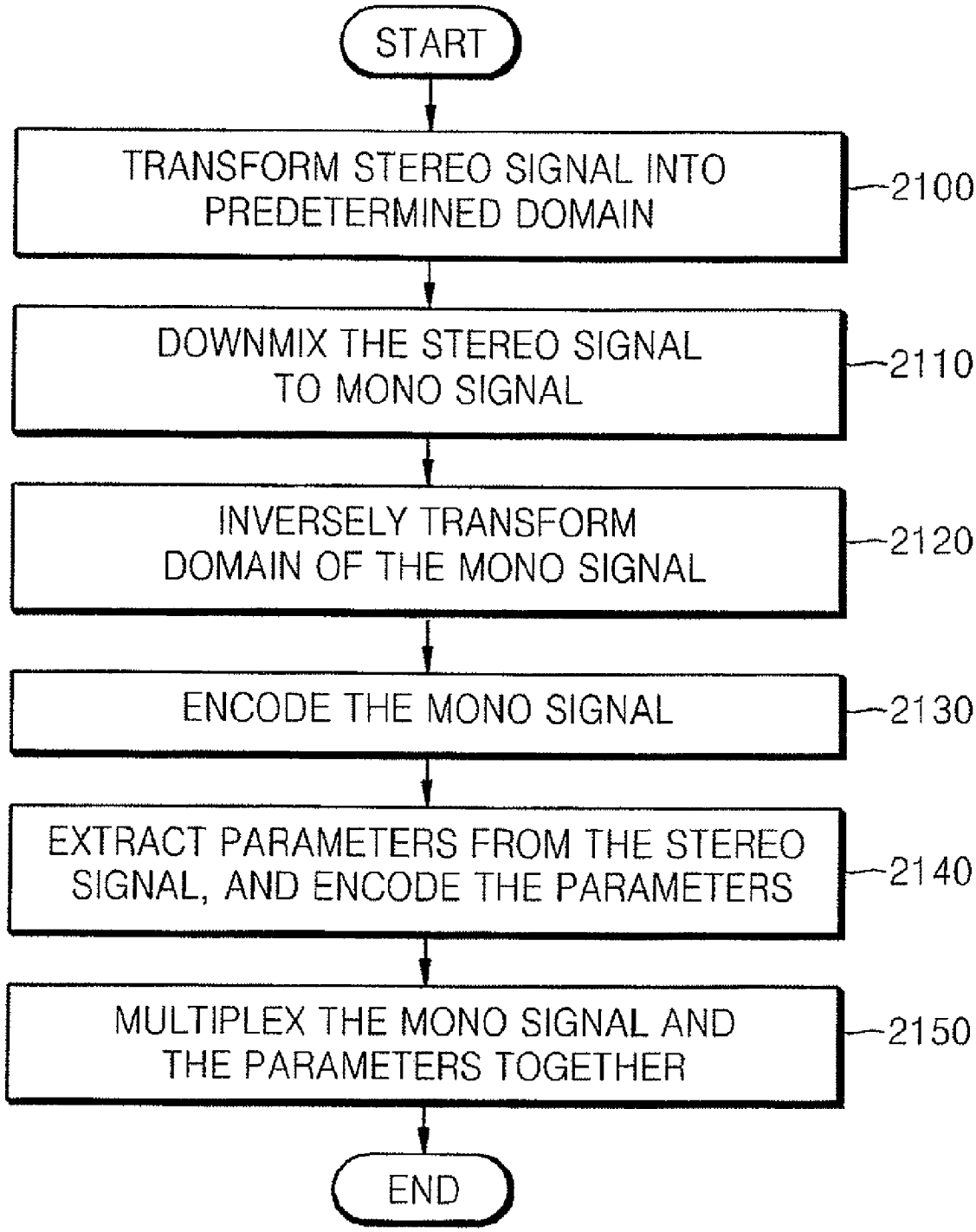
FIG. 21 is a flowchart illustrating a method of encoding a stereo signal, according to another embodiment of the present invention.

FIG. 21 is a flowchart illustrating a method of encoding a stereo signal, according to another embodiment of the present invention.

First, a received stereo signal is transformed into a predetermined domain by using an analysis filterbank (operation 2100). Here, the predetermined domain may have a complex-number format in which both the amplitude and phase of each signal can be expressed. For example, the predetermined domain allows each signal to be expressed in the time domain as spectra for each of the sub bands at predetermined frequency units. For example, the transformation may be achieved by using a Quadrature Mirror Filterbank (QMF) and/or Lapped Orthogonal Transform (LOT).

Next, the stereo signal that is transformed into the predetermined domain is downmixed to a mono signal operation (operation 2110).

The amplitude of the downmixed mono signal may be equal to the average of the amplitudes of a left-channel signal and a right-channel signal, and the mono signal may be generated on a half sum vector of the left-channel signal and the right-channel signal.

Next, an inverse operation of the transformation performed in operation 2100 is performed on the domain of the downmixed mono signal, that is, the domain is inversely transformed using the synthesis filterbank (operation 2120). For example, in operation 2120, inverse transformation is performed so that the mono signal, which is expressed in the time domain for each of the sub bands at predetermined frequency units, can be expressed as a time series only in the time domain.

Next, the inversely transformed mono signal is encoded (operation 2130).

Next, parameters necessary to upmix the mono signal to the stereo signal by a decoding process are extracted from the stereo signal, and the extracted parameters are encoded (operation 2140). The extracted parameters are information for producing the left-channel signal and the right-channel signal, based on the mono signal.

The parameters include a size parameter that represents the ratio of the amplitude of at least one of a left-channel signal and a right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter by using a decorrelated signal that is a vertical vector component of the mono signal.

The parameters, which are extracted in operation 2140, may be produced for each frame, in band units.

Thereafter, the parameters encoded in operation 2130 and the mono signal encoded in operation 2130 are multiplexed together, thereby obtaining a bitstream (operation 2150).

Figure 22:
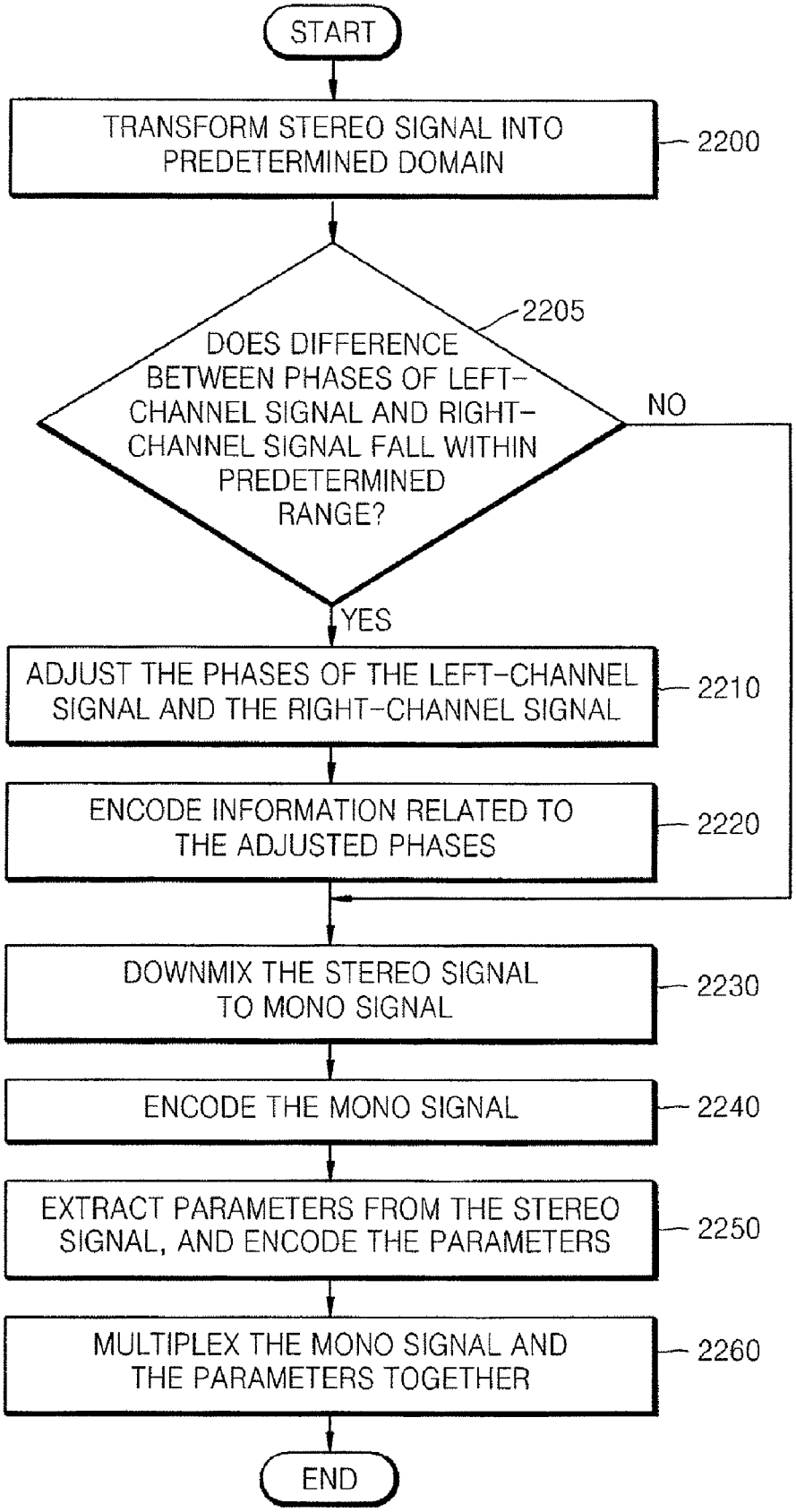
FIG. 22 is a flowchart illustrating a method of encoding a stereo signal, according to another embodiment of the present invention.

FIG. 22 is a flowchart illustrating a method of encoding a stereo signal, according to another embodiment of the present invention.

First, a received stereo signal is transformed into a predetermined domain by using an analysis filterbank (operation 2000). Here, the predetermined domain may have a complex-number format in which both the amplitude and phase of each signal can be expressed. For example, the predetermined domain allows each signal to be expressed in the time domain as spectra for each of the sub bands at predetermined frequency units.

Next, it is determined whether the difference between the phases of a left-channel signal and a right-channel signal contained in the stereo signal, which is transformed into the predetermined domain, falls within a predetermined range (operation 2205). This is because the nearer the difference between the phases of the left-channel signal and the right-channel signal approximates 180 degrees, the nearer the sum of the vectors of the left-channel signal and the right-channel signal approximates zero. The predetermined range may be determined based on 180 degrees.

In an embodiment of the present invention, operation 2205 is performed as follows. First, $S_{n,k}$ is calculated by:

$$S_{n,k} = \frac{L_{n,k} + R_{n,k}}{2}, \tag{22}$$

wherein $L_{n,k}$ denotes the left-channel signal, $R_{n,k}$ denotes the right-channel signal, n denotes a frame number, and k denotes a band number.

Next, $G_{n,k}$ is calculated by substituting $S_{n,k}$ into the following:

$$G_{n,k} = \frac{2|S_{n,k}|}{|L_{n,k}| + |R_{n,k}|}, \tag{23}$$

In operation 2205, it is determined whether to adjust the phases of the left-channel signal and the right-channel signal, depending on whether $G_{n,k}$ is less than $10^{-3}$ that is a predetermined threshold.

If $G_{n,k}$ is less than $10^{-3}$, the phases of the left-channel signal and the right-channel signal are determined to be adjusted. If $G_{n,k}$ is equal to or greater than $10^{-3}$, the phases of the left-channel signal and the right-channel signal are determined not to be adjusted.

If it is determined in operation 2205 that the difference between the phases of the left-channel signal and the right-channel signal falls within the predetermined range, the phases of the left-channel signal and the right-channel signal are adjusted by a predetermined phase (operation 2210).

In operation 2210, the phases of the left-channel signal and the right-channel signal are adjusted by the same phase. If the phase of the left-channel signal is adjusted by an angle of θ°, the phase of the right-channel signal is adjusted by an angle of −θ°.

Returning to operation 2205, phase adjustment is performed by transforming $S_{n,k}$ as follows:

$$S_{n,k} = \frac{L_{n,k}e^{j\theta} + R_{n,k}e^{-j\theta}}{2}, \tag{24}$$

wherein $L_{n,k}$ denotes the left-channel signal, $R_{n,k}$ denotes the right-channel signal, θ denotes a predetermined value, e.g., π/100, n denotes a frame number, and k denotes a band number.

Next, information regarding the phases adjusted in operation 2210 is encoded (operation 2220). For example, if the phases of the left-channel signal and the right-channel signal are respectively adjusted by the angle of θ° and the angle of −θ° in operation 2210, information regarding the angle of θ° is encoded.

Next, the stereo signal whose phase is adjusted in operation 2210 or the stereo signal transformed into the predetermined domain in operation 2200 is downmixed to the mono signal (operation 2230).

Returning to operation 2205, the final $S_{n,k}$ is calculated by:

$$S_{n,k} = S_{n,k}\min\left\{2, \sqrt{\frac{|L_{n,k}|^2 + |R_{n,k}|^2}{2|S_{n,k}|^2}}\right\}, \tag{25}$$

wherein $S_{n,k}$ of the right-hand side of Equation (25) denotes a phasor calculated by Equation (3), $L_{n,k}$ denotes the left-channel signal, $R_{n,k}$ denotes the right-channel signal, n denotes a frame number, and k denotes a band number.

In operation 2230, the mono signal is produced a mono signal by using $S_{n,k}$ calculated by Equation (25), as follows:

$$M_{n,k} = S_{n,k}\sqrt{\frac{\sum_{k=1}^{N}|L_{n,k}|^2 + |R_{n,k}|^2}{4\sum_{k=1}^{N}|S_{n,k}|^2}}, \tag{26}$$

wherein $M_{n,k}$ denotes the mono signal, $S_{n,k}$ denotes the phasor calculated by Equation (25), $L_{n,k}$ denotes the left-channel signal, $R_{n,k}$ denotes the right-channel signal, n denotes a frame number, and k denotes a band number.

The amplitude of the downmixed mono signal may be equal to the average of the amplitudes of a left-channel signal and a right-channel signal, and the mono signal may be generated on a half sum vector of the left-channel signal and the right-channel signal.

Next, the downmixed mono signal is encoded (operation 2240).

Next, parameters necessary to upmix the mono signal to the stereo signal by a decoding process are extracted from the stereo signal, and the extracted parameters are encoded (operation 2250). The extracted parameters are information for producing the left-channel signal and the right-channel signal, based on the mono signal.

The parameters include a size parameter that represents the ratio of the amplitude of at least one of a left-channel signal and a right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter by using a decorrelated signal that is a vertical vector component of the mono signal.

The parameters, which are extracted in operation 2250, may be produced for each frame, in band units.

Thereafter, the parameters encoded in operation 2250 and the mono signal encoded in operation 2240 are multiplexed together, thereby obtaining a bitstream (operation 2260). Also, in operation 2260, if the phase of the stereo signal is adjusted in operation 2210, the information regarding the adjusted phases, which is encoded in operation 2220, is multiplexed together with the parameters and the mono signal.

Figure 23:
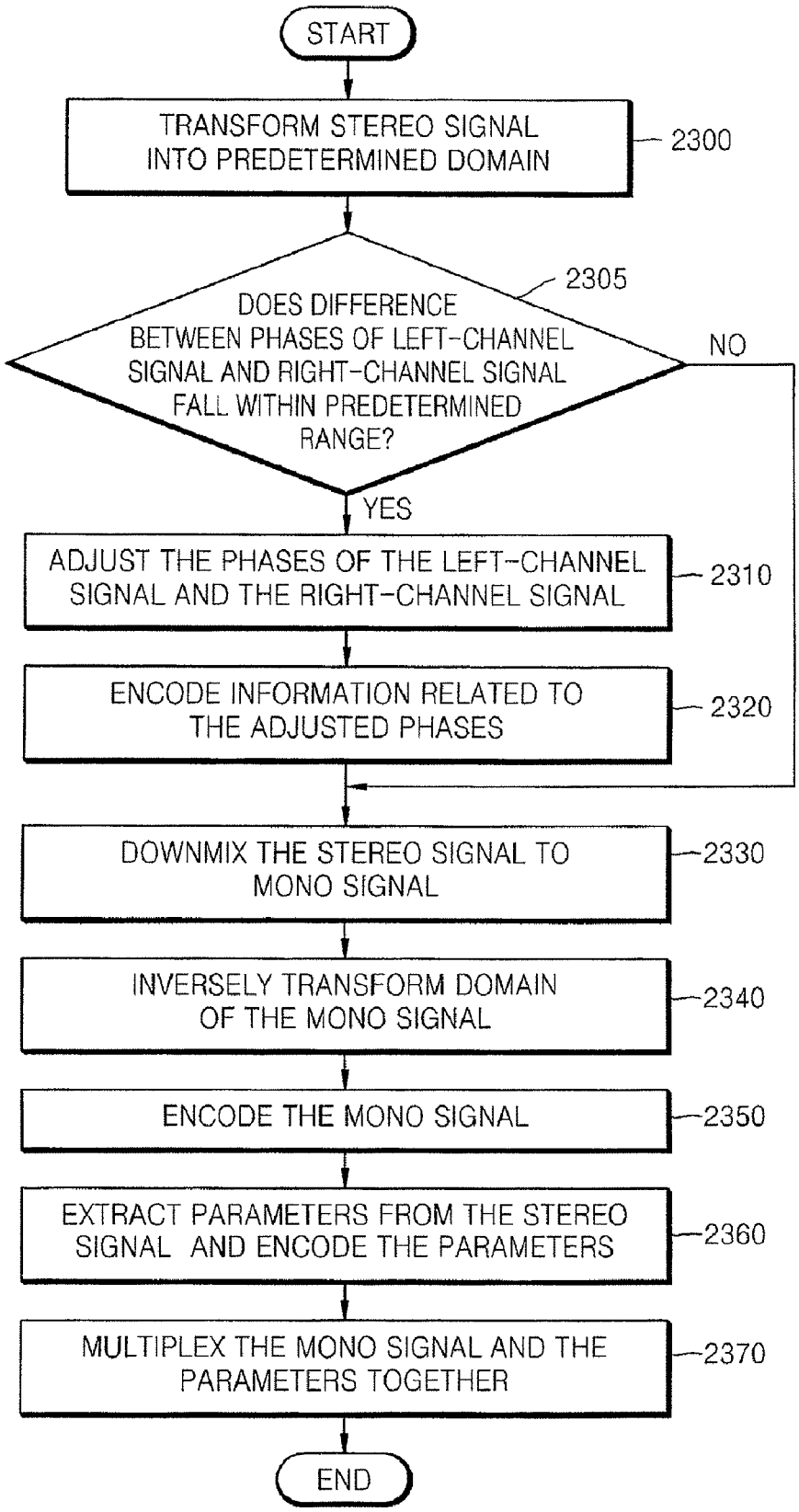
FIG. 23 is a flowchart illustrating a method of encoding a stereo signal, according to another embodiment of the present invention.

FIG. 23 is a flowchart illustrating a method of encoding a stereo signal, according to another embodiment of the present invention.

First, a received stereo signal is transformed into a predetermined domain by using an analysis filterbank (operation 2300). Here, the predetermined domain may have a complex-number format in which both the amplitude and phase of each signal can be expressed. For example, the predetermined domain allows each signal to be expressed in the time domain as spectra for each of the sub bands at predetermined frequency units.

Next, it is determined whether the difference between the phase of a left-channel signal and a right-channel signal contained in the stereo signal, which is transformed into the predetermined domain, falls within a predetermined range (operation 2305). This is because the nearer the difference between the phases of the left-channel signal and the right-channel signal approximates 180 degrees, the nearer the sum of the vectors of the left-channel signal and the right-channel signal approximates zero. The predetermined range may be determined based on 180 degrees.

In an embodiment of the present invention, operation 2305 is performed as follows. First, $S_{n,k}$ is calculated by:

$$S_{n,k} = \frac{L_{n,k} + R_{n,k}}{2}, \tag{27}$$

wherein $L_{n,k}$ denotes the left-channel signal, $R_{n,k}$ denotes the right-channel signal, n denotes a frame number, and k denotes a band number.

Next, $G_{n,k}$ is calculated by substituting $S_{n,k}$ into the following:

$$G_{n,k} = \frac{2|S_{n,k}|}{|L_{n,k}| + |R_{n,k}|} \tag{28}$$

In operation 2305, it is determined whether to adjust the phases of the left-channel signal and the right-channel signal, depending on whether $G_{n,k}$ is less than $10^{-3}$ that is a predetermined threshold.

If $G_{n,k}$ is less than $10^{-3}$, the phases of the left-channel signal and the right-channel signal are determined to be adjusted. If $G_{n,k}$ is equal to or greater than $10^{-3}$, the phases of the left-channel signal and the right-channel signal are determined not to be adjusted.

If it is determined in operation 2305 that the difference between the phases of the left-channel signal and the right-channel signal falls within the predetermined range, the phases of the left-channel signal and the right-channel signal are adjusted by a predetermined phase. This is because the nearer the difference between the phases of the left-channel signal and the right-channel signal approximates 180 degrees, the nearer the sum of the vectors of the left-channel signal and the right-channel signal approximates zero. The predetermined range may be determined based on 180 degrees.

In operation 2310, the phases of the left-channel signal and the right-channel signal are adjusted by the same phase. For example, if the phase of the left-channel signal is adjusted by an angle of θ°, the phase of the right-channel signal is adjusted by an angle of −θ°.

Returning to operation 2305, phase adjustment is performed by transforming $S_{n,k}$ as follows:

$$S_{n,k} = \frac{L_{n,k}e^{j\theta} + R_{n,k}e^{-j\theta}}{2}, \tag{29}$$

wherein $L_{n,k}$ denotes the left-channel signal, $R_{n,k}$ denotes the right-channel signal, θ denotes a predetermined value, e.g., π/100, n denotes a frame number, and k denotes a band number.

Next, information regarding the phases adjusted in operation 2310 is encoded (operation 2320). For example, if the phases of the left-channel signal and the right-channel signal are respectively adjusted by the angle of θ° and the angle of −θ° in operation 2310, information regarding the angle of θ° is encoded.

Next, the stereo signal whose phase is adjusted in operation 2310, or the stereo signal transformed into the predetermined domain in operation 2300 is downmixed to the mono signal (operation 2330).

Returning to operation 2305, the final $S_{n,k}$ is calculated by:

$$S_{n,k} = S_{n,k}\min\left\{2, \sqrt{\frac{|L_{n,k}|^2 + |R_{n,k}|^2}{2|S_{n,k}|^2}}\right\}, \tag{30}$$

wherein $S_{n,k}$ of the right-hand side of Equation (29) denotes a phasor calculated by Equation (29), $L_{n,k}$ denotes the left-channel signal, $R_{n,k}$ denotes the right-channel signal, n denotes a frame number, and k denotes a band number.

In operation 2330, the mono signal is produced a mono signal by using $S_{n,k}$ calculated by Equation (30), as follows:

$$M_{n,k} = S_{n,k}\sqrt{\frac{\sum_{k=1}^{N}|L_{n,k}|^2 + |R_{n,k}|^2}{4\sum_{k=1}^{N}|S_{n,k}|^2}}, \tag{31}$$

wherein $M_{n,k}$ denotes the mono signal, $S_{n,k}$ denotes the phasor calculated by Equation (30), $L_{n,k}$ denotes the left-channel signal, $R_{n,k}$ denotes the right-channel signal, n denotes a frame number, and k denotes a band number.

The amplitude of the downmixed mono signal may be equal to the average of the amplitudes of a left-channel signal and a right-channel signal, and the mono signal may be generated on a half sum vector of the left-channel signal and the right-channel signal.

Next, an inverse operation of the transformation performed in operation 2300 is performed on the domain of the mono signal downmixed in operation 2330, that is, the domain is inversely transformed using the synthesis filterbank (operation 2340). For example, in operation 2340, inverse transformation is performed so that the mono signal, which is expressed in the time domain for each of the sub bands at predetermined frequency units, can be expressed as a time series only in the time domain.

Next, the mono signal that was inversely transformed in operation 2340 is encoded (operation 2350).

Next, parameters necessary to upmix the mono signal to the stereo signal by a decoding process are extracted from the stereo signal, and the extracted parameters are encoded (operation 2360). The extracted parameters are information for producing the left-channel signal and the right-channel signal, based on the mono signal.

The parameters include a size parameter that represents the ratio of the amplitude of at least one of a left-channel signal and a right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter by using a decorrelated signal that is a vertical vector component of the mono signal.

The parameters, which are extracted in operation 2360, may be produced for each frame, in band units.

Thereafter, the parameters encoded in operation 2360 and the mono signal encoded in operation 2350 are multiplexed together, thereby obtaining a bitstream (operation 2370). Also, in operation 2370, if the phase of the stereo signal is adjusted in operation 2310, the information regarding the adjusted phases, which is encoded in operation 2320, is multiplexed together with the parameters and the mono signal.

Figure 24:
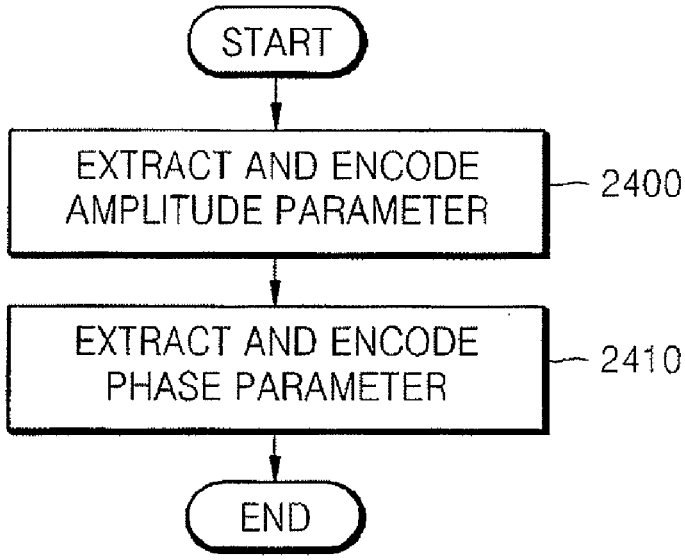
FIG. 24 is a flowchart illustrating in detail operation 2030, 2140, 2250, or 2360 included in a method of encoding a stereo signal, according to an embodiment of the present invention.
Figure 25:
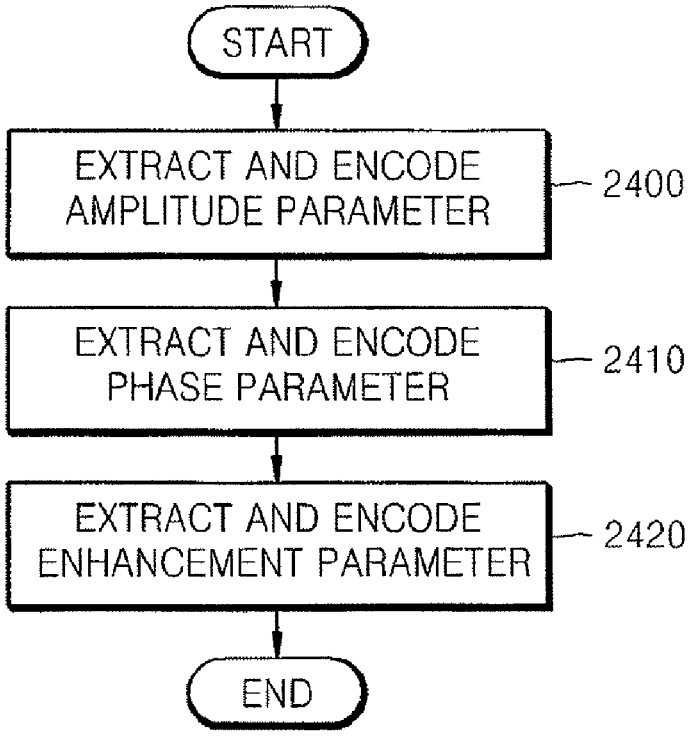
FIG. 25 is a flowchart illustrating in detail operation 2030, 2140, 2250, or 2360 included in a method of encoding a stereo signal, according to another embodiment of the present invention.

FIGS. 24 and 25 are flowcharts illustrating in detail operation 2030, 2140, 2250, or 2306 included in a method of encoding a stereo signal, according to embodiments of the present invention. Operation 2030, 2140, 2250, or 2306 includes operation 2400 and 2410 as illustrated in FIG. 24, but may further include operation 2420 as illustrated in FIG. 25.

First, a size parameter that represents the ratio of the amplitude of at least one of a left-channel signal and a right-channel signal to the amplitude of a mono signal is extracted and encoded (operation 2400).

After operation 2400, a phase parameter that represents the difference between at least one of the left-channel signal and the right-channel signal and the mono signal is extracted and encoded (operation 2420). Alternatively, the phase parameter extracted in operation 2420 may represent the difference between the phases of the left-channel signal and the mono signal, the difference between the phases of the right-channel signal and the mono signal, or the difference among the phases of the left-channel signal and the right-channel signal and the mono signal.

In operation 2420 included in the embodiment illustrated in FIG. 25, an enhancement parameter for enhancing and controlling the phase indicated by the phase parameter using a decorrelated signal that is a vertical vector component of the mono signal is extracted and encoded.

However, the sequence of performing operations 2400 through 2420 is not limited.

Figure 26:
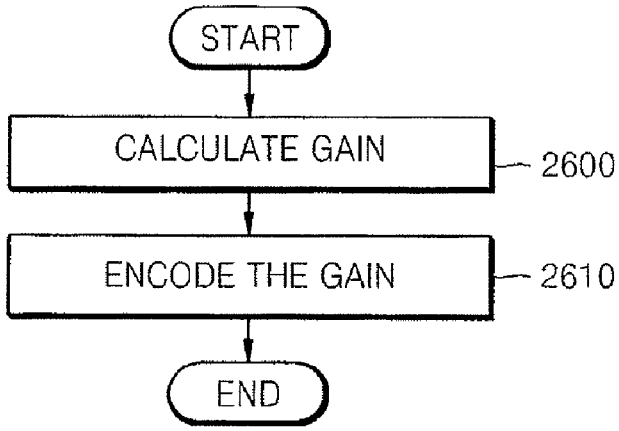
FIG. 26 is a flowchart illustrating in detail operation 2400 illustrated in FIG. 24 or 25, according to an embodiment of the present invention.

FIG. 26 is a flowchart illustrating in detail operation 2400 illustrated in FIG. 24 or 25, according to an embodiment of the present invention.

First, on an assumption that the amplitude of a left-channel signal has a predetermined relation to that of a right-channel signal, a gain is calculated to minimize the difference between the energy levels of an actual stereo signal and a stereo signal that is to be generated from a mono signal by applying the calculated gain, so that an error between the amplitudes of the actual stereo signal and a stereo signal that is to be decoded by a decoding process can be minimized (operation 2600).

The calculated gain is used in determining the amplitude of the left-channel signal and the right-channel signal when the decoding terminal upmixes the mono signal to a stereo signal.

For example, if it is assumed that the predetermined relation between the left-channel signal and the right-channel signal is that the amplitude of the mono signal is equal to the average of the amplitudes of the left-channel signal and the right-channel signal, the left-channel signal and the right-channel signal can be expressed by:

$$\tilde{a}_{n,k}^{L}=g_m a_{n,k}^{M}$$

$$\tilde{a}_{n,k}^{R}=(2-g_m)a_{n,k}^{M} \quad (32),$$

wherein $\tilde{a}_{n,k}^{L}$ denotes the amplitude of the left-channel amplitude to which the gain calculated in operation 2600 is applied, $\tilde{a}_{n,k}^{R}$ denotes the amplitude of the right-channel signal to which the calculated gain is to be applied, $g_m$ denotes the gain used to determine signal amplitude, $a_{n,k}^{M}$ denotes the amplitude of the mono signal, n denotes a frame number, and k denotes a band number.

The difference between the energy levels of the actual stereo signal and the stereo signal to which the calculated gain is applied, can be calculated by the following Equation (33) into which Equation (32) has been substituted:

$$\begin{aligned} E_{n,k}^{LR} &= \sum_n (\tilde{a}_{n,k}^{L} - a_{n,k}^{L})^2 + \sum_n (\tilde{a}_{n,k}^{R} - a_{n,k}^{R})^2 \\ &= \sum_n (g_m a_{n,k}^{M} - a_{n,k}^{L})^2 + \sum_n ((2-g_m)a_{n,k}^{M} - a_{n,k}^{R})^2, \end{aligned} \quad (33)$$

wherein $E_{n,k}^{LR}$ denotes the difference between the energy levels of the actual stereo signal and the stereo signal to which the calculated gain is applied, $\tilde{a}_{n,k}^{L}$ denotes the amplitude of the left-channel signal to which the calculated gain is applied, $\tilde{a}_{n,k}^{R}$ denotes the amplitude of the right-channel signal to which the calculated gain is applied, $a_{n,k}^{L}$ denotes the amplitude of an actual left-channel signal, $a_{n,k}^{R}$ denotes the amplitude of an actual right-channel signal, $g_m$ denotes the gain used to calculate the amplitude of a signal, $a_{n,k}^{M}$ denotes the amplitude of the mono signal, n denotes a frame number, and k denotes a band number.

Equation (33) into which Equation (32) has been substituted can be expressed with respect to the gain $g_m$, as follows:

$$g_m = 1 + \frac{\sum_n \sum_k a_{n,k}^{M} a_{n,k}^{L} - \sum_n \sum_k a_{n,k}^{M} a_{n,k}^{R}}{2\sum_n \sum_k (a_{n,k}^{M})^2}, \quad (34)$$

wherein $g_m$ denotes the gain used to calculate the amplitude of a signal, $a_{n,k}^{L}$ denotes the amplitude of the actual left-channel signal, $a_{n,k}^{R}$ denotes the amplitude of the actual right-channel signal, $a_{n,k}^{M}$ denotes the amplitude of the mono signal, n denotes a frame number, and k denotes a band number.

Thus, in operation 2600, it is possible to calculate the gain that minimizes the difference between the energy levels of the actual stereo signal and the stereo signal to which the gain is applied by substituting the actual left-channel signal amplitude $a_{n,k}^{L}$, the actual right-channel signal amplitude $a_{n,k}^{R}$, and the mono signal amplitude $a_{n,k}^{M}$ into Equation (34).

Thereafter, the gain calculated in operation 2600 is encoded (operation 2610).

Figure 27:
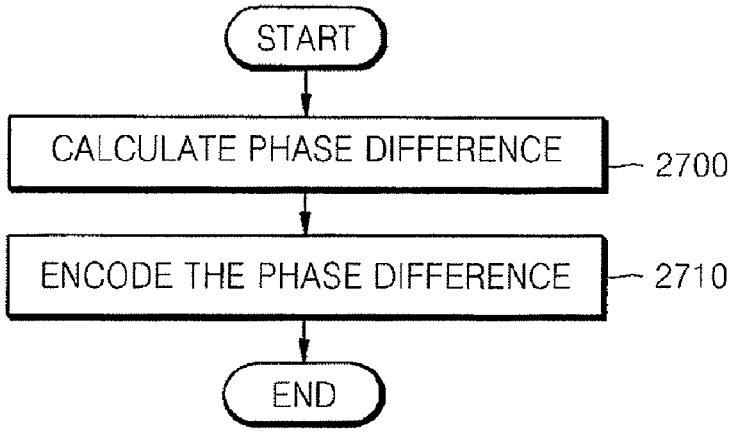
FIG. 27 is a flowchart illustrating in detail operation 2420 illustrated in FIG. 25, according to an embodiment of the present invention.

FIG. 27 is a flowchart illustrating in detail operation 2420 illustrated in FIG. 25, according to an embodiment of the present invention.

First, a phase difference that minimizes the difference between the phases of an actual stereo signal and a stereo signal that is to be generated by applying the phase difference is calculated in order to minimize an error between the phases of the actual stereo signal and a stereo signal that is to be decoded by a decoding terminal, on an assumption that the phase of a left-channel signal has a predetermined relation to the phase of a right-channel signal (operation 2700).

The difference between the energy levels of the actual stereo signal and the stereo signal that is to be generated can be calculated by:

$$E_{n,k}^{LR}=2(a_{n,k}^{R})^2[1-\cos(\phi_{n,k}^{R}-\phi_{n,k}^{M}+\psi_{n,k}^{R})]+2(a_{n,k}^{L})^2[1-\cos(\phi_{n,k}^{M}-\phi_{n,k}^{L}+\psi_{n,k}^{L})] \quad (35),$$

wherein $E_{n,k}^{LR}$ denotes the difference between the energy levels of the actual stereo signal and the stereo signal that is to be generated, $a_{n,k}^{R}$ denotes the amplitude of an actual right-channel signal, $a_{n,k}^{L}$ denotes the amplitude of an actual left-channel signal, $\phi_{n,k}^{R}$ denotes the phase of the actual right-channel signal, $\phi_{n,k}^{M}$ denotes the phase of a mono signal, $\phi_{n,k}^{L}$ denotes the phase of the actual left-channel signal, $\psi_{n,k}^{R}$ denotes the difference between the phases of the mono signal and the right-channel signal, $\psi_{n,k}^{L}$ denotes the difference between the phases of the mono signal and the left-channel signal, n denotes a frame number, and k denotes a band number.

If it is assumed that the difference between the phases of the left-channel signal and the mono signal is equal to the difference between the phases of the right-channel signal and the mono signal in Equation (35), that is, if it is assumed that $\psi_{n,k}^{R}$ and $\psi_{n,k}^{L}$ has the same value, e.g., $\psi_{n,k}$, Equation (35) can be expressed by:

$$tg(\psi_{n,k})=\frac{\sum_n\sum_k (a_{n,k}^{R})^2\sin(\varphi_{n,k}^{M}-\varphi_{n,k}^{R})+\sum_n\sum_k (a_{n,k}^{L})^2\sin(\varphi_{n,k}^{L}-\varphi_{n,k}^{M})}{\sum_n\sum_k (a_{n,k}^{R})^2\cos(\varphi_{n,k}^{M}-\varphi_{n,k}^{R})+\sum_n\sum_k (a_{n,k}^{L})^2\cos(\varphi_{n,k}^{L}-\varphi_{n,k}^{M})} \quad (36)$$

wherein $\psi_{n,k}$ denotes the difference between the phases of the mono signal and the stereo signal, $a_{n,k}^{R}$ denotes the amplitude of the actual right-channel signal, $a_{n,k}^{L}$ denotes the amplitude of the actual left-channel signal, $\phi_{n,k}^{R}$ denotes the phase of the actual right-channel signal, $\phi_{n,k}^{M}$ denotes the phase of the mono signal, $\phi_{n,k}^{L}$ denotes the phase of the actual left-channel signal, n denotes a frame number, and k denotes a band number.

Thus, in operation 2700, the phase difference that minimizes the difference between the energy levels of the actual stereo signal and the stereo signal that is to be generated can be calculated by substituting the actual left-channel signal amplitude $a_{n,k}^{L}$, the actual right-channel signal amplitude $a_{n,k}^{R}$, the actual left-channel signal phase $\phi_{n,k}^{L}$, the actual right-channel signal phase $\phi_{n,k}^{R}$, and the mono signal phase $\phi_{n,k}^{M}$ into Equation (36).

Thereafter, the calculated phase difference is encoded (operation 2710).

Figure 28:
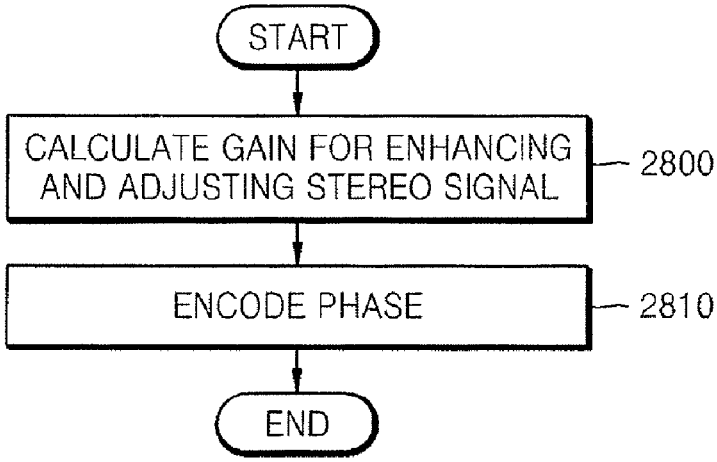
FIG. 28 is a flowchart illustrating in detail operation 2420 illustrated in FIG. 25, according to another embodiment of the present invention.

FIG. 28 is a flowchart illustrating in detail operation 2420 illustrated in FIG. 25, according to another embodiment of the present invention.

First, a second phase for enhancing and controlling a first phase indicated by a phase parameter encoded, is calculated using a decorrelated signal that is a vertical vector component of a mono signal (operation 2800).

For example, in operation 2800, the second phase for enhancing and controlling the first phase can be calculated by:

$$tg(\alpha_k)=\min\left[1,\sqrt{\frac{2\left(\sum_{n=b_k}^{b_{k+1}-1}(a_{n,k}^{L})^2(1-\cos(\varphi_{n,k}^{L}-\varphi_{n,k}^{M}-\psi_{n,k}))+\sum_{n=b_k}^{b_{k+1}-1}(a_{n,k}^{R})^2(1-\cos(\varphi_{n,k}^{R}-\varphi_{n,k}^{M}+\psi_{n,k}))\right)}{\sum_{n=b_k}^{b_{k+1}-1}(a_{n,k}^{L})^2+\sum_{n=b_k}^{b_{k+1}-1}(a_{n,k}^{R})^2}}\right], \quad (37)$$

wherein $a_{n,k}^{L}$ denotes the amplitude of an actual left-channel signal, $\phi_{n,k}^{L}$ denotes the phase of the actual left-channel signal, $\phi_{n,k}^{M}$ denotes the phase of the mono signal, $\psi_{n,k}$ denotes the difference between the phases of the mono signal and the stereo signal, $a_{n,k}^{R}$ denotes the amplitude of an actual right-channel signal, $\phi_{n,k}^{R}$ denotes the phase of the actual right-channel signal, $b_k$ denotes a band border value, n denotes a frame number, and k denotes a band number.

Thus, in operation 2800, the second phase can be calculated by using the actual left-channel signal amplitude $a_{n,k}^{L}$, the actual left-channel signal phase $\phi_{n,k}^{L}$, the mono signal phase $\phi_{n,k}^{M}$, the difference $\psi_{n,k}$ between the phases of the mono signal and the stereo signal, the actual right-channel signal amplitude $a_{n,k}^{R}$, and the actual right-channel signal phase $\phi_{n,k}^{R}$.

Thereafter, the second phase is encoded (operation 2810).

Figure 29:
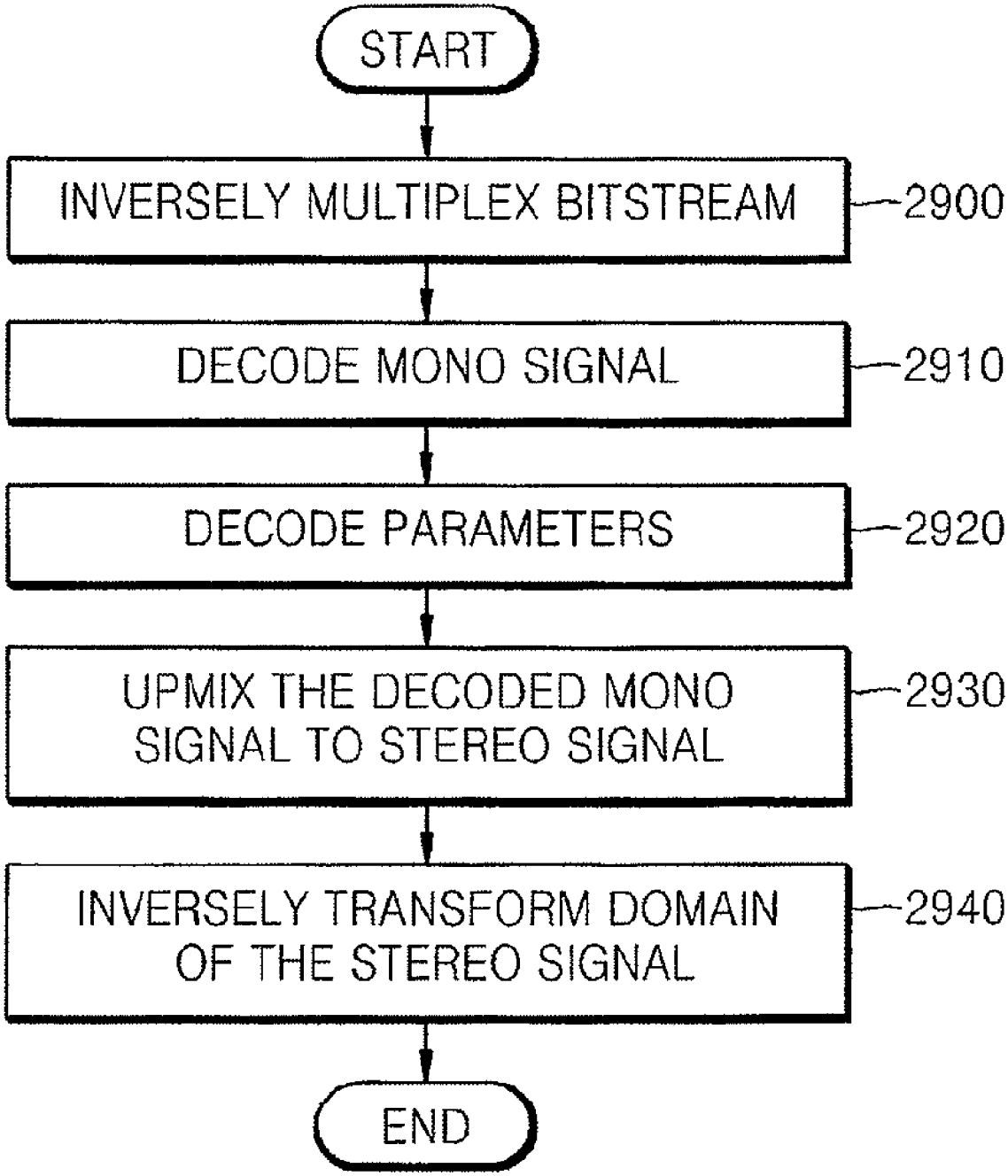
FIG. 29 is a flowchart illustrating a method of decoding a stereo signal, according to an embodiment of the present invention.

FIG. 29 is a flowchart illustrating a method of decoding a stereo signal, according to an embodiment of the present invention.

First, a bitstream is received from an encoding terminal, and inversely multiplexed (operation 2900). The bitstream contains parameters necessary to upmix a mono signal generated by an encoding apparatus, and the mono signal encoded by the encoding apparatus.

Next, the inversely multiplexed, encoded mono signal is decoded (operation 2910).

Next, the inversely multiplexed parameters are decoded (in operation 2920). The decoded parameters include a size parameter that represents the ratio of the amplitude of at least one of a left-channel signal and a right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter by using a decorrelated signal that is a vertical vector component of the mono signal. The decoded parameters may be produced for each frame and in band units.

Next, the decoded mono signal is upmixed to a stereo signal by using the decoded parameters, such as the size parameter, the phase parameter, and the enhancement parameter (operation 2930). When the mono signal is upmixed to a stereo signal containing a left-channel signal and a right-channel signal in operation 2930, the amplitudes of the left-channel signal and the right-channel signal are determined using the mono signal according to the size parameter, the phases of the left-channel signal and the right-channel signal are determined using the mono signal according to the phase parameter, and the determined phases of the left-channel signal and the right-channel signal are enhanced and controlled using a decorrelated signal according to the enhancement parameter.

Next, an inverse operation of the transformation performed in operation 2000 illustrated in FIG. 20 is performed, that is, the domain of the stereo signal upmixed in operation 2930 is inversely transformed using the synthesis filterbank (operation 2940). For example, in operation 2940, the mono signal, which is expressed as spectra in the time domain for each of the sub bands at predetermined frequency units, is inversely transformed so that it can be expressed as a time series only in the time domain.

Figure 30:
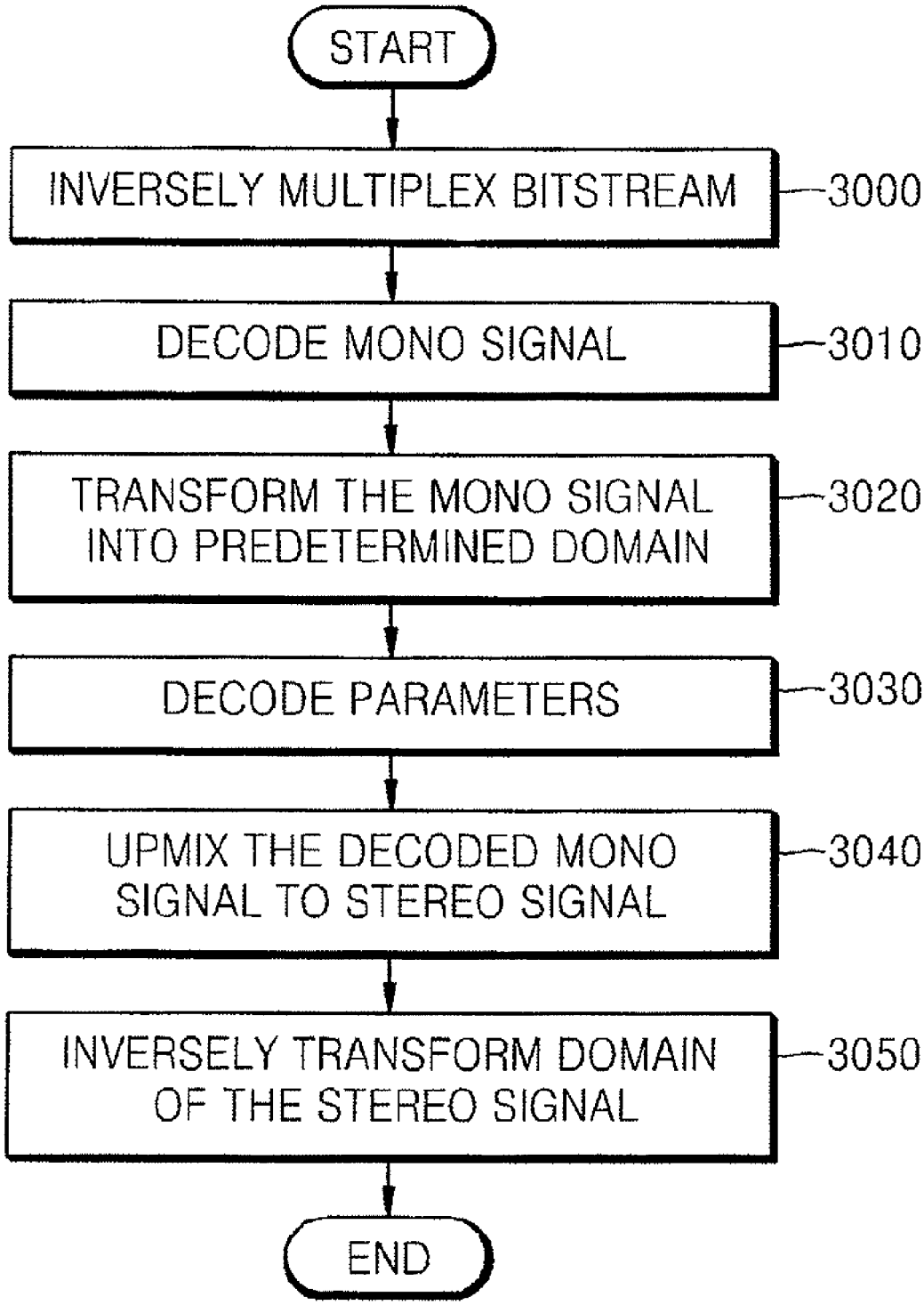
FIG. 30 is a flowchart illustrating a method of decoding a stereo signal, according to another embodiment of the present invention.

FIG. 30 is a flowchart illustrating a method of decoding a stereo signal, according to another embodiment of the present invention.

First, a bitstream is received from an encoding terminal and inversely multiplexed (operation 3000). The bitstream contains parameters necessary to upmix a mono signal generated by an encoding apparatus, and the mono signal encoded by the encoding apparatus.

Next, the inversely multiplexed, encoded mono signal is decoded (operation 3010).

Next, the decoded mono signal is transformed into a predetermined domain by using an analysis filterbank (operation 3020). The predetermined domain may have a complex-number format in which both the amplitude and phase of each signal can be expressed. For example, the predetermined domain allows each signal to be expressed in the time domain as spectra for each of the sub bands at predetermined frequency units.

Next, the inversely multiplexed parameters are decoded (operation 3030). The decoded parameters include a size parameter that represents the ratio of the amplitude of at least one of a left-channel signal and a right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter by using a decorrelated signal that is a vertical vector component of the mono signal. The decoded parameters may be produced for each frame and in band units.

Next, the decoded mono signal is upmixed to a stereo signal by using the decoded parameters, such as the size parameter, the phase parameter, and the enhancement parameter (operation 3040). When the mono signal is upmixed to a stereo signal containing a left-channel signal and a right-channel signal in operation 3040, the amplitudes of the left-channel signal and the right-channel signal are determined using the mono signal according to the size parameter, the phases of the left-channel signal and the right-channel signal are determined using the mono signal according to the phase parameter, and the determined phases of the left-channel signal and the right-channel signal are enhanced and controlled using a decorrelated signal according to the enhancement parameter.

Thereafter, an inverse operation of the transformation performed in operation 3020 is performed, that is, the domain of the stereo signal upmixed in operation 3040 is inversely transformed using the synthesis filterbank (operation 3050). For example, in operation 3050, the mono signal, which is expressed in the time domain as spectra for each of the sub bands at predetermined frequency units, is inversely transformed so that it can be expressed as a time series only in the time domain.

Figure 31:
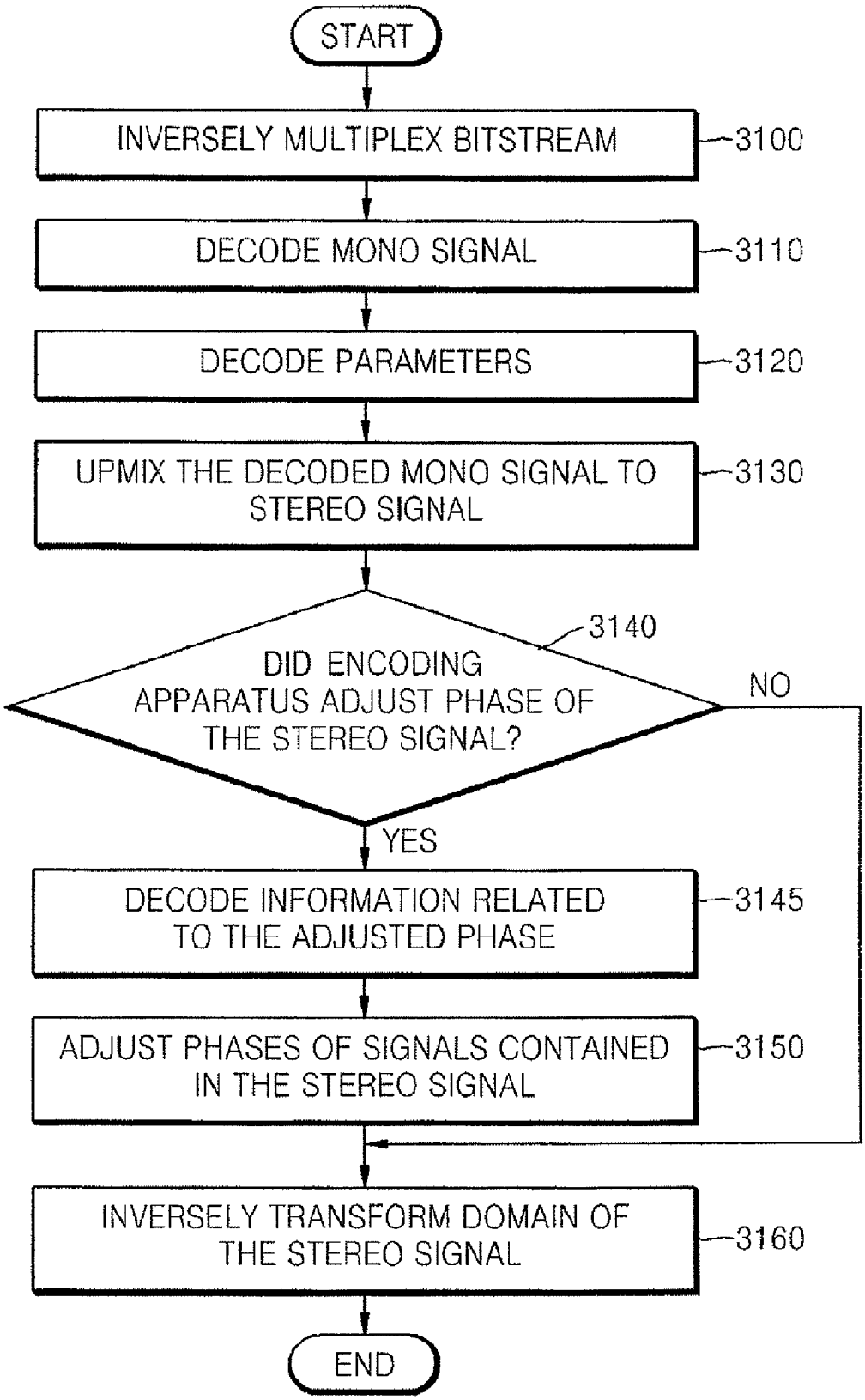
FIG. 31 is a flowchart illustrating a method of decoding a stereo signal, according to another embodiment of the present invention.

FIG. 31 is a flowchart illustrating a method of decoding a stereo signal, according to another embodiment of the present invention.

First, a bitstream is received from an encoding terminal and inversely multiplexed (operation 3100). The bitstream contains parameters necessary to upmix a mono signal generated by an encoding apparatus, and the mono signal encoded by the encoding apparatus. If the encoding apparatus has adjusted the phase of the stereo signal because the difference between the phases of a left-channel signal and a right-channel signal contained in the stereo signal fell within a predetermined range, the bitstream further contains information regarding the phase of the stereo signal, which is adjusted by the encoding apparatus.

Next, the inversely multiplexed, encoded mono signal is decoded (operation 3110).

Next, the inversely multiplexed parameters are decoded (operation 3120). The decoded parameters include a size parameter that represents the ratio of the amplitude of at least one of the left-channel signal and the right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter by using a decorrelated signal that is a vertical vector component of the mono signal. The decoded parameters may be produced for each frame and in band units.

Next, the decoded mono signal is upmixed to a stereo signal by using the decoded parameters, such as the size parameter, the phase parameter, and the enhancement parameter. When the mono signal is upmixed to a stereo signal containing the left-channel signal and the right-channel signal in operation 3130, the amplitudes of the left-channel signal and the right-channel signal are determined using the mono signal according to the size parameter, the phases of the left-channel signal and the right-channel signal are determined using the mono signal according to the phase parameter, and the determined phases of the left-channel signal and the right-channel signal are enhanced and controlled using a decorrelated signal according to the enhancement parameter.

After operation 3130, it is determined whether the phases of the left-channel signal and the right-channel signal have been adjusted due to the difference between the phases of the left-channel signal and the right-channel signal falling within the predetermined range (operation 3140). In other words, it is determined whether the bitstream being inversely multiplexed in operation 3100 contains the information regarding the adjusted phases.

If it is determined in operation 3140 that the encoding apparatus has adjusted the phases of the left-channel signal and the right-channel signal, the information regarding the adjusted phases is decoded (operation 3145). For example, if the encoding apparatus adjusts the phase of the left-channel signal by an angle of $\theta°$ and the phase of the right-channel signal by an angle of $-\theta°$, the information regarding the adjusted phase indicates the angle of $\theta°$.

Next, the phases of the left-channel signal and the right-channel signal of the upmixed stereo signal are respectively adjusted by the adjusted phases (operation 3150).

If the inversely multiplexed bitstream contains the information regarding the adjusted phases, an inverse operation of the transformation performed in operation 2200 illustrated in FIG. 22 is performed, that is, the domain of the stereo signal that is upmixed in operation 3130 or is adjusted in operation 3150 is inversely transformed using the synthesis filterbank (operation 3160). For example, in operation 3160, the mono signal, which is expressed in the time domain as spectra for each of the sub bands at predetermined frequency units, is inversely transformed so that it can be expressed as a time series only in the time domain.

Figure 32:
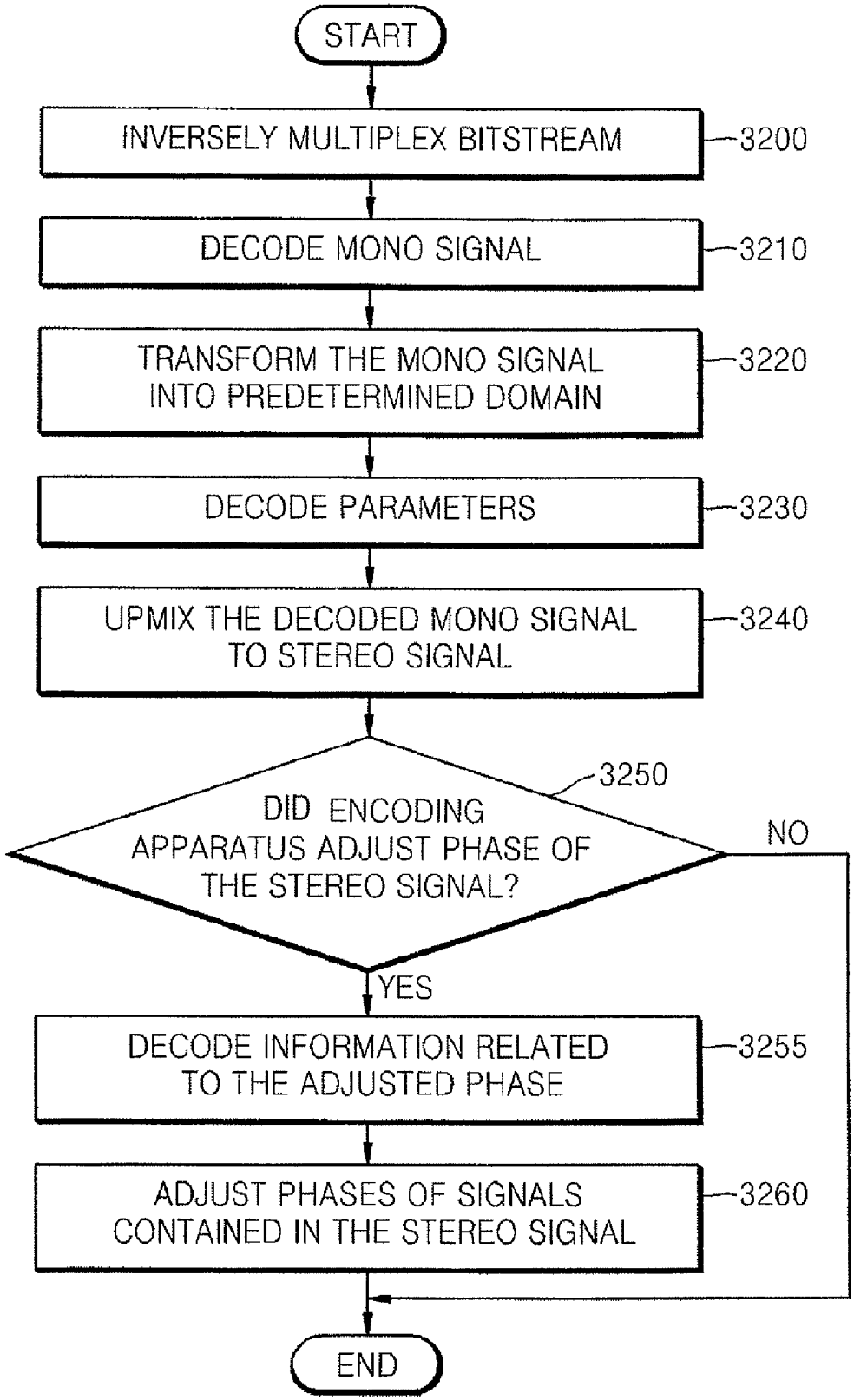
FIG. 32 is a flowchart illustrating a method of decoding a stereo signal, according to another embodiment of the present invention.

FIG. 32 is a flowchart illustrating a method of decoding a stereo signal, according to another embodiment of the present invention.

First, a bitstream is received from an encoding terminal and inversely multiplexed (operation 3200). The bitstream contains parameters necessary to upmix a mono signal generated by an encoding apparatus, and the mono signal encoded by the encoding apparatus. If the encoding apparatus adjusted the phase of the stereo signal due to the difference between the phases of a left-channel signal and a right-channel signal contained in the stereo signal falling within a predetermined range, the bitstream further contains information regarding the adjusted phase of the stereo signal.

Next, the inversely multiplexed, encoded mono signal is decoded (operation 3210).

Next, the decoded mono signal is transformed into a predetermined domain by using the analysis filterbank (operation 3210). The predetermined domain may have a complex-number format in which both the amplitude and phase of each signal can be expressed. For example, the predetermined domain allows each signal to be expressed in the time domain as spectra for each of the sub bands at predetermined frequency units.

Next, the inversely multiplexed parameters are decoded (operation 3230). The decoded parameters include a size parameter that represents the ratio of the amplitude of at least one of the left-channel signal and the right-channel signal to the amplitude of the mono signal, and a phase parameter that represents the difference between the phases of at least one of the left-channel signal and the right-channel signal and the mono signal. The parameters may further include an enhancement parameter that contains information for enhancing information contained in the size parameter and the phase parameter by using a decorrelated signal that is a vertical vector component of the mono signal. The decoded parameters may be produced for each frame and in band units.

Next, the transformed mono signal is upmixed to a stereo signal by using the decoded parameters, such as the size parameter, the phase parameter, and the enhancement parameter (operation 3240). When the mono signal is upmixed to a stereo signal containing the left-channel signal and the right-channel signal in operation 3240, the amplitudes of the left-channel signal and the right-channel signal are determined using the mono signal according to the size parameter, the phases of the left-channel signal and the right-channel signal are determined using the mono signal according to the phase parameter, and the determined phases of the left-channel signal and the right-channel signal are enhanced and controlled using a decorrelated signal according to the enhancement parameter.

After operation 3240, it is determined whether the encoding apparatus has adjusted the phases of the left-channel signal and the right-channel signal because the difference between the phases of the left-channel signal and the right-channel signal fell within the predetermined range (operation 3250). That is, it is determined whether the inversely multiplexed bitstream contains the information regarding the adjusted phases.

If it is determined in operation 3250 that the encoding apparatus adjusted the phases of the left-channel signal and the right-channel signal, the information regarding the adjusted phases is decoded (operation 3255). For example, if the encoding apparatus adjusted the phase of the left-channel signal by an angle of θ° and the phase of the right-channel signal by an angle of −θ°, the information regarding the adjusted phases indicates the angle of θ°.

Next, the phases of the left-channel signal and the right-channel signal of the upmixed stereo signal are respectively adjusted, by the adjusted phases (operation 3260).

However, the inversely multiplexed bitstream does not contain the information regarding the adjusted phases, the phase adjustment unit 1360 does not adjust the phases of the left-channel signal and the right-channel signal that are upmixed to the stereo signal.

If the inversely multiplexed bitstream contains the information regarding the adjusted phases, an inverse operation of the transformation performed in operation 3220 is performed, that is, the domain of the stereo signal that is upmixed in operation 3240 or whose phase is adjusted in operation 3260 is inversely transformed using the synthesis filterbank (operation 3270). For example, in operation 3270, the mono signal, which is expressed in the time domain as spectra for each of the sub bands at predetermined frequency units, is inversely transformed so that it can be expressed as a time series only in the time domain.

Figure 33:
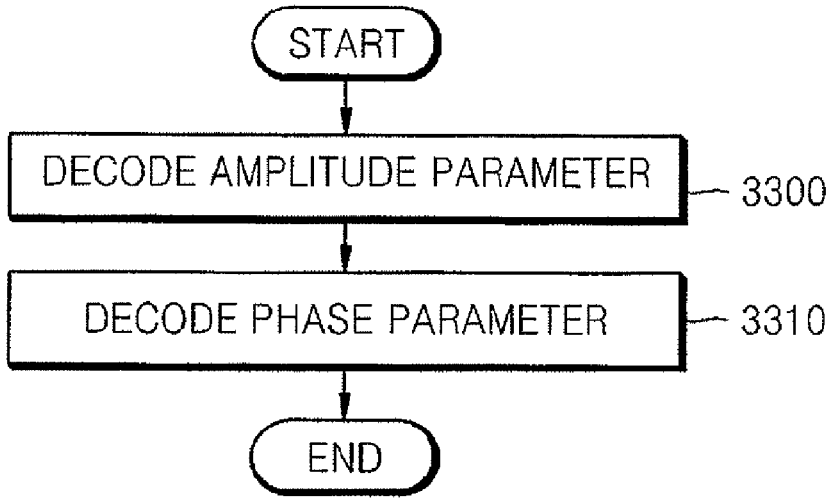
FIG. 33 is a flowchart illustrating operation 2920, 3030, 3120 or 3230 included in a method of decoding a stereo signal, according to an embodiment of the present invention.
Figure 34:
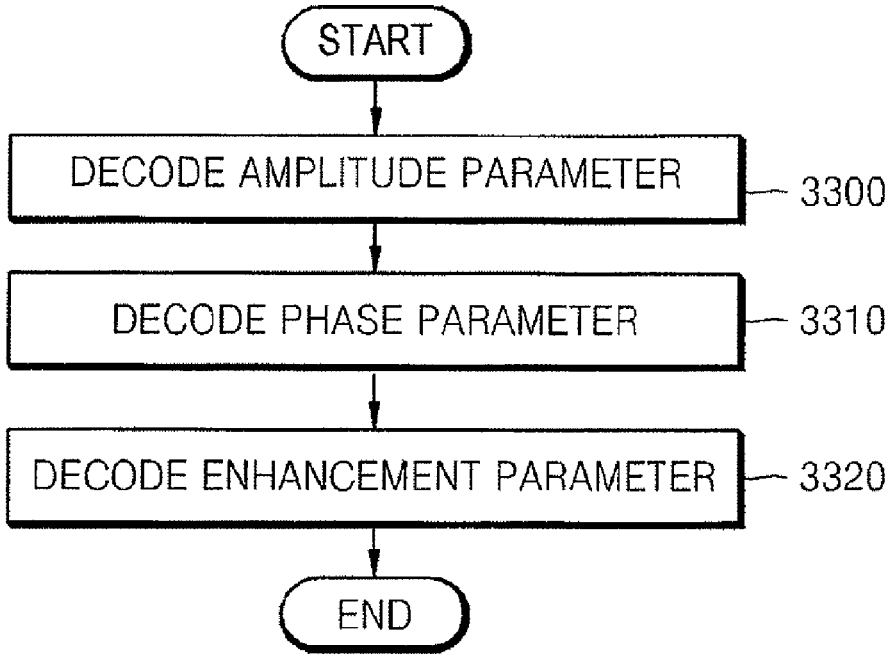
FIG. 34 is a flowchart illustrating operation 2920, 3030, 3120 or 3230 included in a method of decoding a stereo signal, according to another embodiment of the present invention.

FIGS. 33 and 34 are flowcharts illustrating in detail operation 2920, 3030, 3120, or 3230 included in a method of decoding a stereo signal, according to embodiments of the present invention. Operation 2920, 3030, 3120, or 3230 includes operation 3300 and operation 3320 as illustrated in FIG. 33, but may further include operation 3320 as illustrated in FIG. 34.

First, the size parameter that represents the ratio of the amplitude of at least one of the left-channel signal and the right-channel signal to the amplitude of the mono signal is decoded (operation 3300).

After operation 3300, the phase parameter that represents the difference between the phases of at least one of the left-channel signal and the right-channel signal and the mono signal is decoded (operation 3310).

In operation 3320 included in the embodiment illustrated in FIG. 34, the enhancement parameter for enhancing and controlling the phase indicated by the phase parameter by using a decorrelated signal that is a vertical vector component of the mono signal, is decoded.

However, the sequence of performing operations 3300 through 3320 is not limited.

Figure 35:
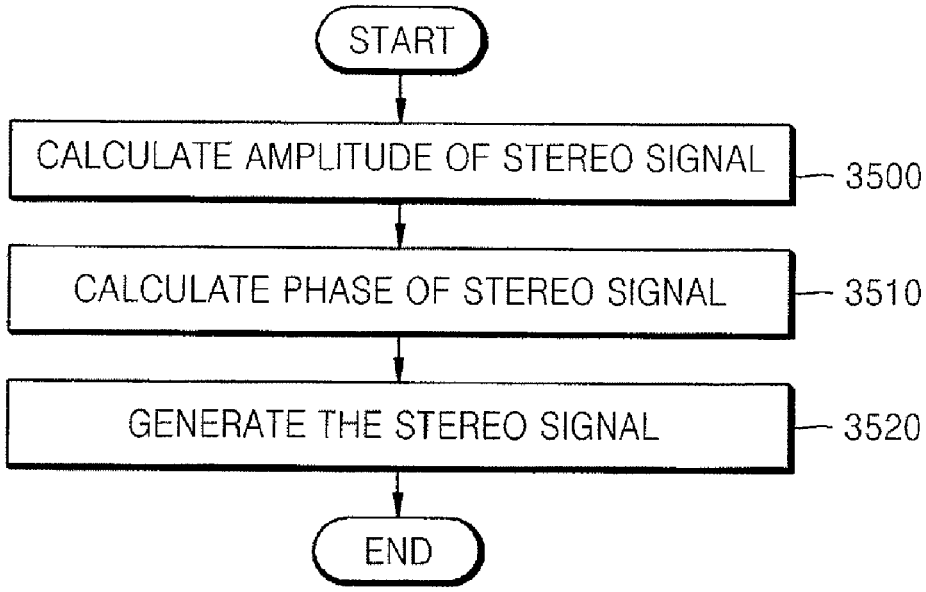
FIG. 35 is a flowchart illustrating in detail operation 2930, 3040, 3130 or 3240 included in a method of decoding a stereo signal, according to an embodiment of the present invention.

FIG. 35 is a flowchart illustrating in detail operation 2930, 3040, 3130 or 3240 included in a method of decoding a stereo signal, according to an embodiment of the present invention.

First, the amplitudes of the left-channel signal and the right-channel signal are calculated based on the amplitude of the mono signal, using the size parameter decoded in operation 3300 illustrated in FIG. 33 or 34 (operation 3500). Here, the size parameter refers to a gain that an encoding apparatus calculates to minimize the difference between the energy levels of an actual signal and a stereo signal to which the gain is to be applied, in order to minimize an error between the amplitudes of the actual stereo signal and a stereo signal that is to be decoded by a decoding terminal.

If it is assumed that the relation between the left-channel signal and the right-channel signal is predetermined so that the amplitude of the mono signal can be equal to the average of the amplitudes of the left-channel signal and the right-channel signal, the amplitudes of the left-channel signal and the right-channel signal can be calculated by:

$$\tilde{a}_{n,k}^{L}=g_m a_{n,k}^{M}$$

$$\tilde{a}_{n,k}^{R}=(2-g_m)a_{n,k}^{M} \quad (38),$$

wherein $\tilde{a}_{n,k}^{L}$ and $\tilde{a}_{n,k}^{R}$ respectively denote the amplitudes of the left-channel signal and the right-channel signal calculated in operation 3500, $g_m$ denotes the gain, $a_{n,k}^{M}$ denotes the amplitude of the mono signal, n denotes a frame number, and k denotes a band number.

Next, the phases of the left-channel signal and the right-channel signal are calculated using the phase parameter decoded in operation 3310 illustrated in FIG. 33 or 34, based on the phase of the mono signal (operation 3510). Here, the phase parameter is a phase difference $\psi_{n,k}$ calculated so that the difference between the energy levels of the actual stereo signal and the stereo signal to which the calculated phase difference is to be applied can be minimized in order to minimize an error between the phases of the actual stereo signal and a stereo signal that is to be decoded by a decoding apparatus.

If the phase parameter is the phase difference $\psi_{n,k}$ on an assumption that both the encoding apparatus and the decoding apparatus predetermine that the phase between the left-channel signal and the mono signal is equal to the phase between the right-channel signal and the mono signal, the phase of the left-channel signal is calculated by adding $\psi_{n,k}$ to the phase of the mono signal and the phase of the right-channel signal is calculated by subtracting $\psi_{n,k}$ from the phase of the mono signal in operation 3510.

Thereafter, the stereo signal is produced by generating the left-channel signal and the right-channel signal, based on the amplitudes of the left-channel signal and the right-channel signal, which are calculated in operation 3500, and the phases of the left-channel signal and the right-channel signal which are calculated in operation 3510 (operation 3520).

Figure 36:
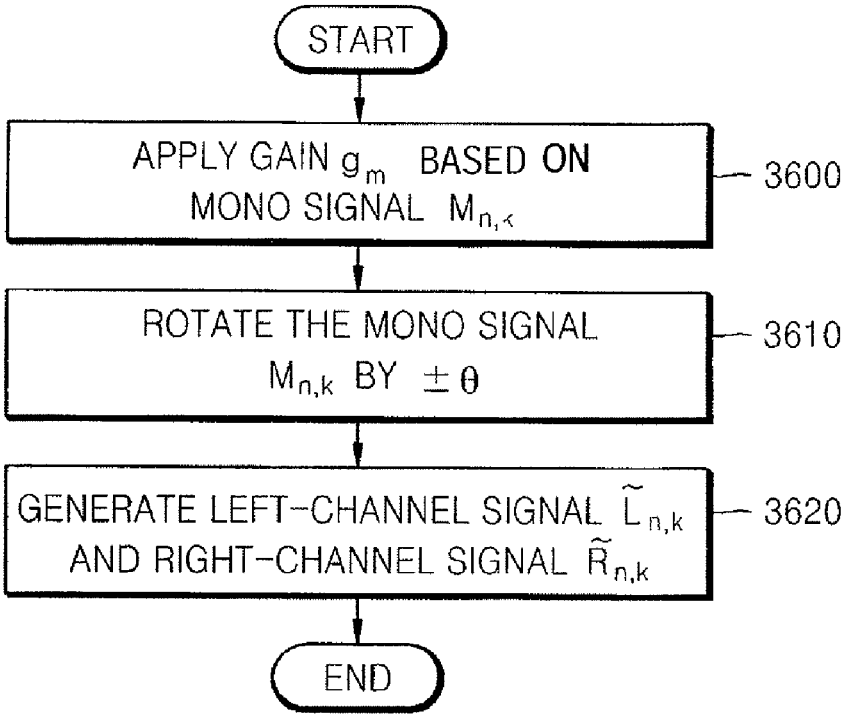
FIG. 36 is a flowchart illustrating in detail operation 2930, 3040, 3130 or 3240 illustrated in FIG. 35 by using the graph illustrated in FIG. 18.

FIG. 36 is a flowchart illustrating in detail operation 2930, 3040, 3130 or 3240 illustrated in FIG. 35 by using the graph illustrated in FIG. 18.

First, the amplitudes of a left-channel signal $\tilde{L}_{n,k}$ and a right-channel signal $\tilde{R}_{n,k}$ are determined by applying the gain $g_m$, based on a mono signal $M_{n,k}$ (operation 3600).

Next, the phases of the left-channel signal $\tilde{L}_{n,k}$ and the right-channel signal $\tilde{R}_{n,k}$ are determined by applying the phase difference θ, that is, by respectively rotating the mono signal $M_{n,k}$ by an angle of θ and an angle of −θ° (operation 3610).

Then, the left-channel signal $\tilde{L}_{n,k}$ and the right-channel signal $\tilde{R}_{n,k}$ are produced using the amplitudes of the left-channel signal and the right-channel signal that are calculated in operation 3600 and the phases of the left-channel signal and the right-channel signal that are calculated in operation 3610 (operation 3620).

Figure 37:
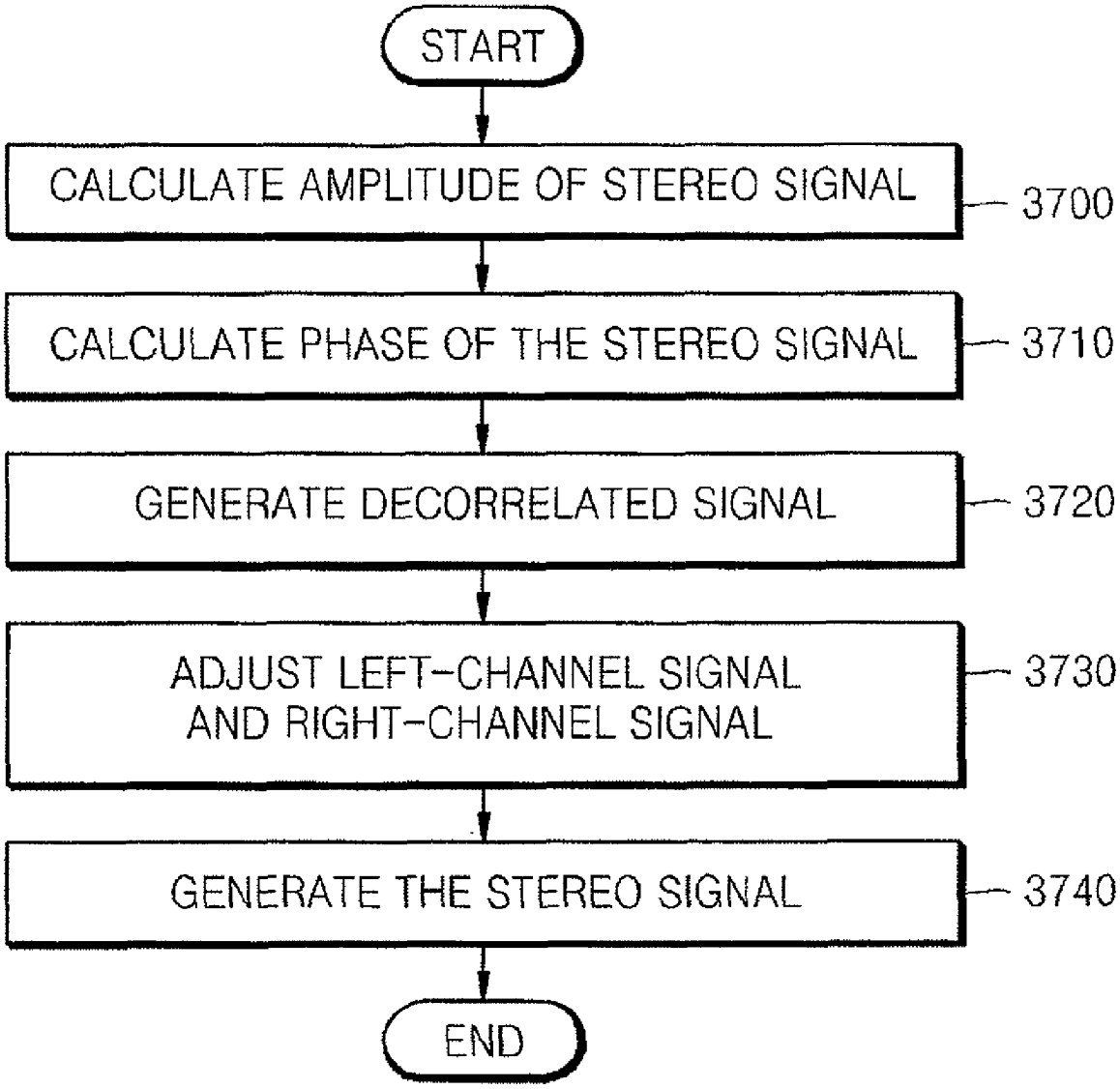
FIG. 37 is a flowchart illustrating operation 2930, 3040, 3130 or 3240 included in a method of decoding a stereo signal, according to another embodiment of the present invention.

FIG. 37 is a flowchart illustrating in detail operation 2930, 3040, 3130 or 3240 included in a method of decoding a stereo signal, according to another embodiment of the present invention.

First, the amplitudes of the left-channel signal and the right-channel signal are calculated based on the amplitude of the mono signal, using the size parameter decoded in operation 3300 illustrated in FIG. 33 or 34 (operation 3700). Here, the size parameter refers to a gain that an encoding apparatus calculates to minimize the difference between the energy levels of an actual signal and a stereo signal to which the gain is to be applied, in order to minimize an error between the amplitudes of the actual stereo signal and a stereo signal that is to be decoded by a decoding terminal.

If it is assumed that the relation between the left-channel signal and the right-channel signal is predetermined so that the amplitude of the mono signal can be equal to the average of the amplitudes of the left-channel signal and the right-channel signal, the amplitudes of the left-channel signal and the right-channel signal can be calculated by:

$$\tilde{a}_{n,k}^{L}=g_m a_{n,k}^{M}$$

$$\tilde{a}_{n,k}^{R}=(2-g_m)a_{n,k}^{M} \quad (39),$$

wherein $\tilde{a}_{n,k}^{L}$ and $\tilde{a}_{n,k}^{R}$ respectively denote the amplitudes of the left-channel signal and the right-channel signal that are calculated in operation 3700, $g_m$ denotes the gain, $a_{n,k}^{M}$ denotes the amplitude of the mono signal, n denotes a frame number, and k denotes a band number.

Next, the phases of the left-channel signal and the right-channel signal are calculated using the phase parameter decoded in operation 3310 illustrated in FIG. 33 or 34, based on the phase of the mono signal (operation 3710). Here, the phase parameter is a phase difference $\psi_{n,k}$ calculated so that the difference between the energy levels of the actual stereo signal and the stereo signal to which the calculated phase difference is to be applied can be minimized in order to minimize an error between the phases of the actual stereo signal and a stereo signal that is to be decoded by a decoding apparatus.

If the phase parameter is the phase difference $\psi_{n,k}$ on an assumption that both the encoding apparatus and the decoding apparatus have determined that the difference between the phases of the left-channel signal and the mono signal is equal to the difference between the phases of the right-channel signal and the mono signal, the phase of the left-channel signal is calculated by adding $\psi_{n,k}$ to the phase of the mono signal and the phase of the right-channel signal is calculated by subtracting $\psi_{n,k}$ from the phase of the mono signal in operation 3710.

Thereafter, a decorrelator produces a decorrelated signal that is a vertical vector component of the mono signal (operation 3720).

Next, the left-channel signal and the right-channel signal are adjusted by enhancing the phases of the left-channel signal and the right-channel signal that are calculated in operation 3710, based on the decorrelated signal and the mono signal by using the enhancement parameter decoded in operation 3320 illustrated in FIG. 33 (operation 730). If it is assumed that the enhancement parameter is $\alpha_m$ calculated by the encoding apparatus, it is possible to adjust the left-channel signal by using Equation (40) and the right-channel signal by using Equation (41), as follows:

$$\begin{aligned}\hat{L}_{n,k} &= \tilde{L}_{n,k}\cos(\alpha_m) + g_m e^{j\psi_{n,k}} D_{n,k}\sin(\alpha_m) \\ &= g_m M_{n,k} e^{j\psi_{n,k}}\cos(\alpha_m) + g_m e^{j\psi_{n,k}} D_{n,k}\sin(\alpha_m),\end{aligned} \quad (40)$$

wherein $\hat{L}_{n,k}$ denotes the left-channel signal adjusted in operation 3730, $\tilde{L}_{n,k}$ denotes the left-channel signal obtained by applying the amplitude and phase of the left-channel signal that are respectively calculated in operations 3700 and 3710, $g_m$ denotes the gain, $\psi_{n,k}$ denotes a phase difference indicated by the phase parameter, $D_{n,k}$ denotes the amplitude of the decorrelated signal, $\alpha_m$ denotes the phase indicated by the enhancement parameter, and $M_{n,k}$ denotes the amplitude of the mono signal.

$$\begin{aligned}\hat{R}_{n,k} &= \tilde{R}_{n,k}\cos(\alpha_m) - (2-g_m)e^{-j\psi_{n,k}}D_{n,k}\sin(\alpha_m) \\ &= (2-g_m)M_{n,k}e^{-j\psi_{n,k}}\cos(\alpha_m) - (2-g_m)e^{j\psi_{n,k}}D_{n,k}\sin(\alpha_m),\end{aligned} \tag{41}$$

wherein $\hat{R}_{n,k}$ denotes the right-channel signal adjusted in operation 3730, $\tilde{R}_{n,k}$ denotes a right-channel signal obtained by applying the amplitude and phase of the right-channel signal that are respectively calculated in operations 3700 and 3710, $g_m$ denotes the gain, $\psi_{n,k}$ denotes the phase difference indicated by phase parameter, $D_{n,k}$ denotes the amplitude of the decorrelated signal, $\alpha_m$ denotes the phase indicated by the enhancement parameter, and $M_{n,k}$ denotes the amplitude of the mono signal.

Then, the stereo signal is produced by generating the left-channel signal and the right-channel signal, based on the amplitudes of the left-channel signal and the right-channel signal that are calculated in operation 3700, the phases of the left-channel signal and the right-channel signal that are calculated in operation 3710, and the phases of the left-channel signal and the right-channel signal that are adjusted in operation 3730 (operation 3740).

Figure 38:
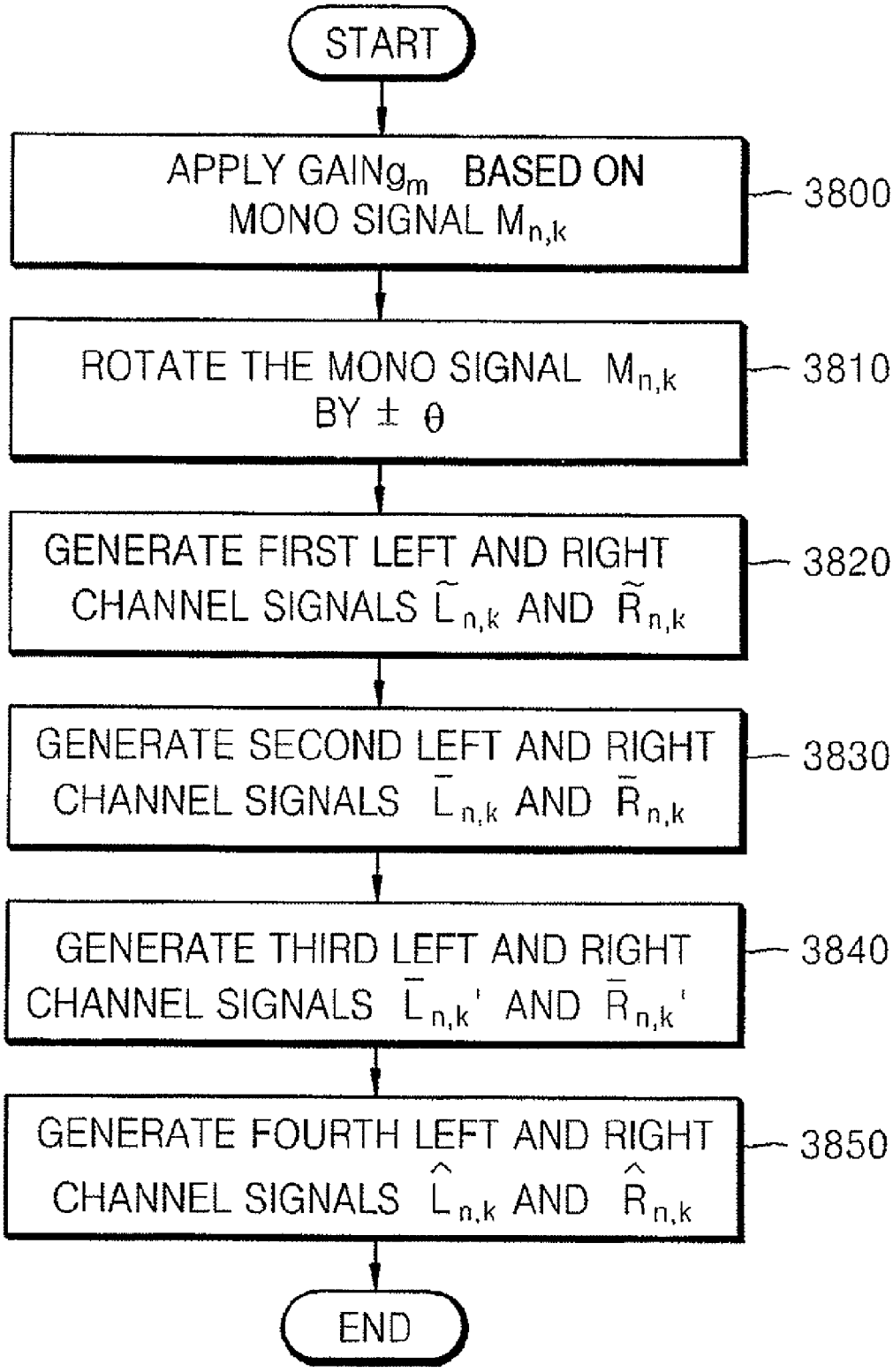
FIG. 38 is a flowchart illustrating in detail operation 2930, 3040, 3130 or 3240 illustrated in FIG. 37 by using the graph illustrated in FIG. 18.

FIG. 38 is a flowchart illustrating in detail operation 2930, 3040, 3130 or 3240 illustrated in FIG. 37 by using the graph illustrated in FIG. 18.

First, the amplitudes of the left-channel signal and the right-channel signal are calculated by applying the gain $g_m$, based on the mono signal $M_{n,k}$ (operation 3800).

Next, the phases of the left-channel signal and the right-channel signal are calculated by applying the phase difference $\theta$, that is, by respectively rotating the mono signal $M_{n,k}$ by an angle of $\theta°$ and an angle of $-\theta°$ (operation 3810).

Next, the first left-channel signal $\tilde{L}_{n,k}$ and the first right-channel signal $\tilde{R}_{n,k}$ are produced using the amplitudes of the left-channel signal and the right-channel signal that are calculated in operation 3800 and the phases of the left-channel signal and the right-channel signal that are calculated in operation 3810 (operation 3820).

Next, a second left-channel signal $\bar{L}_{n,k}$ is produced by adjusting the amplitude of the first left-channel signal $\tilde{L}_{n,k}$ to $|\tilde{L}_{n,k}|\cos(\alpha_m)$, and a second right-channel signal $\bar{R}_{n,k}$ is produced by adjusting the amplitude of the first right-channel signal $\tilde{R}_{n,k}$ to $|\tilde{R}_{n,k}|\cos(\alpha_m)$ (operation 3830).

Next, a second decorrelated signal $D_{n,k}^{L}$ is produced by rotating the first decorrelated signal $D_{n,k}$ by the phase difference $\psi_{n,k}$, a third left-channel signal $\bar{L}_{n,k}'$ is produced by adjusting the amplitude of the second left-channel signal $\bar{L}_{n,k}$ to $|\tilde{L}_{n,k}|\sin(\alpha_m)(=M_n g_m \sin(\alpha_m)=g_m|M_n|\sin(\alpha_m)=g_m|D_n|\sin(\alpha_m))$, and then, a third right-channel signal $\bar{R}_{n,k}'$ is produced similarly (operation 3840).

Thereafter, a fourth left-channel signal $\hat{L}_{n,k}$ is produced by combining the second left-channel signal $\bar{L}_{n,k}$ and the third left-channel signal $\bar{L}_{n,k}'$, and a fourth right-channel signal $\hat{R}_{n,k}$ is produced by combining the second right-channel signal $\bar{R}_{n,k}$ and the third right-channel signal $\bar{R}_{n,k}'$ (operation 3850).

As illustrated in FIG. 19, in operation 2930, 3040, 3130 or 3240, the mono signal $M_{n,k}$ is received, the decorrelated signal $D_{n,k}$ is produced by the decorrelator 1720, and then, the left-channel signal $\hat{L}_{n,k}$ and the right-channel signal $\hat{R}_{n,k}$ are produced based on the mono signal $M_{n,k}$ and the decorrelated signal $D_{n,k}$ by using the gain $g_m$ represented by the size parameter, the phase difference $\psi_{n,k}$ represented by the phase parameter, and the phase $\alpha_m$ represented by the enhancement parameter.

The method, illustrated in FIG. 19, of generating a left-channel signal and a right-channel signal can be simply expressed by:

$$\begin{aligned}\begin{bmatrix}\hat{L}_{n,k}\\ \hat{R}_{n,k}\end{bmatrix} &= \begin{bmatrix}e^{j\psi_{n,k}} & 0\\ 0 & e^{-j\psi_{n,k}}\end{bmatrix}\begin{bmatrix}g_m & 0\\ 0 & (2-g_m)\end{bmatrix}\begin{bmatrix}\cos(\alpha_m) & \sin(\alpha_m)\\ \cos(\alpha_m) & -\sin(\alpha_m)\end{bmatrix}\begin{bmatrix}M_{n,k}\\ D_{n,k}\end{bmatrix} \\ &= \begin{bmatrix}g_m e^{j\psi_{n,k}}\cos(\alpha_m) & g_m e^{j\psi_{n,k}}\sin(\alpha_m)\\ (2-g_m)e^{-j\psi_{n,k}}\cos(\alpha_m) & -(2-g_m)e^{-j\psi_{n,k}}\sin(\alpha_m)\end{bmatrix}\begin{bmatrix}M_{n,k}\\ D_{n,k}\end{bmatrix},\end{aligned} \tag{42}$$

wherein $\hat{L}_{n,k}$ denotes the finally generated left-channel signal, $\hat{R}_{n,k}$ denotes the finally generated right-channel signal, $\psi_{n,k}$ denotes the phase difference represented by the phase parameter, $g_m$ denotes the gain, $\alpha_m$ denotes the phase represented by the enhancement parameter, $M_{n,k}$ denotes the mono signal, and $D_{n,k}$ denotes the decorrelated signal.

According to Equation (42), first, rotation transformation is performed on the mono signal $M_{n,k}$ and the decorrelated signal $D_{n,k}$, size transformation is performed, and then, phase adjustment is performed, but the present invention is not limited thereto.

A method and apparatus for encoding and decoding a stereo signal according to the present invention have been described above with reference to FIGS. 1 through 38. Those of ordinary skill in the art may easily derive from FIGS. 1 through 38 a method and apparatus for encoding a multi-channel signal by downmixing three or more signals to one or less than the number of signals and encoding the downmixed signal(s), and a method and apparatus for decoding a multi-channel signal by upmixing one or more signals to three or more signals and decoding the upmixed signals.

The present invention can be embodied as code that can be read by a computer system (any device capable of processing information) in a computer readable medium. Here, the computer readable medium may be any recording apparatus capable of storing data that is read by the computer system, e.g., a read-only memory (ROM), a random access memory (RAM), a compact disc (CD)-ROM, a magnetic tape, a floppy disk, an optical data storage device, and so on.

In a method and apparatus for encoding and decoding a stereo signal and a multi-channel signal according to the present invention, a stereo signal or a multi-channel signal can be encoded or decoded by producing parameters based on a mono signal.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of decoding a stereo signal, comprising:

decoding a parameter that represents a ratio of the amplitude of at least one of signals contained in the stereo signal to the amplitude of a mono signal;

decoding a parameter that represents the difference between the phases of at least one of the signals contained in the stereo signal and the mono signal; and upmixing the mono signal to the stereo signal by using the decoded parameters.

2. The method of claim 1, further comprising decoding a parameter for adjusting the phase difference by using a decorrelated signal.

3. The method of claim 1, wherein the upmixing of the mono signal to the stereo signal comprises:

determining the amplitude of the stereo signal by using the decoded parameter that represents the ratio of amplitude;

determining the phase of the stereo signal by using the decoded parameter that represents the phase difference; and generating the stereo signal according to the determined amplitude and phase.

4. The method of claim 2, wherein the upmixing of the mono signal to the stereo signal comprises:

determining the amplitude of the stereo signal by using the decoded parameter that represents the ratio of amplitude;

determining the phase of the stereo signal by using the decoded parameter that represents the phase difference;

adjusting the determined phase of the stereo signal by using the parameter for adjusting the phase difference; and generating the stereo signal according to the determined amplitude and phase.

5. The method of claim 1, wherein at least one of the parameters is generated for each frame, in band units.

6. The method of claim 1, further comprising transforming the stereo signal into a domain for expressing both the amplitude and phase of the stereo signal.

7. The method of claim 1, wherein the mono signal is generated on a half sum vector of the stereo signal.

8. The method of claim 1, wherein the mono signal is downmixed to an amplitude equal to the average amplitude of the signals contained in the stereo signal.

9. The method of claim 1, wherein, if the phase of the stereo signal is adjusted and encoded since the difference between the phases of a left-channel signal and a right-channel signal contained in the stereo signal falls within a predetermined, further comprising adjusting the phase of the upmixed stereo signal.

10. The method of claim 9, wherein the predetermined range is determined based on 180 degrees.

11. The method of claim 9, further comprising encoding information related to the adjusted phase.

12. The method of claim 3, wherein the determining of the phase of the stereo signal is based on an assumption that the difference between the phases of the mono signal and a left-channel signal is equal to the difference between the phases of the mono signal and a right-channel signal.

13. The method of claim 1, wherein the relation between the amplitudes of a left-channel signal and a right-channel signal that are contained in the stereo signal is predetermined.

14. A non-transitory computer readable medium having recorded thereon a computer program for executing a method of decoding a stereo signal, the method comprising:

decoding a parameter that represents a ratio of the amplitude of at least one of signals contained in the stereo signal to the amplitude of a mono signal;

decoding a parameter that represents the difference between the phases of at least one of the signals contained in the stereo signal and the mono signal; and upmixing the mono signal to the stereo signal by using the decoded parameters.

15. An apparatus for decoding a stereo signal, comprising:

a size parameter decoding unit decoding a parameter that represents a ratio of the amplitude of at least one of signals contained in the stereo signal to the amplitude of a mono signal;

a phase parameter decoding unit decoding a parameter that represents the difference between the phases of at least one of the signals contained in the stereo signal and the mono signal; and an upmixing unit upmixing the mono signal to the stereo signal by using the decoded parameters.

16. The apparatus of claim 15, further comprising an enhancement parameter decoding unit decoding a parameter for adjusting the phase difference by using a decorrelated signal.

17. The apparatus of claim 16, wherein the up-mixing unit comprises:

a amplitude determination unit determining the amplitude of the stereo signal by using the decoded parameter that represents the ratio of amplitude;

a phase determination unit determining the phase of the stereo signal by using the decoded parameter that represents the phase difference;

a phase adjustment unit adjusting the determined phase of the stereo signal by using the parameter for adjusting the phase difference; and a signal generation unit generating the stereo signal according to the determined amplitude and phase.

18. The apparatus of claim 15, further comprising:

adjusting the phase of the upmixed stereo signal if the phase of the stereo signal is adjusted and encoded since the difference between the phases of a left-channel signal and a right-channel signal contained in the stereo signal falls within a predetermined.

19. The apparatus of claim 15, wherein the phase determination unit determines the phase of the stereo signal, based on an assumption that the difference between the phases of the mono signal and a left-channel signal is equal to the difference between the phases of the mono signal and a right-channel signal.

20. An apparatus for decoding a multi-channel signal, comprising:

a size parameter decoding unit decoding a parameter that represents a ratio of the amplitude of at least one of the signals contained in the multi-channel signal to the amplitude of at least one of downmixed signals, where the multi-channel signal comprises at least two signals;

a phase parameter decoding unit decoding a parameter that represents the difference between phases of least one of the signals of the multi-channel signal and at least one of the downmixed signals; and an upmixing unit upmixing the downmixed signals to the multi-channel signal by using the decoded parameters.

* * * * *